US009772159B2

(12) United States Patent
Isabelle

(10) Patent No.: US 9,772,159 B2
(45) Date of Patent: Sep. 26, 2017

(54) PAINTBALL MARKER LOADING AND FEEDING SYSTEM

(71) Applicant: Michael Allan Isabelle, Burnaby (CA)

(72) Inventor: Michael Allan Isabelle, Burnaby (CA)

( * ) Notice: Subject to any disclaimer, the term of this patent is extended or adjusted under 35 U.S.C. 154(b) by 218 days.

(21) Appl. No.: 14/341,202

(22) Filed: Jul. 25, 2014

(65) Prior Publication Data

US 2015/0027426 A1 Jan. 29, 2015

Related U.S. Application Data

(60) Provisional application No. 61/858,545, filed on Jul. 25, 2013, provisional application No. 61/991,357, filed on May 9, 2014.

(51) Int. Cl.

| | |
|---|---|
| ***F41B 11/52*** | (2013.01) |
| ***F41A 9/82*** | (2006.01) |
| ***F42B 39/02*** | (2006.01) |
| ***F42B 39/26*** | (2006.01) |

(52) U.S. Cl.

CPC ..... *F41B 11/52* (2013.01); *F41A 9/82* (2013.01); *F42B 39/02* (2013.01); *F42B 39/26* (2013.01)

(58) Field of Classification Search

CPC F41B 11/52; F41B 11/55; F41B 11/50; F41A 9/63; F41A 9/82

USPC ..... 124/45, 49, 51.1

See application file for complete search history.

(56) References Cited

U.S. PATENT DOCUMENTS

| | | | | |
|---|---|---|---|---|
| 5,809,983 | A * | 9/1998 | Stoneking | F41B 11/52 124/45 |
| 6,055,975 | A * | 5/2000 | Gallagher | F41B 11/52 124/49 |
| 6,109,252 | A | 8/2000 | Stevens | |
| 6,205,991 | B1 * | 3/2001 | Summers | F41B 5/1469 124/35.2 |
| 6,234,157 | B1 * | 5/2001 | Parks | F41B 11/52 124/45 |
| 6,273,079 | B1 * | 8/2001 | Jzn | F41B 11/54 124/45 |
| 6,644,293 | B2 * | 11/2003 | Jong | A45F 5/02 124/52 |
| 6,722,355 | B1 * | 4/2004 | Andrews, Jr. | F41B 11/52 124/49 |
| 6,923,170 | B2 | 8/2005 | Ho et al. | |
| 6,935,324 | B2 * | 8/2005 | Watson | F41B 11/52 124/49 |
| 7,000,603 | B1 * | 2/2006 | Steenbeke | F41B 11/52 124/45 |
| 7,017,569 | B2 * | 3/2006 | Jong | A45F 5/02 124/51.1 |
| 7,077,118 | B2 * | 7/2006 | Lewis | F41B 11/50 124/45 |

(Continued)

*Primary Examiner* — Alexander Niconovich
(74) *Attorney, Agent, or Firm* — Smiths IP

(57) ABSTRACT

An assembly for rapid loading and feeding of paintballs in a paintball marker comprises a receiver mountable on the marker, having an opening to receive and secure a magazine carrying paintballs. An ejection mechanism to clear a magazine from the opening may also be provided. The magazine comprises an outer shell that interacts with the receiver to secure the magazine, and holds an arming mechanism that is manipulated by twisting or pulling to selectively cover apertures in the outer shell to secure the paintballs within the magazine, or uncover the apertures to release the paintballs.

45 Claims, 106 Drawing Sheets

(56) References Cited

U.S. PATENT DOCUMENTS

| | | | | |
|---|---|---|---|---|
| 7,270,120 | B2 * | 9/2007 | Broersma | F41B 11/53 124/45 |
| 7,322,348 | B2 * | 1/2008 | Chen | F41B 11/53 124/51.1 |
| 7,426,927 | B1 * | 9/2008 | Broersma | F41B 11/52 124/49 |
| 7,617,817 | B1 * | 11/2009 | Kulp | F41B 11/52 124/45 |
| 7,779,825 | B2 | 8/2010 | Estrate | |
| 7,975,681 | B2 * | 7/2011 | Handel | F41A 9/64 124/49 |
| 8,302,586 | B2 * | 11/2012 | Isabelle | F41B 11/52 124/49 |
| 2002/0059927 | A1 * | 5/2002 | Woods, Sr. | F41B 11/50 124/45 |
| 2004/0074488 | A1 * | 4/2004 | Ho | F41B 11/52 124/57 |
| 2005/0166904 | A1 * | 8/2005 | Friesen | F41B 11/52 124/45 |
| 2006/0180134 | A1 * | 8/2006 | Illuzzi | F41A 9/24 124/74 |
| 2008/0047535 | A1 * | 2/2008 | Handel | F41B 11/53 124/49 |
| 2008/0053422 | A1 * | 3/2008 | Estrate | F41A 9/63 124/49 |
| 2008/0087264 | A1 * | 4/2008 | Postorivo | F41B 11/52 124/45 |
| 2009/0229589 | A1 * | 9/2009 | Karnis | F41B 11/52 124/45 |
| 2011/0226226 | A1 * | 9/2011 | Isabelle | F41B 11/52 124/45 |

* cited by examiner

PAINTBALL MARKER LOADING AND FEEDING SYSTEM

TECHNICAL FIELD OF THE INVENTION

This invention relates to a storage container and an assembly for rapid loading and feeding of ammunition into paintball markers.

BACKGROUND OF THE INVENTION

Paintball is a popular competitive game in which players attempt to eliminate other players by hitting them with projectiles filled with paint. The game therefore requires players to move and react very quickly, both to hit other players and to avoid being hit. In order to successfully hit another player, who is usually a fast-moving target, it is advantageous to be able to shoot several projectiles in rapid succession. It is therefore advantageous to have a virtually unlimited supply of paintballs to avoid running out of ammunition during a game.

Paintballs were often stored in a hopper mounted on the paintball marker and manually refilled once the hopper emptied, but this procedure is time-consuming, wasteful of paintballs that are not cleanly poured into the hopper, and leaves a player defenseless during the refilling process.

Players are therefore looking for the flexibility and speed of a "magazine" type of system, in which the player carries disposable or replaceable pods or magazines full of paintballs about his person, such as in his vest or pants pockets, on a belt, harness or holster, or in another carrying system. The magazine is inserted into a receiver carried on the marker, and the paintballs are either immediately or gradually fed into the marker for shooting. When a magazine has been emptied, it is ejected or otherwise removed from the receiver and replaced with a full magazine. Examples of such paintball loading mechanisms are shown in U.S. Patent Publication No. 2008/0047535 to Handel, U.S. Pat. No. 7,270,120 to Broersma et al., and Applicant's own U.S. Pat. No. 8,302,586.

One potential drawback with these systems is the degree of certainty available, specifically that the user be able to ensure that the magazine has been securely inserted, in the correct place, and with the proper alignment, so that it is certain that the pod is securely attached and won't fall out at an inopportune time, and so that the pod correctly and easily feeds its load of paintballs into the marker. For example, Handel uses a flat two-guide rail mechanism, while in Broersma the magazine simply slides across the top of the marker, relying on a friction-based attachment mechanism to secure the magazine. While Applicant's earlier patent includes a locking mechanism and is designed to provide a positive lock that can easily be felt by the player, it may be preferable to provide an even more secure configuration, and one that may be simpler to produce and operate, with fewer external moving pieces, and a simpler connection to a receiver.

It is therefore an object of the present invention to provide a paintball loading and feeding assembly that overcomes the foregoing disadvantages.

It is a further object of the present invention to provide a system in which an emptied or partially emptied paintball magazine can be easily, quickly and securely replaced with a full magazine.

It is a further object of the present invention to provide a receiver for a paintball marker that will accept a full paintball magazine and efficiently hold and funnel the paintballs contained in the magazine to the marker, while minimizing the flow of paintballs back towards the magazine. The receiver may also contain an area to accommodate excess paintballs away from an inserted magazine to avoid breakage of paintballs that do not properly enter, or accidentally exit from, the marker.

It is yet a further object of the present invention to provide a replacement paintball magazine for a rapid paintball marker loading and feeding system that can be easily assembled and disassembled for maintaining and cleaning the magazine.

These and other objects of the invention will be better understood by reference to the detailed description of the preferred embodiments which follows. Note that the objects referred to above are statements of what motivated the invention rather than promises. Not all of the objects are necessarily met by all embodiments of the invention described below or by the invention defined by each of the claims.

SUMMARY OF THE INVENTION

The invention provides a modular assembly comprising magazines of varying shapes and capacities that function with varying receivers. The receiver portion of the invention can be releasably mounted or integrated directly into a marker. The magazine is designed to be securely fitted quickly and easily within the receiver, allowing for rapid loading of paintballs to the marker.

To load a magazine into a receiver, the user holds the paintball marker with one hand and places an end of the magazine inside the front end of the receiver with the other. Alignment means on both the magazine and the receiver allow the user to ensure that the magazine is properly aligned during the initial insertion into the receiver, before applying additional pressure from the rear end of the magazine until the magazine is fully inserted and locked into position. The user receives confirmation, which may be audible, tactile, or both, that the magazine is fully and securely inserted.

Once inserted and locked into position, the magazine may be "armed" by a twisting or pulling motion, opening the magazine to allow paintballs to flow out the magazine.

In some embodiments, the weight of the magazine may be reduced by thinning, or removing entirely, portions of the various components of the magazine.

In one aspect, the invention comprises a magazine for storing and feeding paintballs to a paintball marker, the magazine comprising an outer shell adapted to hold paintballs, the outer shell comprising at least one aperture; and an arming mechanism adapted to cover and uncover the aperture, controlling flow of the paintballs from the magazine, when the arming mechanism is twisted or pulled. The magazine may further comprise at least one internal ramp to assist in funneling paintballs toward the aperture. It may further comprise a locking mechanism to prevent the arming mechanism from moving within the outer shell and/or a stopper mechanism to control rotation of the arming mechanism within the outer shell.

In a further aspect, the arming mechanism may comprise a gripper having at least one aperture cover extending therefrom, and actuation of the gripper causes the aperture cover to cover or uncover the aperture. The gripper may further comprise features such as a slip lock mechanism and/or refill means through which paintballs may be inserted into the magazine. The refill means may also or instead be located on another part of the magazine such as the outer shell or an inner tube.

In a further aspect, the outer shell may comprise a refill means through which paintballs may be inserted into the magazine. It may further comprise one or more channels to control movement of the arming mechanism. It may have a non-circular cross-section, and may comprise two or more pieces. The outer tube may comprise an outer shell guide, adapted for insertion into a receiver guide in a receiver on the marker. The outer shell may be provided with a groove in its front end to support the front end of the arming mechanism or an inner tube. The outer shell may further comprise a locking mechanism to secure the outer shell to a receiver in the marker, whether the receiver is integrated into the marker, or is a separate piece mountable on the marker.

In another aspect, the magazine may further comprise an inner tube sized to fit inside the outer shell, the inner tube comprising at least one aperture; and at least one aperture cover bounding the at least one inner tube aperture; wherein the arming mechanism aligns the inner tube and outer tube apertures to allow paintballs to flow from the magazine, and aligns the outer tube aperture and the aperture cover to prevent paintballs from flowing from the magazine.

In a further aspect, the inner tube may comprise a refill means through which paintballs may be inserted into the magazine. The inner tube may be removably attached to the arming mechanism, or it may be inseparable. It may have a non-circular cross-section, and may be provided with friction fit or other retention material between it and the outer shell to help hold the parts together. The inner tube may comprise a stopper mechanism to control rotation of the inner tube within the outer shell.

In yet a further aspect, the arming mechanism may be a gripper, which may be threadable to or inseparable from the inner tube. The gripper may further comprise a locking mechanism to prevent the inner tube from moving within the outer shell.

In a further aspect, the magazine may further comprise an inner tube lock on the inner tube; and an outer shell lock in the outer shell; wherein the outer shell lock is adapted to receive the inner tube lock to removably secure the inner tube within the outer shell. The inner tube lock may take various forms, including a flexible guide tab, a guide slot, a swivel pin, an opening to accommodate a swivel pin, or a clip, while the outer shell lock comprises a corresponding mechanism such as a guide slot, a flexible guide tab, an opening to accommodate the swivel pin, a swivel pin or a lock hole.

In another aspect, the invention comprises a receiver to facilitate loading a paintball marker with paintballs from a magazine, the receiver comprising an opening in communication with a feed neck, the opening being adapted to receive and enclose a portion of the magazine; at least one receiver guide within the opening to guide insertion of the magazine into the opening; and a rim at a top edge of the feed neck to prevent paintballs from travelling towards the magazine. The receiver guide may be at least one guide slot and/or at least one guide rail. The receiver may further comprise features such as a window for viewing paintballs within the marker, a flexible catch to hold the magazine within the opening and/or a spring mechanism to assist in ejecting the magazine from the receiver. The receiver may further comprise an overflow area spaced from a path traveled by said magazine upon insertion into said receiver, to accommodate paintballs that accidentally exit the marker or the magazine.

In another aspect, the invention comprises a loading and feeding assembly for a paintball marker comprising a magazine adapted to hold paintballs, the magazine comprising an outer shell adapted to hold paintballs, the outer shell comprising at least one aperture; and an arming mechanism adapted to cover and uncover the aperture, controlling flow of the paintballs from the magazine, when the arming mechanism is twisted or pulled; and a receiver mountable on the marker, the receiver comprising an opening in communication with a feed neck, the opening being adapted to receive and enclose a portion of the magazine; at least one guide within the opening to guide insertion of the magazine into the opening; and a rim at a top edge of the feed neck to prevent paintballs from travelling towards the magazine. The magazine may further comprise a locking mechanism to secure the outer shell to the receiver.

The magazine is easily accommodated in conventional paintball vests and pod harnesses, allowing players to carry several replacement magazines during a game.

The foregoing was intended as a summary only and of only some of the aspects of the invention. It was not intended to define the limits or requirements of the invention. Other aspects of the invention will be appreciated by reference to the detailed description of the preferred embodiments. Moreover, this summary should be read as though the claims were incorporated herein for completeness.

BRIEF DESCRIPTION OF THE DRAWINGS

The preferred embodiments of the invention will be described by reference to the drawings in which.

DETAILED DESCRIPTION OF PREFERRED EMBODIMENTS OF THE INVENTION

Figure 1:
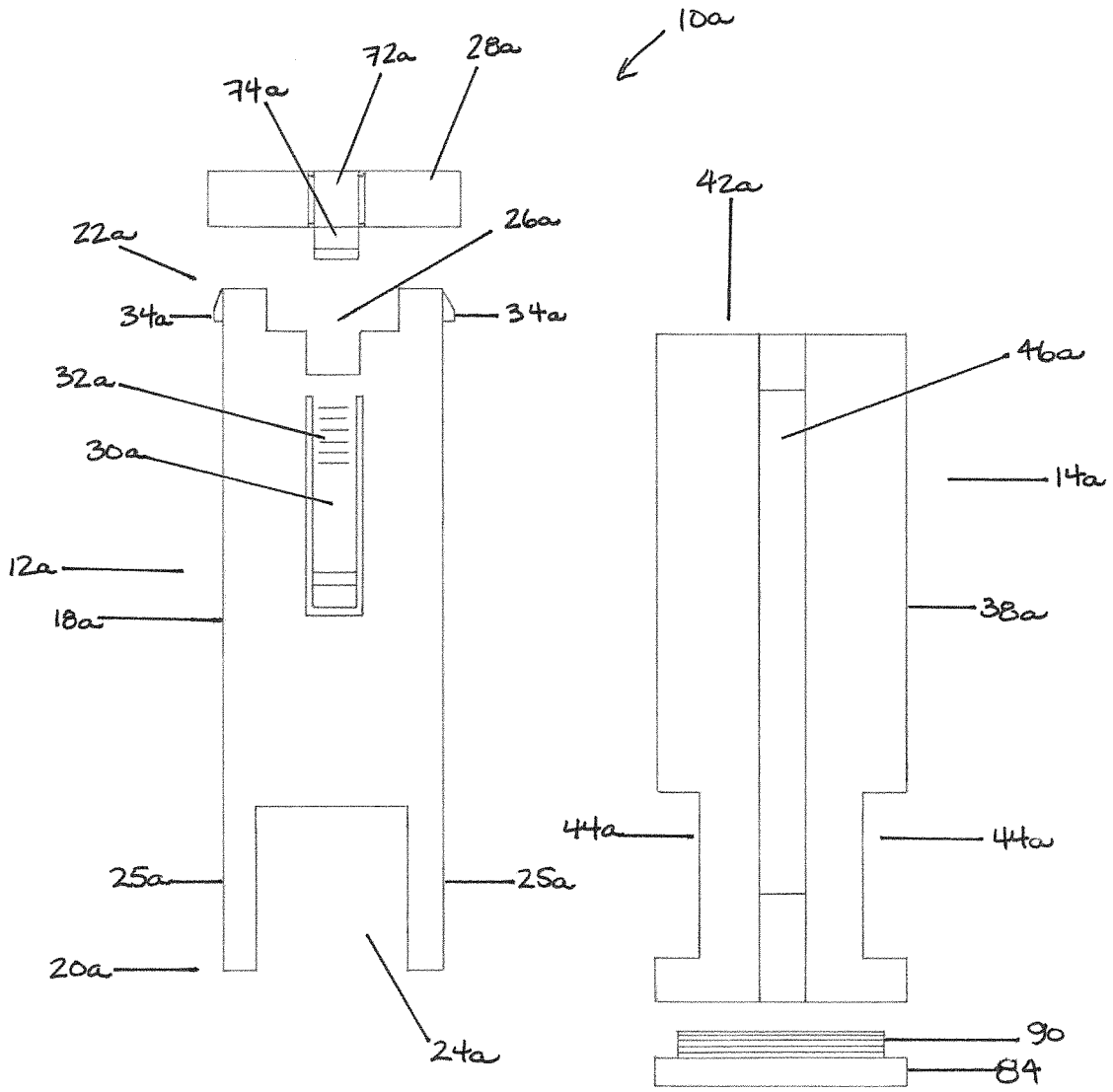
FIG. 1 is an exploded view of the components of a first embodiment of the magazine.
Figures 2A, 2B, 2C:
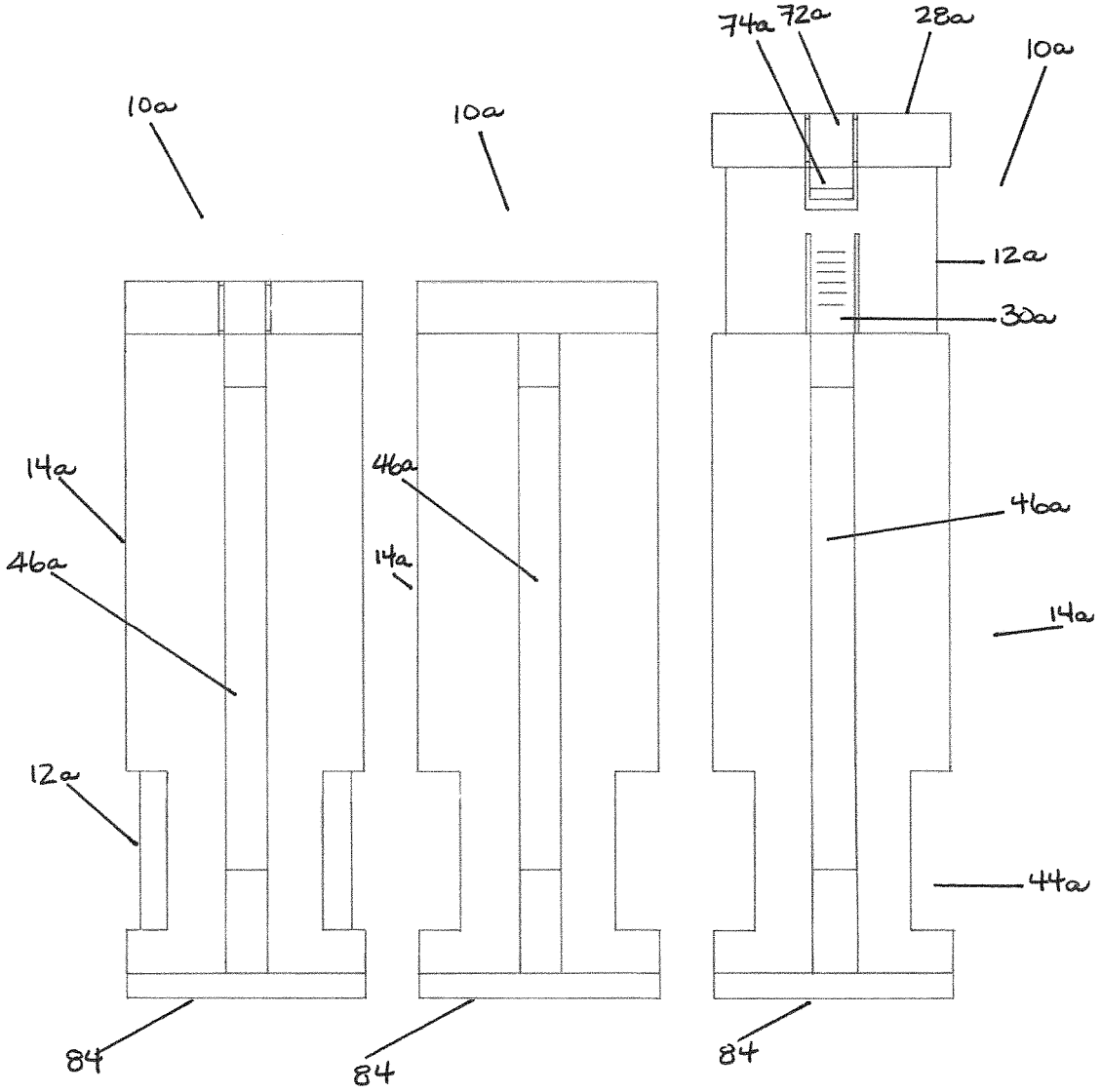
FIGS. 2*a*-2*c* are side views of the magazine of FIG. 1.
Figure 3A:
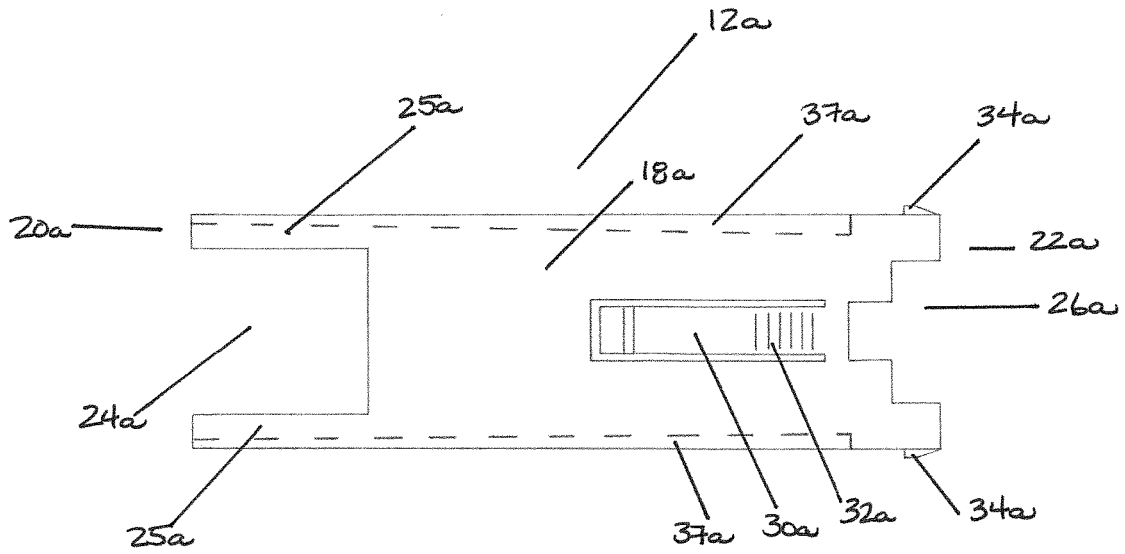
FIGS. 3*a*-3*d* are side, top, front and rear views, respectively, of a first embodiment of the inner tube of the invention.
Figure 3B:
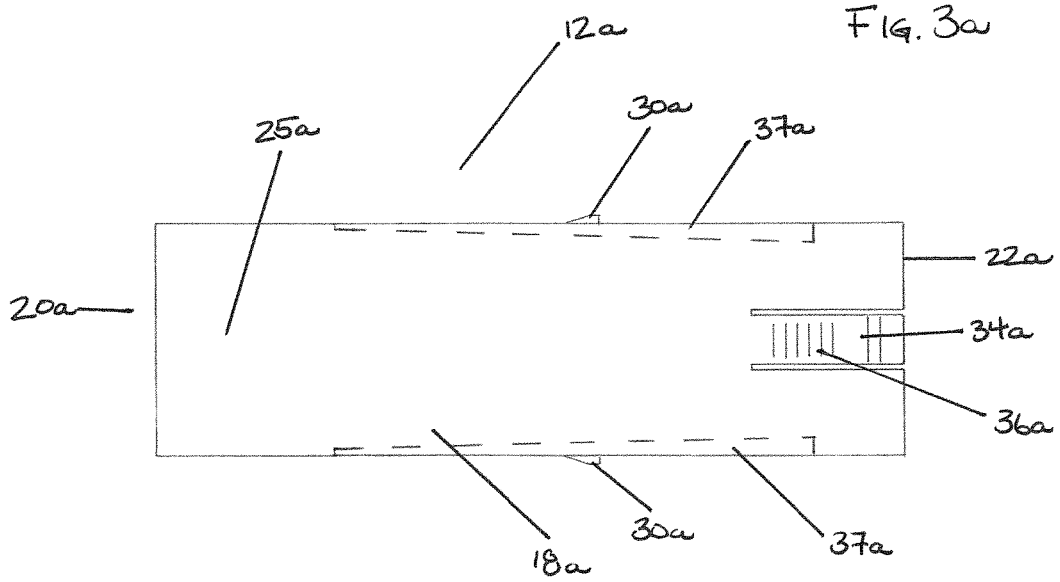
Figure 3C:
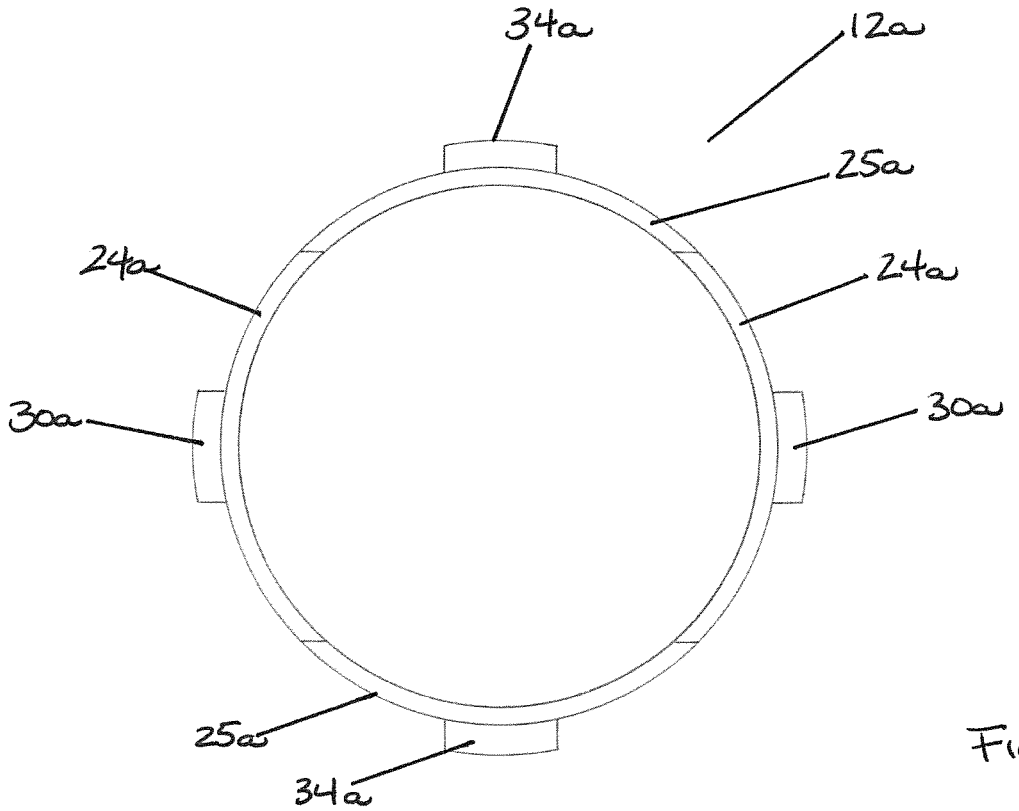
Figure 3D:
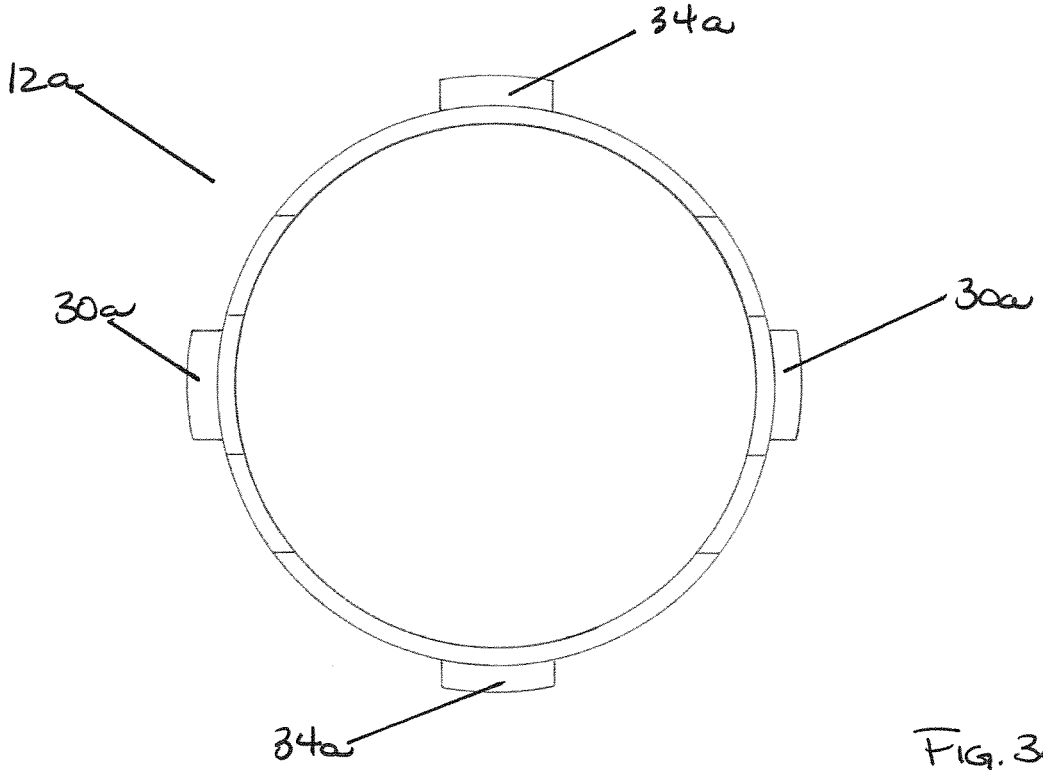
Figure 4A:
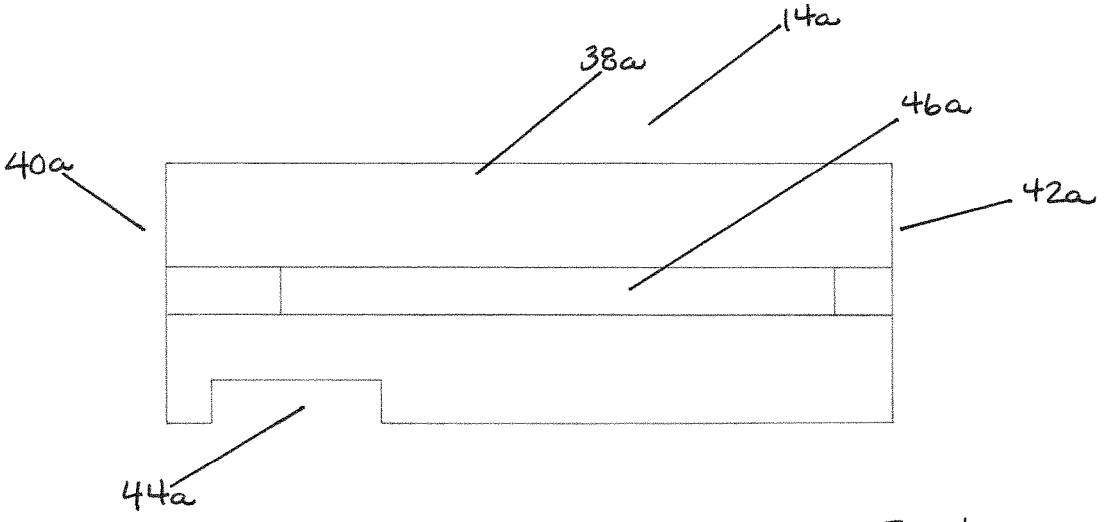
FIGS. 4*a*-4*e* are side, top, bottom, front and rear views, respectively, of a first embodiment of an outer shell of the invention.
Figure 5A:
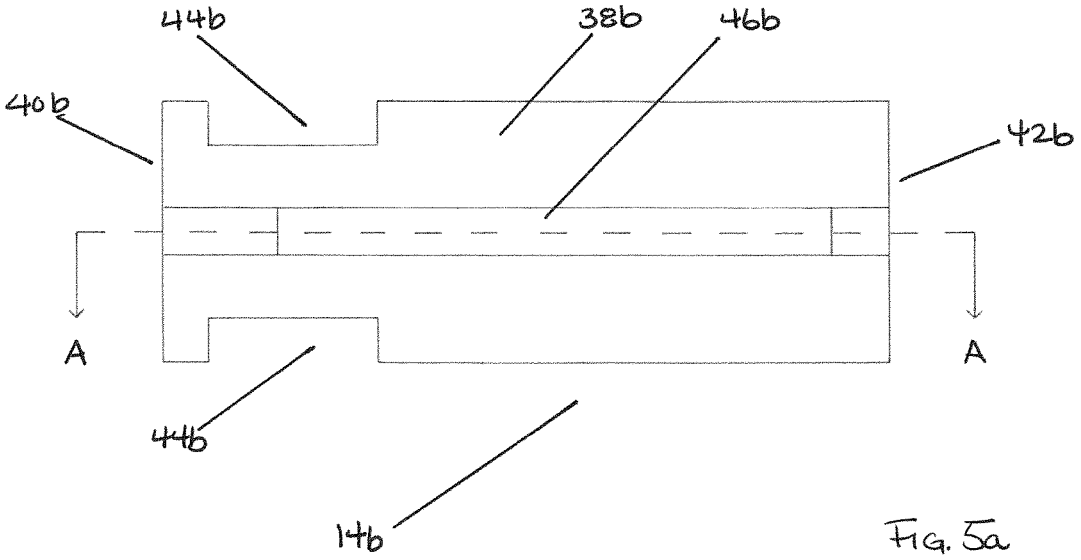
FIGS. 5*a* and 5*b* are side and top views, respectively, of a second embodiment of an outer shell of the invention.
Figure 4B:
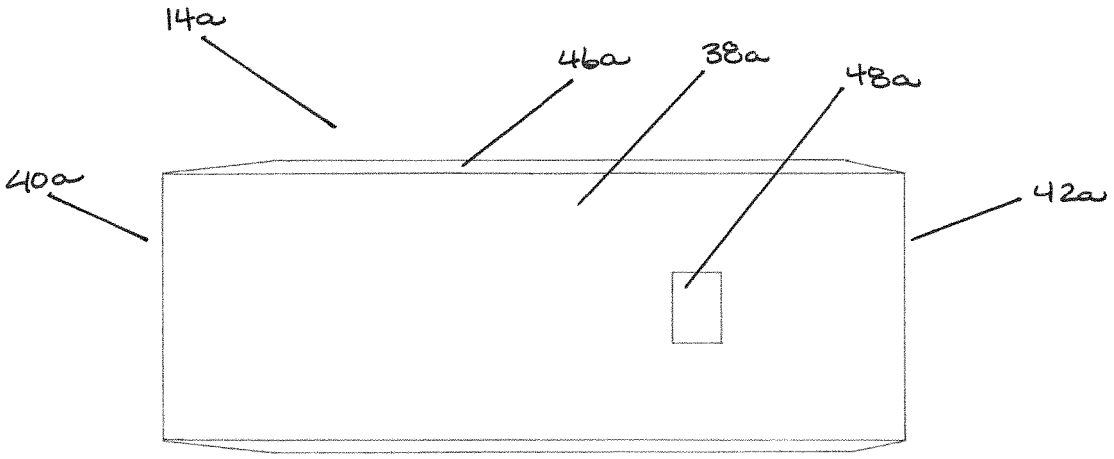
Figure 4C:
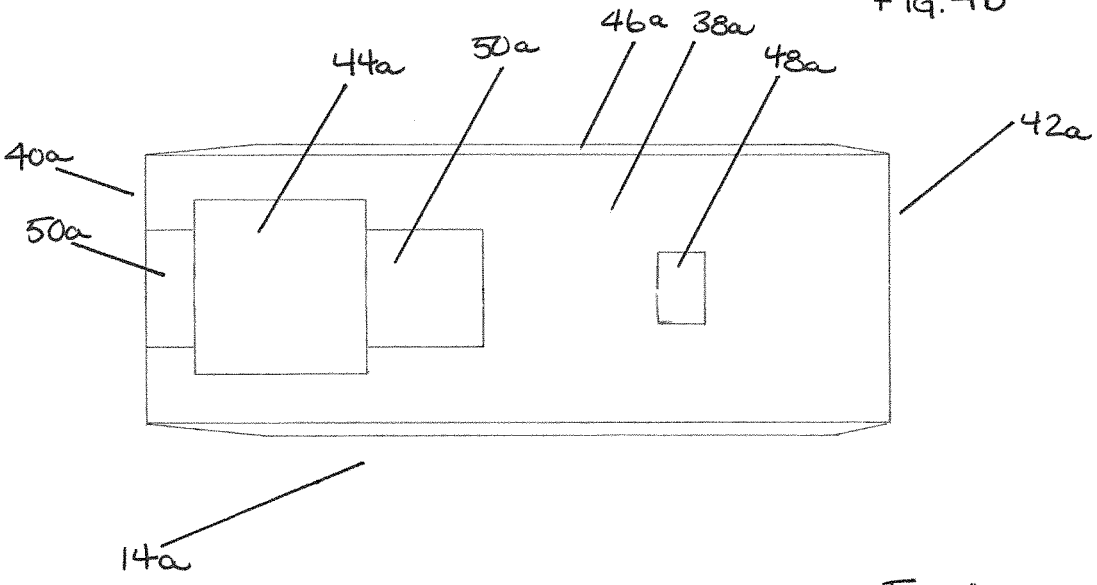
Figure 4D:
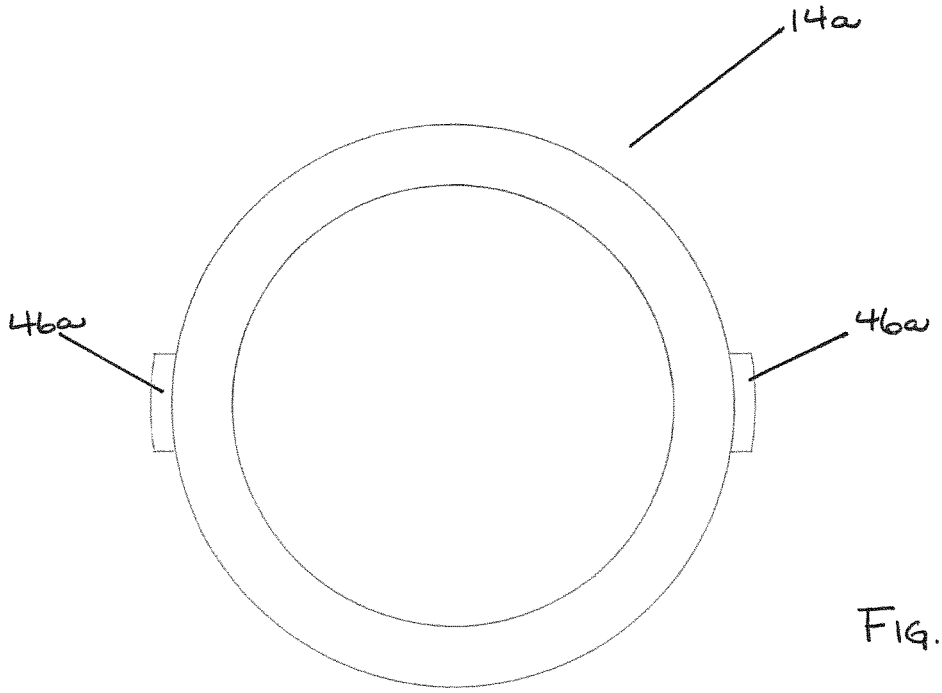
Figure 4E:
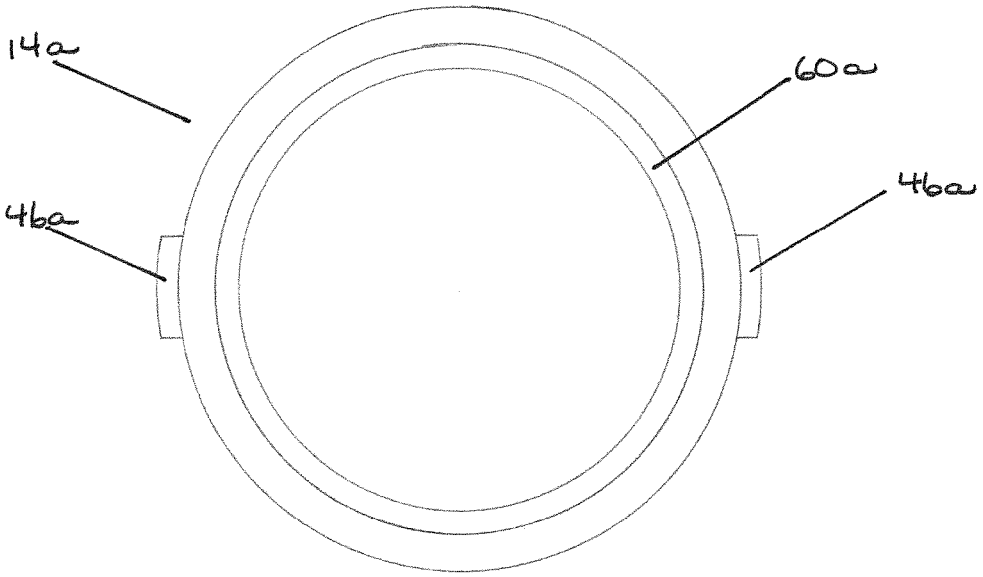
Figure 5B:
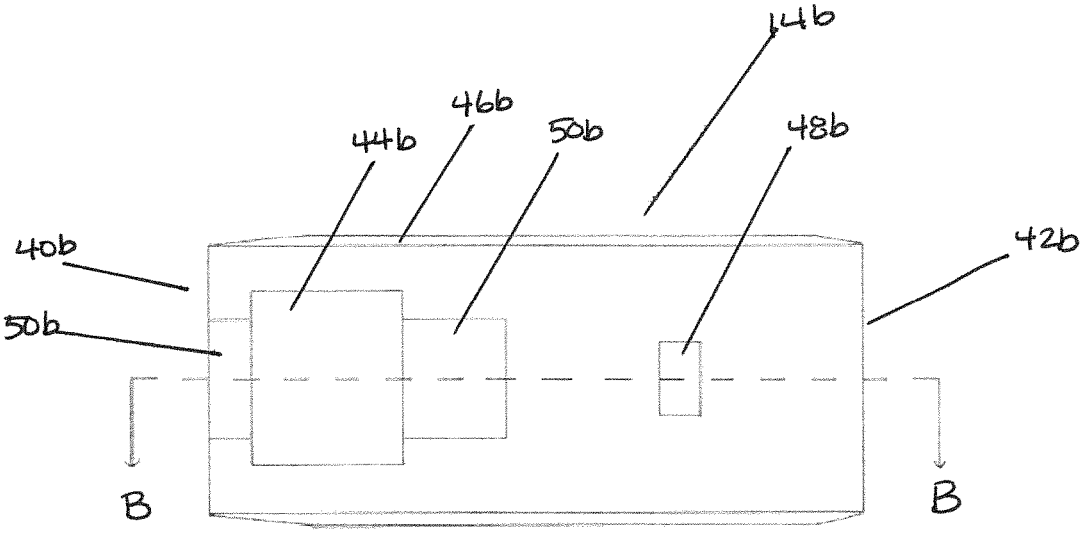
Figure 8A:
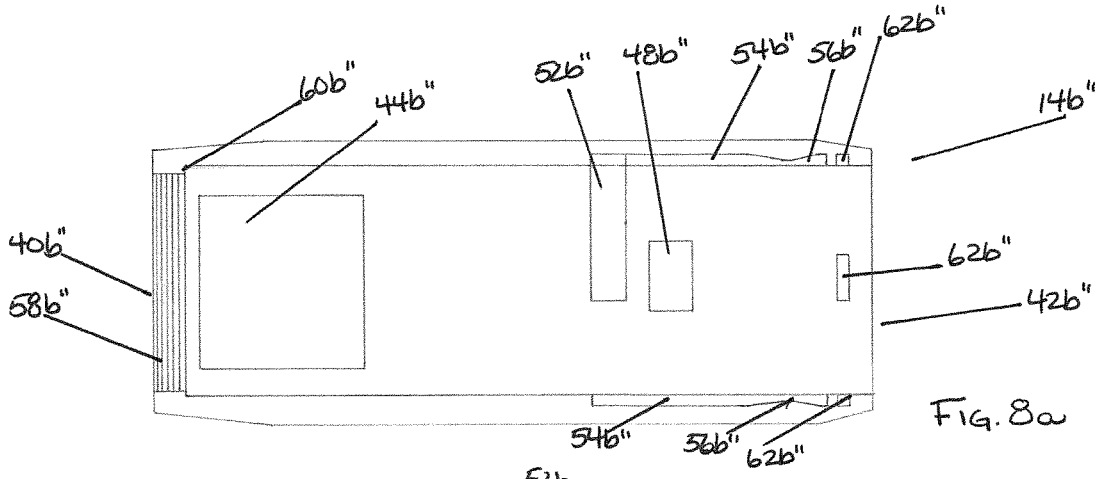
FIGS. 8*a*-8*b* are sectional views of a third embodiment of the shell of FIG. 5 taken along line A-A in FIG. 5*a* and line B-B in FIG. 5*b* respectively.
Figure 6A:
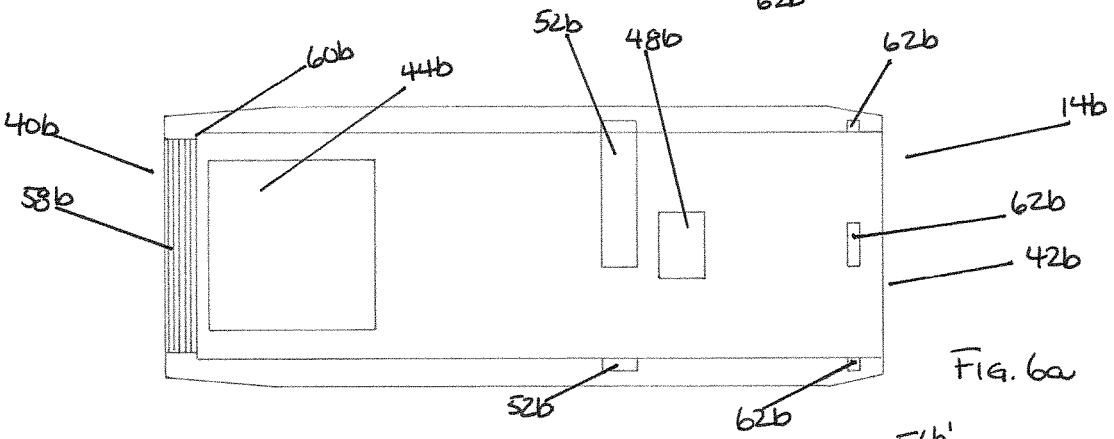
FIGS. 6*a*-6*b* are sectional views of a first embodiment of the shell of FIG. 5, taken along line A-A in FIG. 5*a* and line B-B in FIG. 5*b* respectively.
Figure 7A:
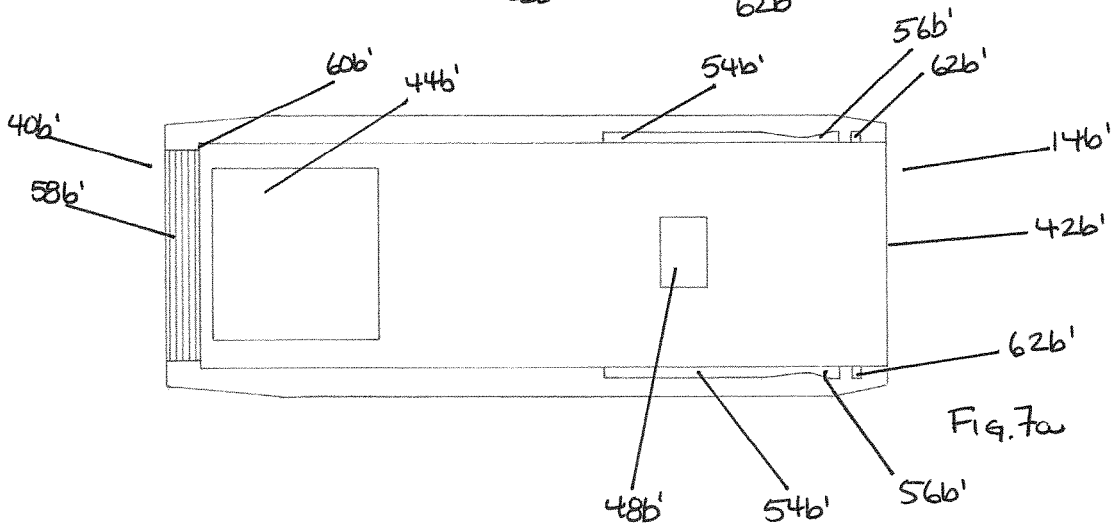
FIGS. 7*a*-7*b* are sectional views of a second embodiment of the shell of FIG. 5, taken along line A-A in FIG. 5*a* and line B-B in FIG. 5*b* respectively.
Figure 8B:
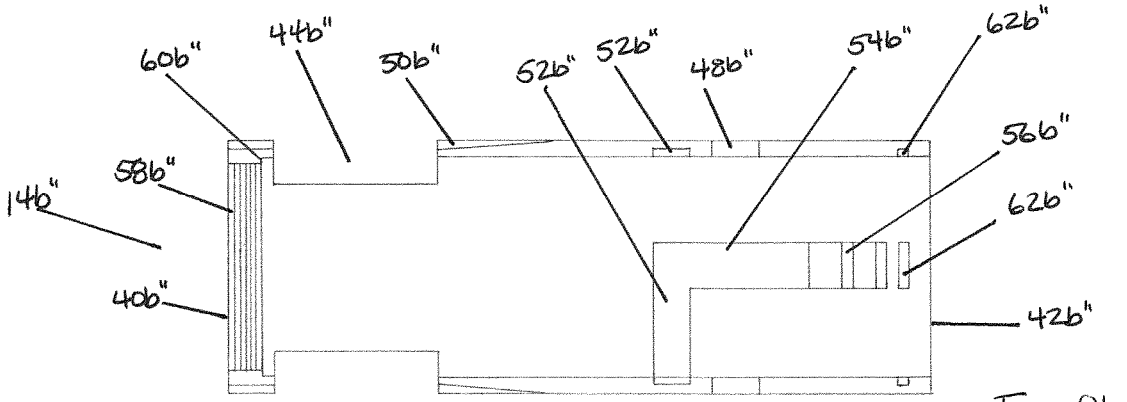
Figure 6B:
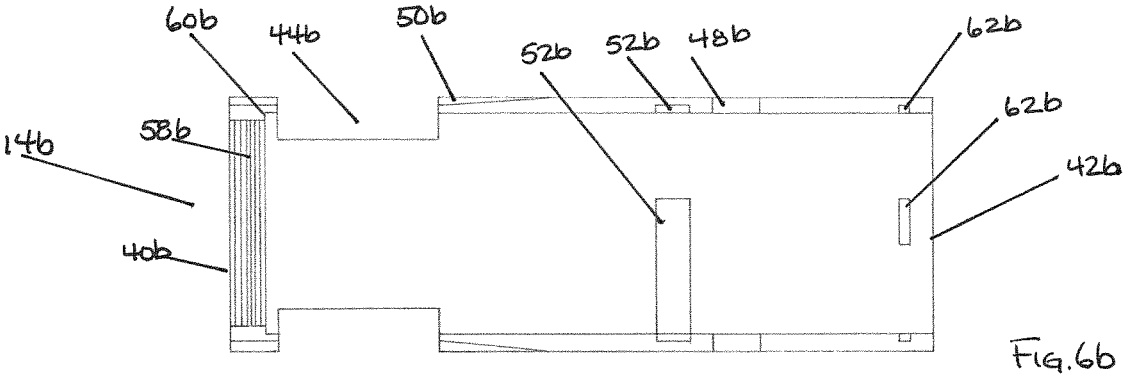
Figure 7B:
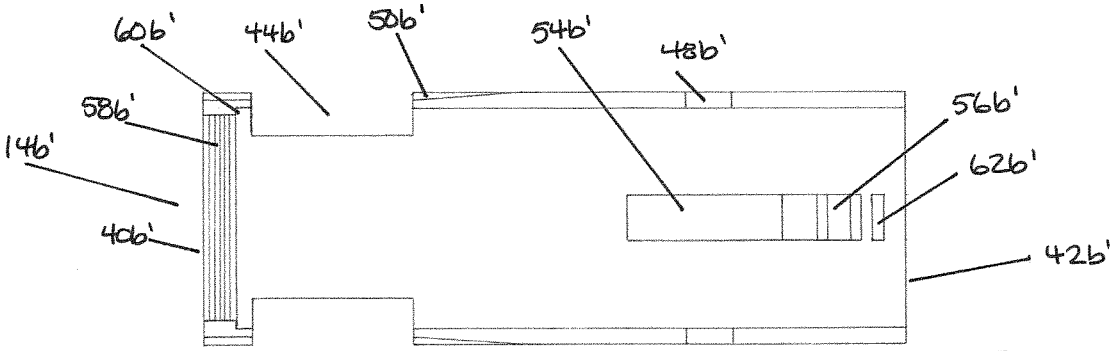
Figure 9A:
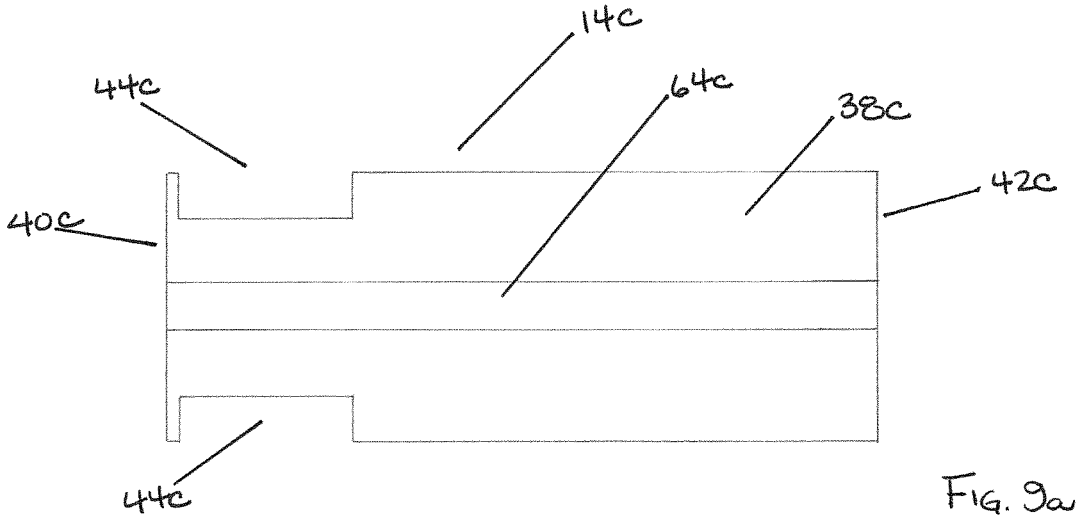
FIGS. 9*a*-9*d* are side, top, front and rear views, respectively, of a third embodiment of an outer shell of the invention.
Figure 9B:
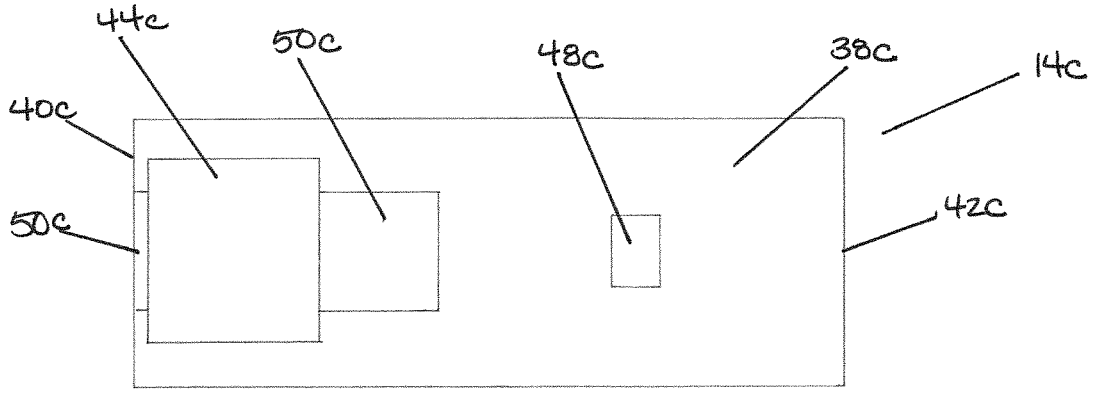
Figure 9C:
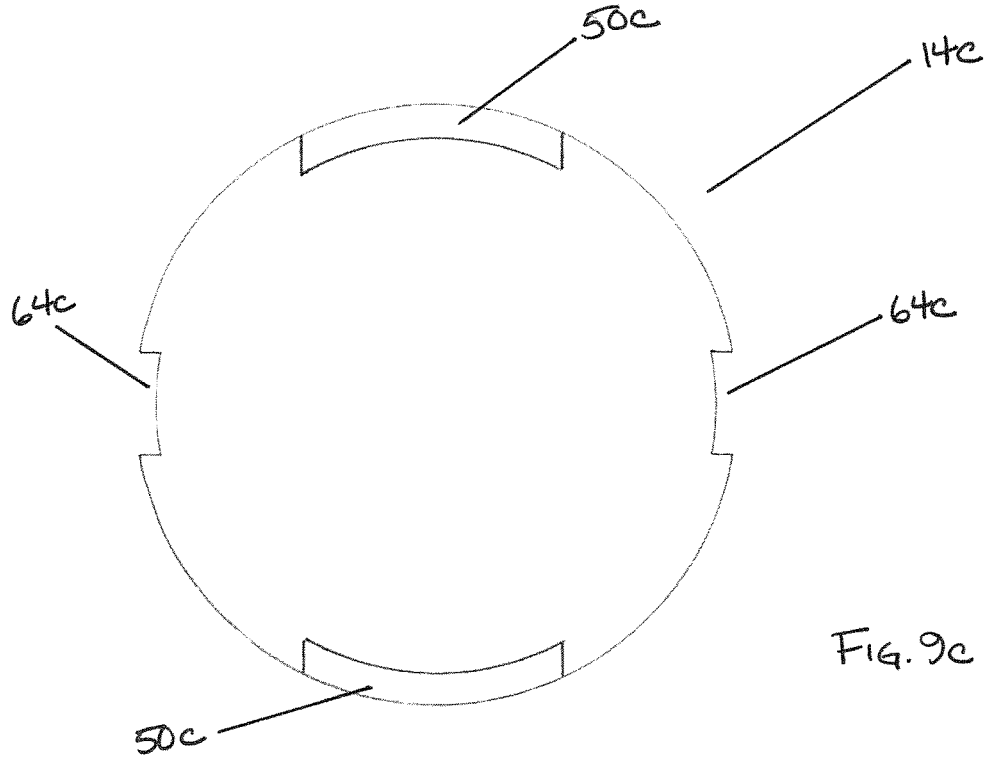
Figure 9D:
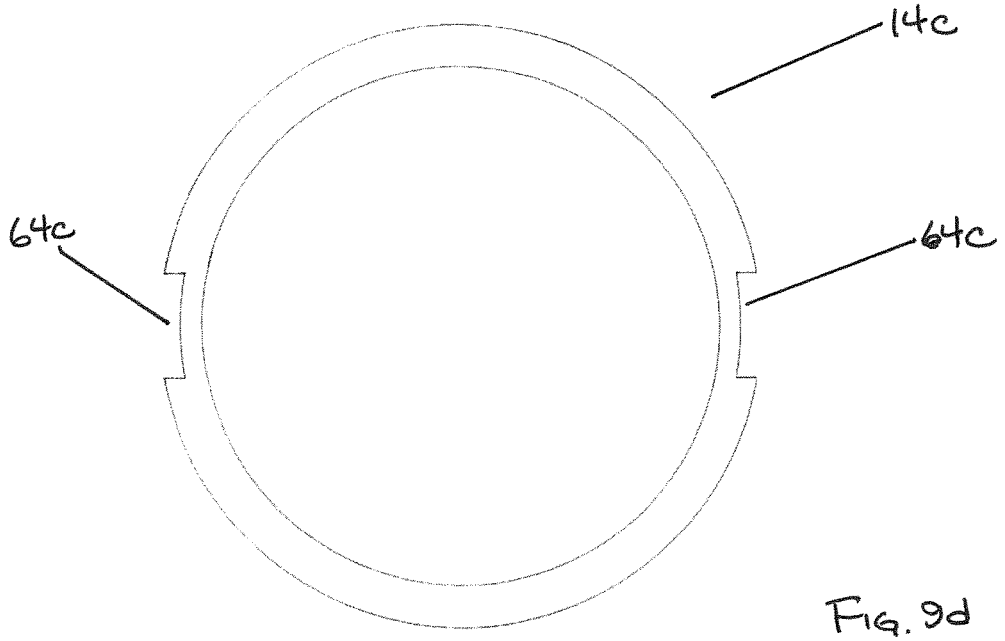
Figure 10A:
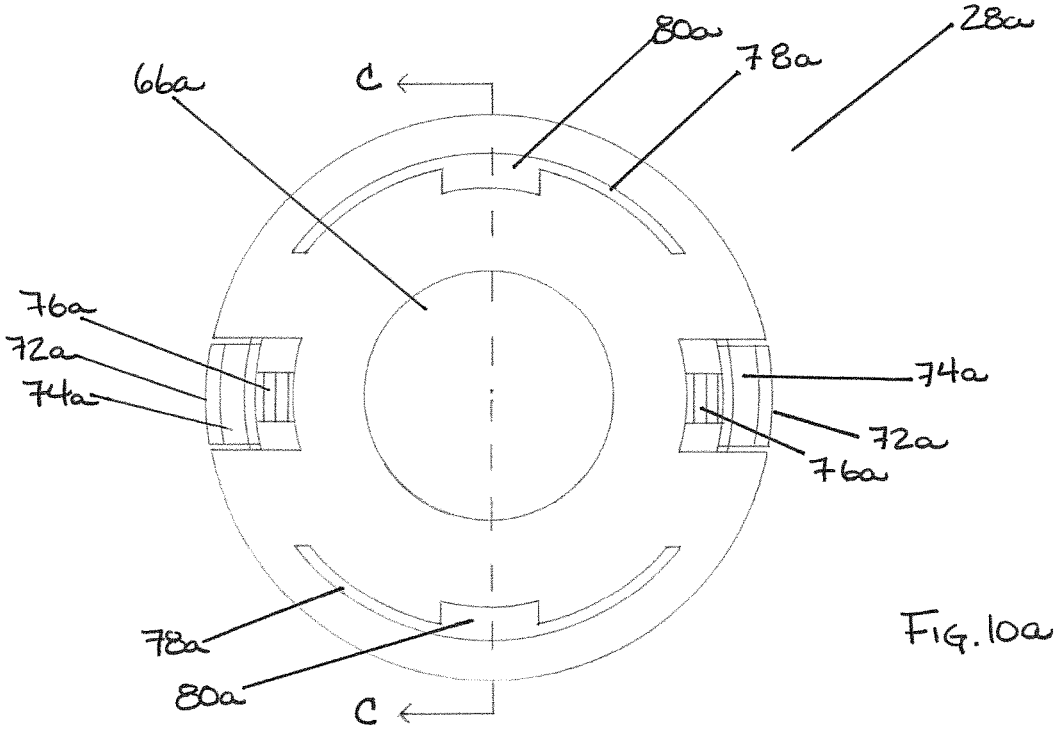
FIGS. 10*a* and 10*b* are views of two sides of a first embodiment of a gripper ring according to the invention.
Figure 10B:
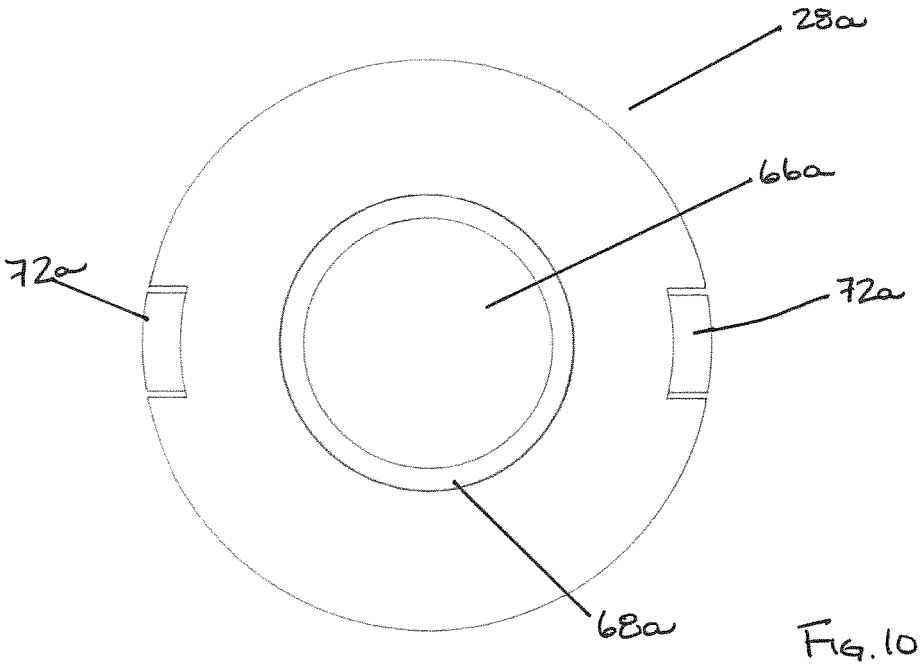
Figure 10D:
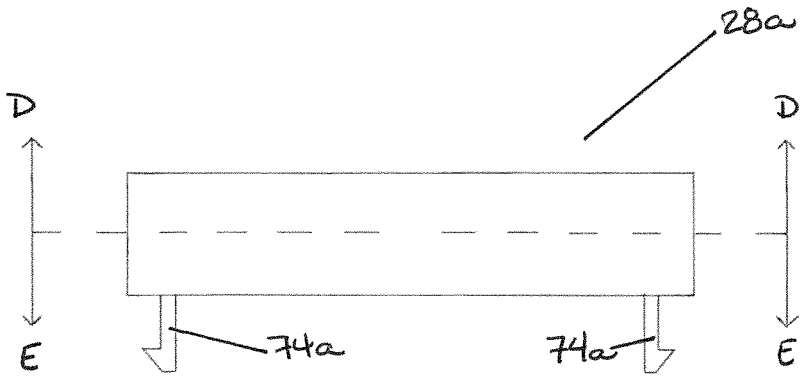
FIGS. 10*d* and 10*e* are two side views of the ring of FIG. 10*a;*
Figure 10E:
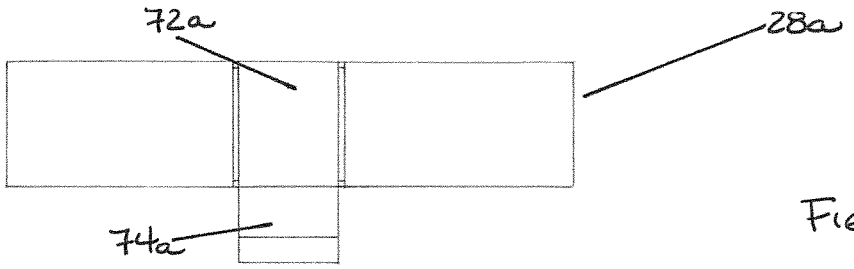
Figure 10C:
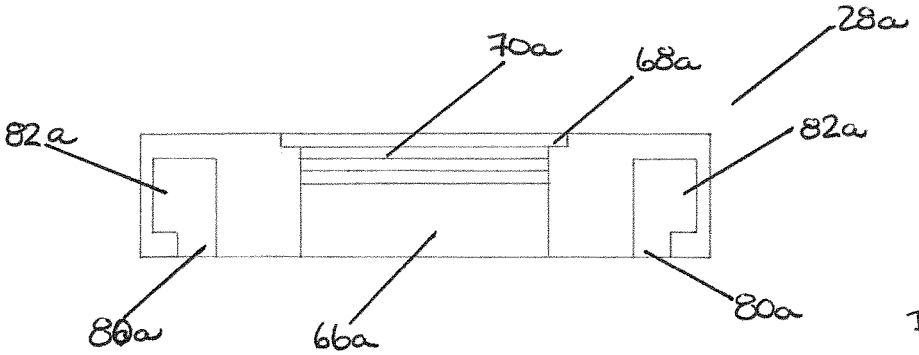
FIG. 10*c* is a sectional view of the ring of FIG. 10*a*, taken along line C-C.
Figure 10F:
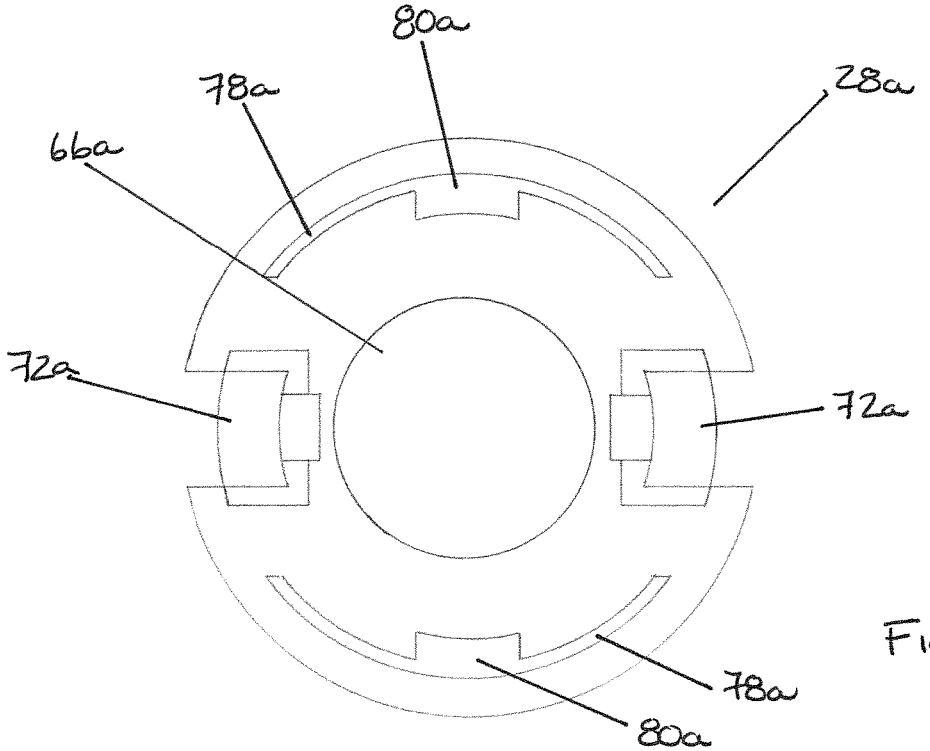
FIGS. 10*f* and 10*g* are sectional views of the ring of FIG. 10*d*, taken along lines D-D and E-E respectively.
Figure 10G:
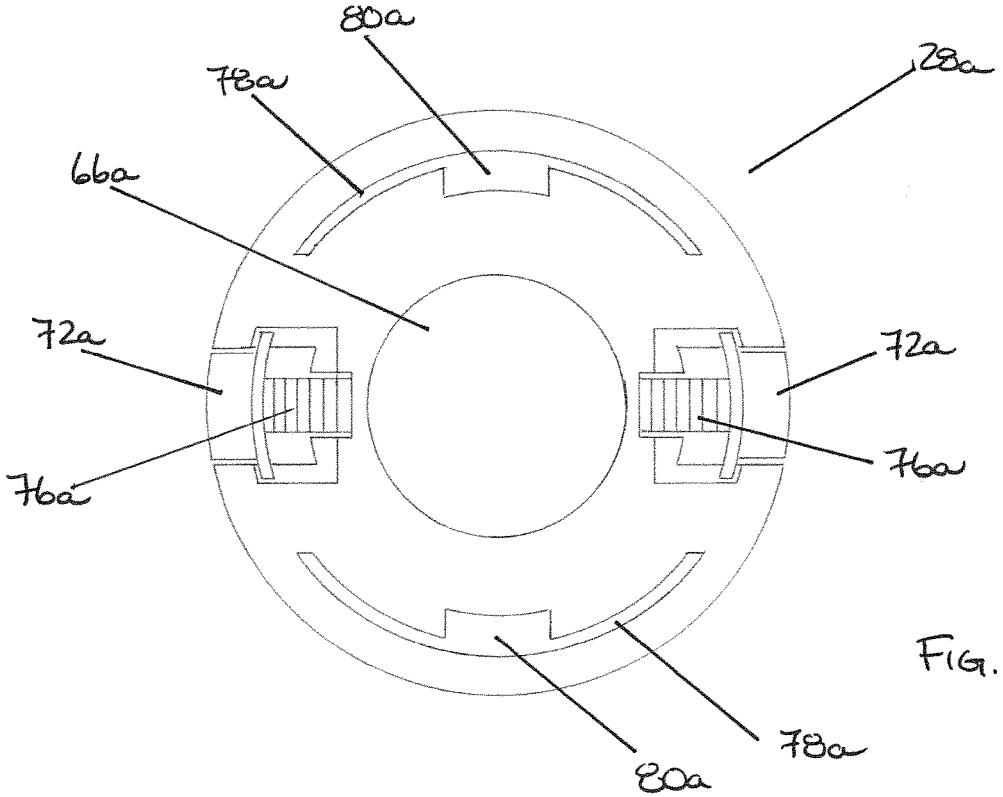

Referring generally to FIGS. 1-2*c*, a first embodiment of the magazine assembly 10*a* of the invention comprises a tube 12*a* and outer shell 14*a* adapted to engage a receiver 16 (not shown). The tube 12*a* is adapted to hold paintballs to be fed to a marker on which receiver 16 is integrated or mounted. Closure means, such as refill cap 84 or other suitable means as will be discussed later, may be provided to close of one or both ends of the assembly 10*a*.

In one embodiment, tube 12*a*, best seen in FIGS. 3*a*-3*d*, comprises a generally cylindrical body 18*a* having an open front end 20*a* and an opposed rear end 22*a*. One or more apertures 24*a*, through which paintballs will flow out of the magazine and into the marker once the magazine is properly inserted and armed, are provided on tube 12*a*, and are bounded by one or more aperture covers 25*a*. Apertures 24*a* are generally shown as being near front end 20*a*, but the exact location of the apertures may be chosen based on the configuration of a receiver with which the magazine will be used. At least one rear aperture 26*a*, which will engage with a locking and arming mechanism (not shown) as will be discussed later, is located towards the rear end 22*a*. Rear aperture 26*a* may be stepped as shown, or may be made in any suitable shape to provide a secure attachment means for the arming mechanism. Tube 12*a* may optionally be provided with one or more internal ramps 37*a*, which assist in funneling paintballs within tube 12*a* towards the front aperture 24*a* and into the receiver.

Tube 12*a* further comprises a guide, such as a pair of opposed flexible guide tabs 30*a*, which allow the tube 12*a* to be inserted and locked into an outer shell, as will be discussed. The guide tabs 30*a* are provided with a release surface or point 32*a*, which acts as a quick release method, allowing the user to separate the inner tube from the outer shell as required merely by pressing the release surface 32*a*. Opposed flex locks 34*a* are also provided on tube 12*a*, towards the rear opening 22*a*, in order to provide a connection with a locking and arming mechanism such as a gripper, as will be discussed. Flex locks 34*a* may similarly be provided with a release surface or point 36*a*, allowing a user to easily separate the tube 12*a* from the locking and arming mechanism as needed.

In the embodiment of the outer shell 14*a* shown in FIGS. 4*a*-4*e*, outer shell 14*a* comprises a generally cylindrical body 38*a*, sized to fit around a tube, having a front end 40*a* and an opposed rear end 42*a*. Aperture 44*a* is provided to generally correspond with an aperture on a tube, to allow paintballs to flow out of the tube when the magazine is properly inserted and armed. An external guide mechanism, shown as a pair of opposed guide rails 46*a*, is provided to ensure that the outer shell 14*a* inserts properly into a receiver. The outer shell 14*a* may also be provided with a lock slot 48*a* and a chamfered area 50*a*, each of which will be discussed in more detail later. In some embodiments, lock slot 48*a* also acts as a means of removing an inner tube from the outer shell.

In the embodiment of the outer shell 14*b* shown in FIGS. 5*a*-5*d*, outer shell 14*b* is similar to that shown in FIG. 4 except that two apertures 44*b* are provided. This may provide more flexibility when inserting the magazine into a receiver, as it is not necessary for a user to determine which side of the shell must be aligned with the receiver in order to allow the paintballs to flow into the receiver—either aperture may be inserted in the downward position to gravity-feed the paintballs toward the marker. Further, some receivers are provided with an open top, rather than a top that substantially encloses the front portion of a magazine. This configuration may be more suitable to a magazine having only a single aperture, such that opening the downward aperture to allow paintballs to flow down into the marker, does not also open an upper aperture, allowing paintballs to escape from the top of the magazine, or for foreign material to enter the magazine.

Each embodiment of the outer shell 14 may be provided with different operating mechanisms, as shown in FIGS. 6*a*-8*b*. In the embodiment of outer shell 14*b* shown in FIGS. 6*a* and 6*b*, the shell 14*b* is provided with a twist channel 52*b*, which will cooperate with an inserted tube to allow the magazine to be armed by twisting the tube, as will be discussed later. In the embodiment shown in FIGS. 7*a* and 7*b*, the outer shell 14*b*' is provided with a pair of opposed pull channels 54*b*' and one or more friction retainers 56*b*', which will cooperate with an inserted inner tube so the magazine may be armed by pulling on the inner tube, as will be discussed later. In yet another embodiment, shown in FIGS. 8*a* and 8*b*, the outer shell 14*b*" is provided with twist channel 52*b*", opposed pull channels 54*b*" and one or more friction retainers 56*b*", such that the arming motion is either a twist or a pull, as may be preferred by the user. In each case, the outer tube 14*b* is provided with a threaded area 58*b* at its front end 40*b*, which is slightly smaller than the inner circumference of the rest of the outer shell 14*b*, thereby providing a ridge 60*b* to support an inner tube when it is inserted. Each of the outer shell embodiments is also provided with one or more sets of locking slots 62*b*, 62*b*', 62*b*" to retain a locking and arming mechanism such as a gripper, as will be discussed.

The guide mechanism provided to ensure accurate insertion of the outer shell 14*c* into a receiver 16 (not shown) may alternatively be a pair of opposed guide slots 64*c*, as shown in FIGS. 9*a*-9*d*.

One embodiment of gripper 28*a*, best shown in FIGS. 10*a*-10*g*, comprises a generally annular shape with a central opening 66*a*, which may have a slight step 68*a* within the opening 66*a*, and which may be threaded 70*a*. The ring further comprises a pair of opposed resilient tabs 72*a* on its outer circumference, each of which may actuate an extending hook 74*a*. Tabs 72*a* may be biased towards the ring's outer edge, such as by springs 76*a* or another suitable biasing means. A pair of opposed elongated slots 78*a* are also provided near the outer edge of the inner surface of the gripper 28*a* in order to accommodate the rear opening of an inner tube, and a compression space 80*a* having an extension 82*a* may be provided along one or both elongated slots 78*a* to accommodate the flex locks on the inner tube, so that the two pieces may be securely joined.

Figure 11A:
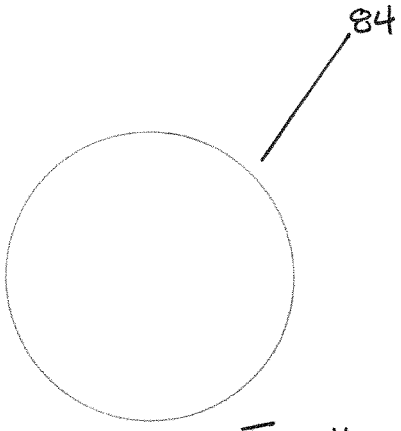
FIGS. 11*a*-11*c* are side, inside and outside views of a refill cap for the magazine according to the invention.
Figure 11B:
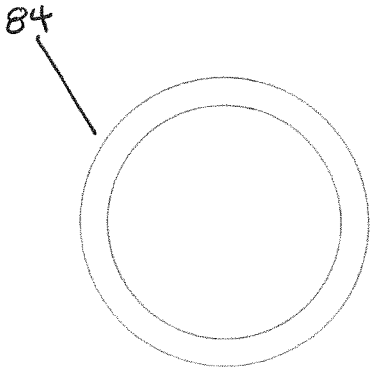
Figure 11C:
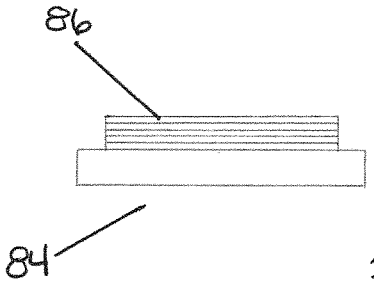

The magazine 10 preferably further comprises one or more closure means to close off at least one end of the magazine, making it possible to refill and reuse empty magazines without disassembling the magazine 10. One exemplary closure means is refill cap 84, best shown in FIGS. 11*a*-11*c*. Refill cap 84 comprises a disk shape with an extending threaded portion 86, sized to mate with a threaded end of an outer shell.

Figure 12A:
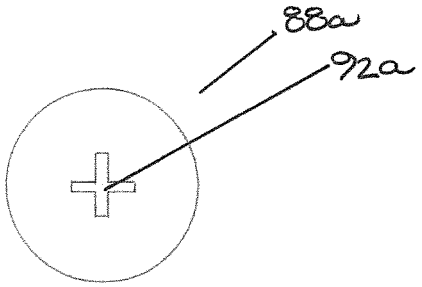
FIGS. 12*a*-12*c* are side, inside and outside views of a refill plug for the magazine according to the invention.
Figure 12B:
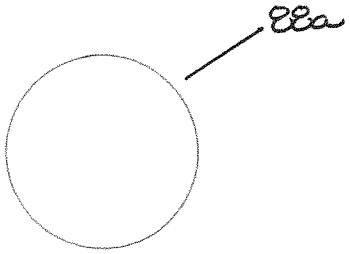
Figure 12C:
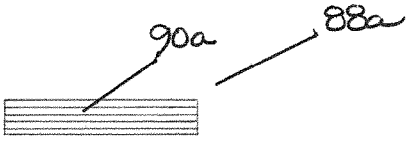
Figure 13A:
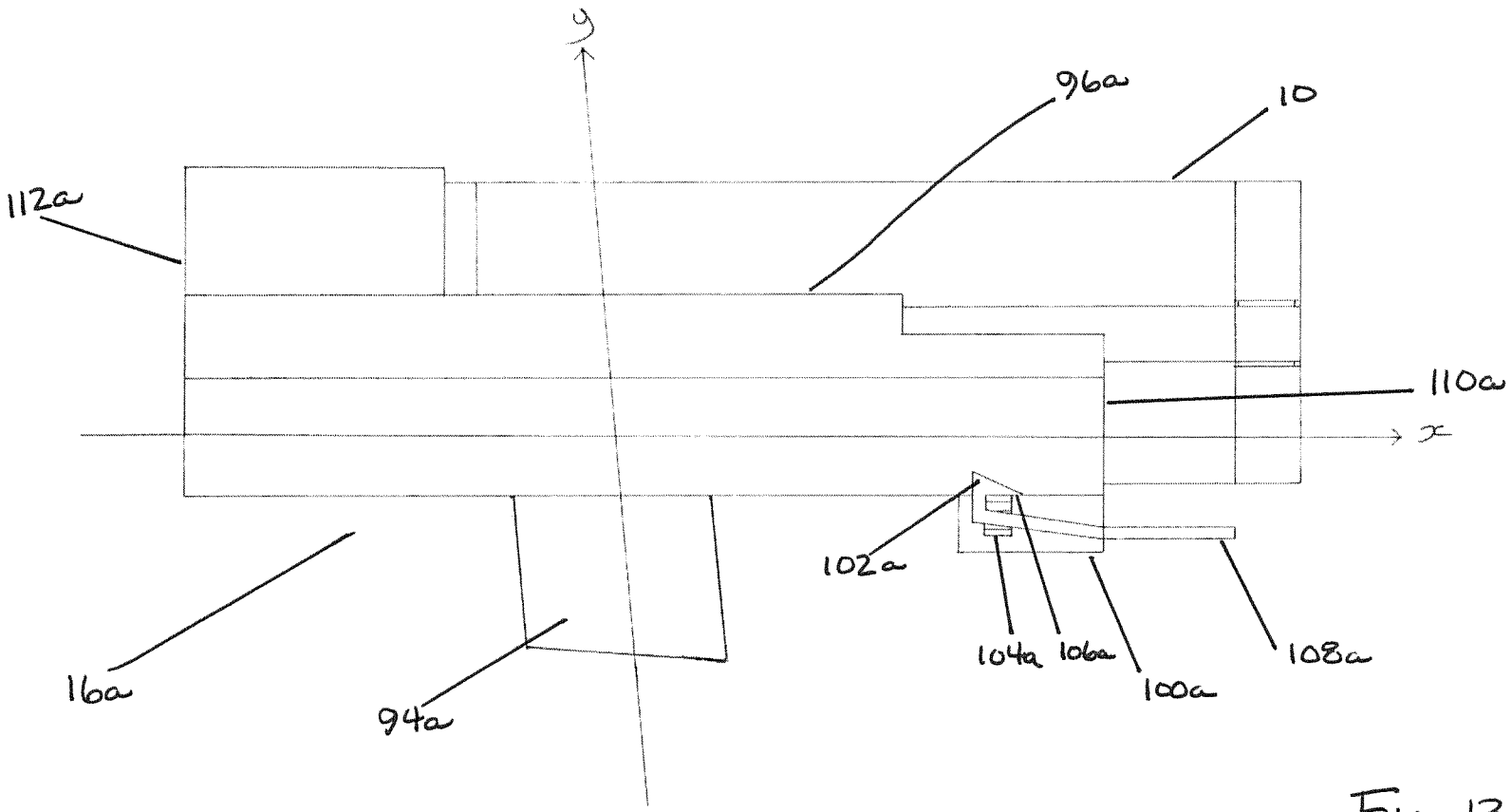
FIGS. 13*a* and 13*b* are side and front views, respectively, of a first embodiment of a receiver according to the invention.
Figure 37A:
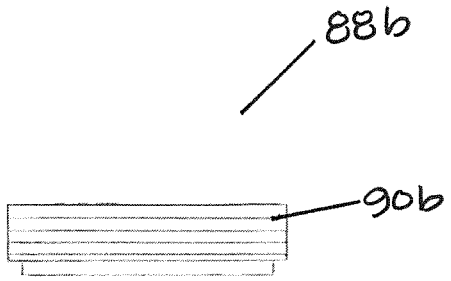
FIGS. 37*a*-37*c* are side, outside and inside views, respectively, of a second embodiment of a refill plug for a magazine according to the invention.
Figure 37B:
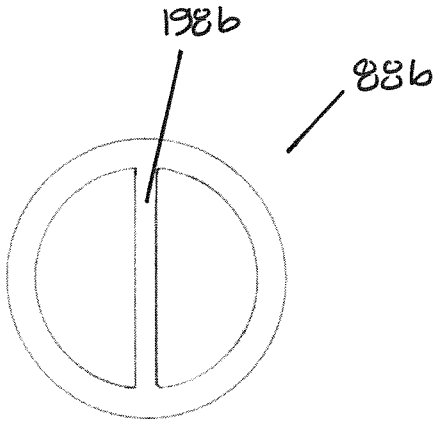
Figure 37C:
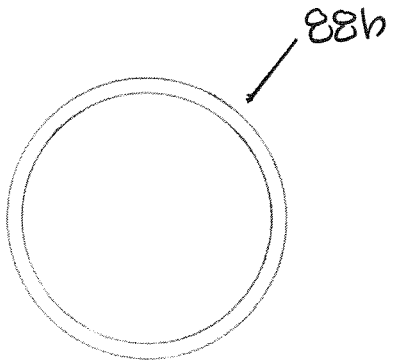
Figure 38:
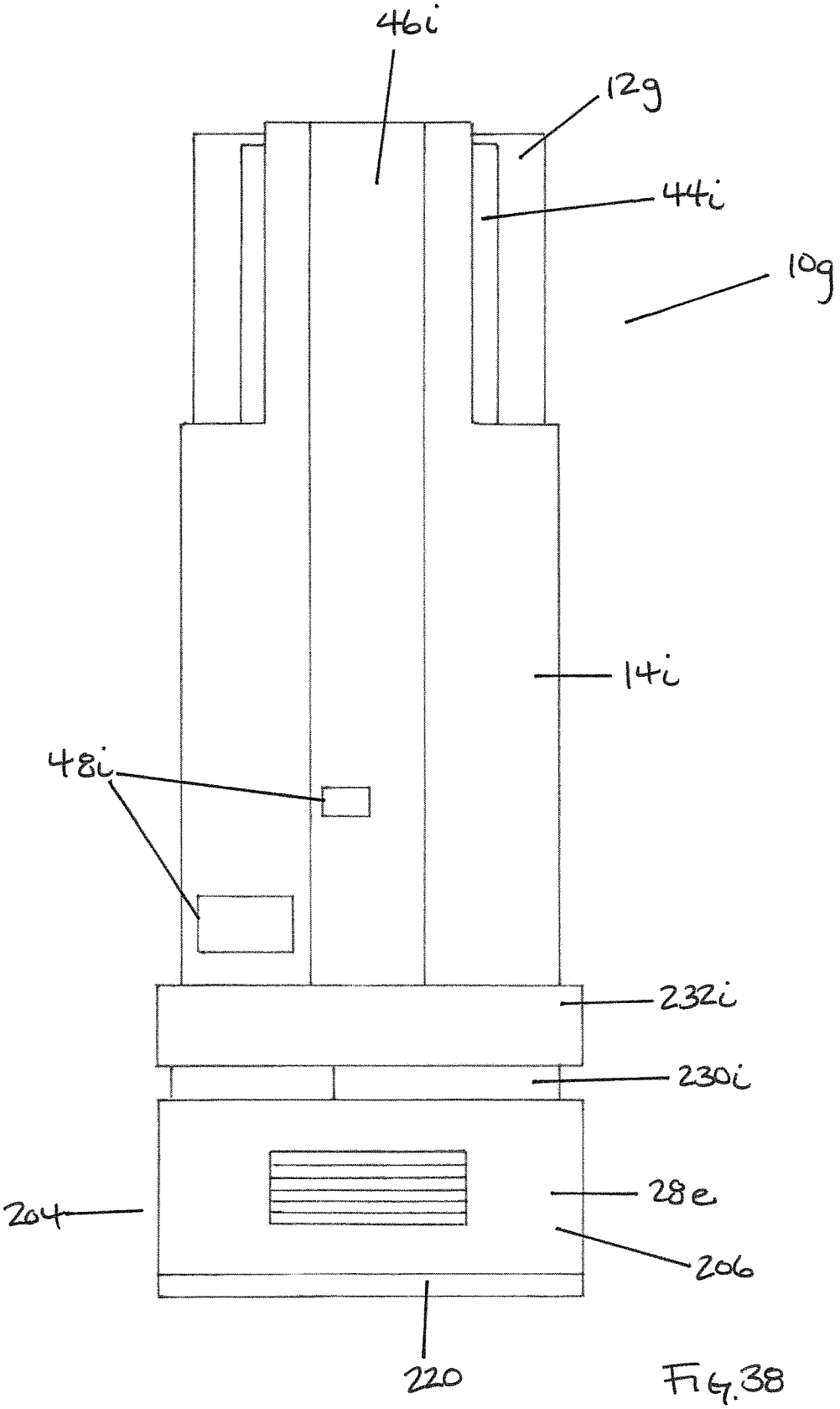
FIG. 38 is a side view of an assembled magazine, according to a seventh embodiment of the invention.
Figure 39A:
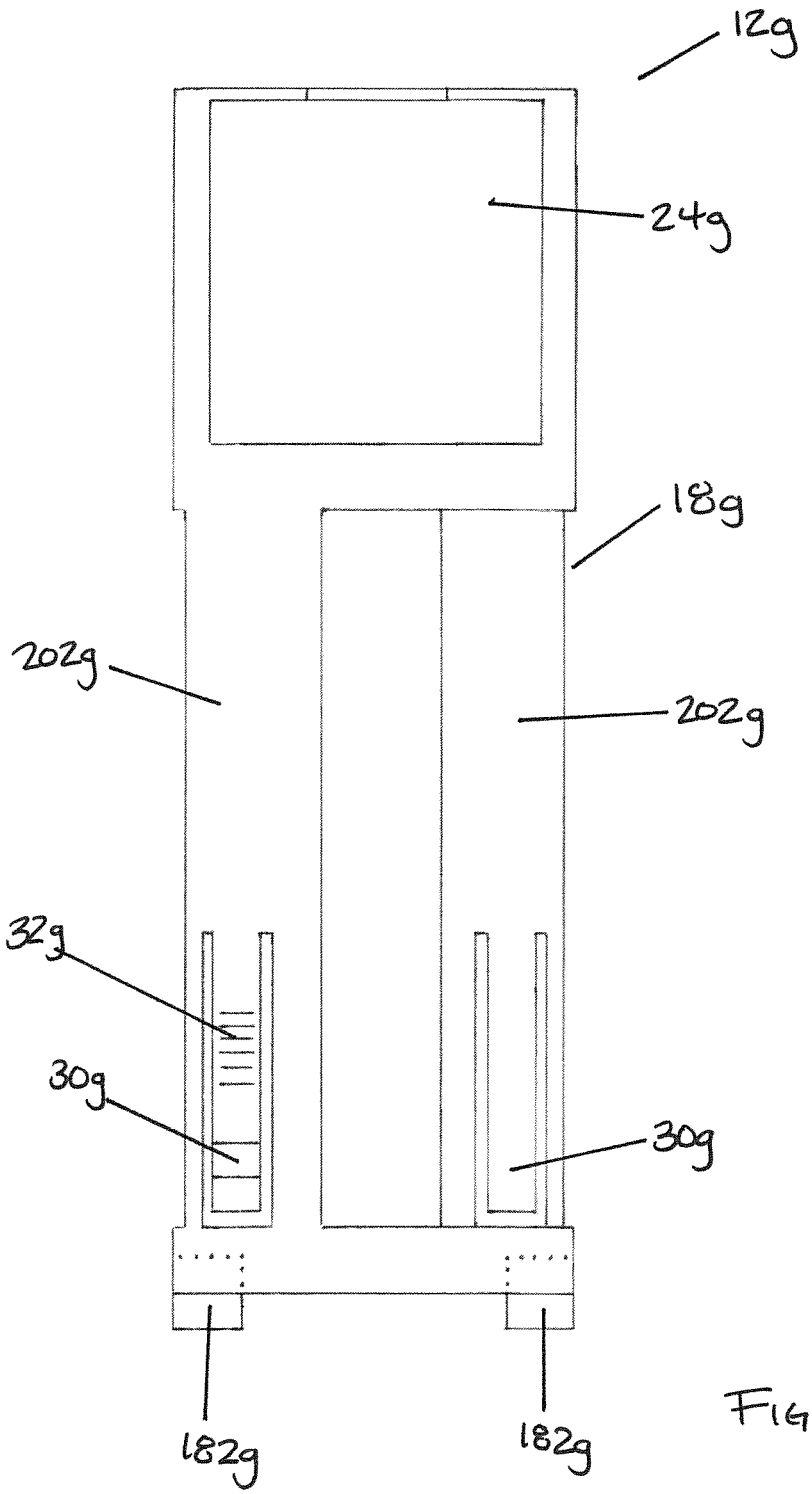
FIGS. 39*a*-39*d* are side, top, front and rear views, respectively, of a seventh embodiment of an inner tube of the invention.
Figure 39B:
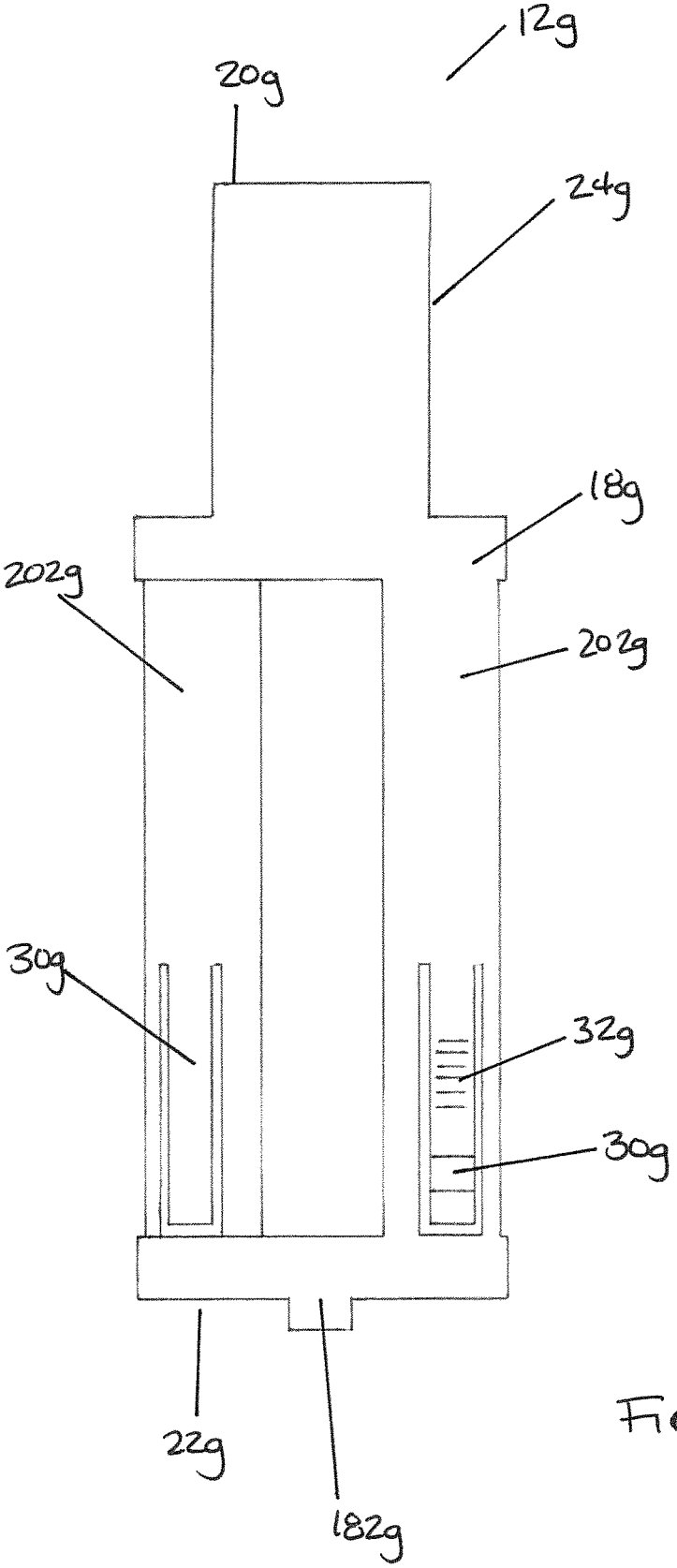
Figure 39C:
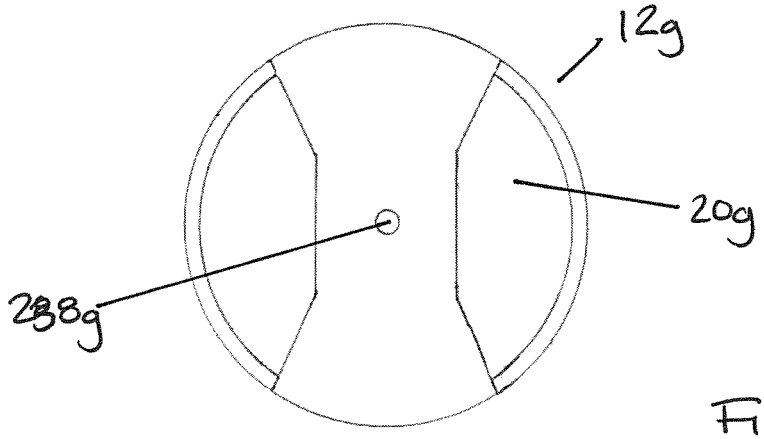
Figure 39D:
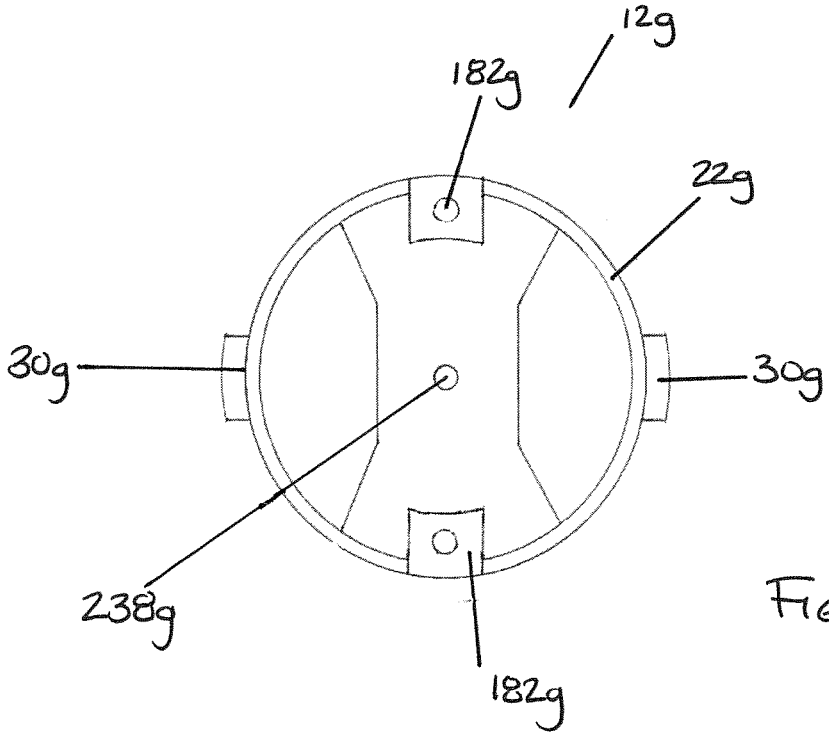
Figure 40A:
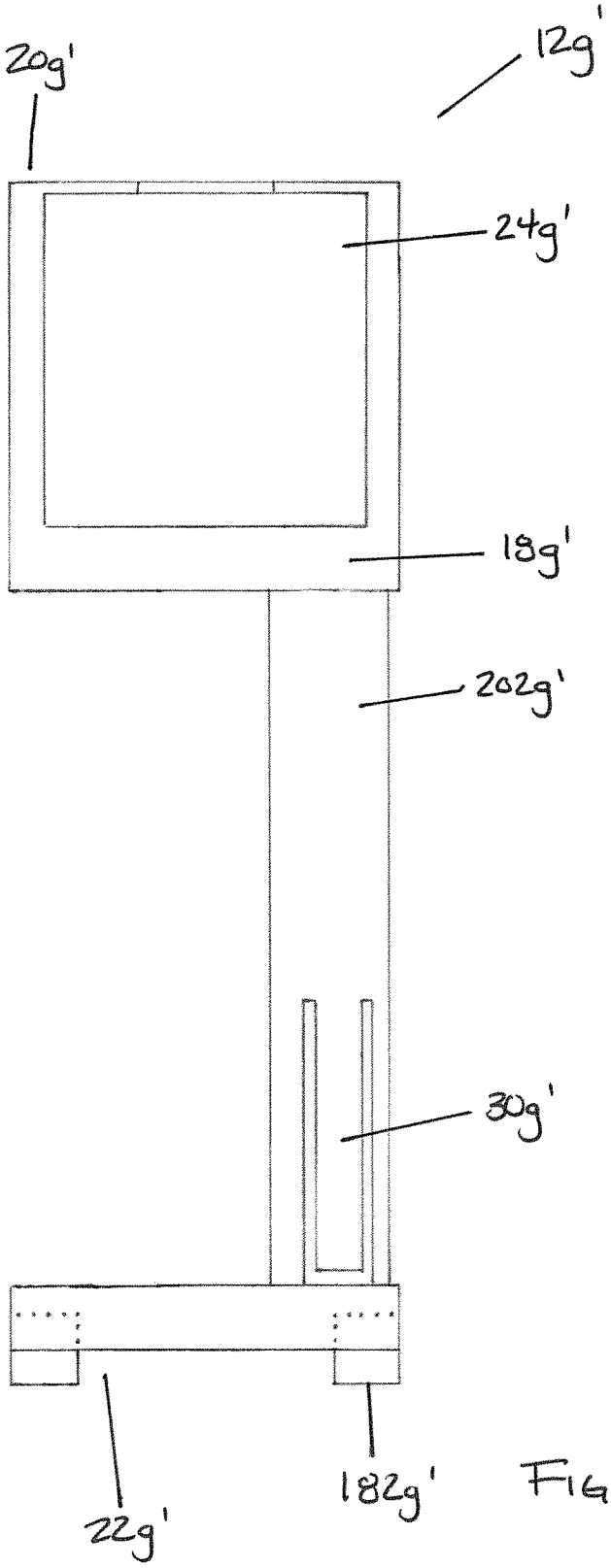
FIGS. 40*a* and 40*b* are side and top views, respectively, of an eighth embodiment of an inner tube of the invention.
Figure 40B:
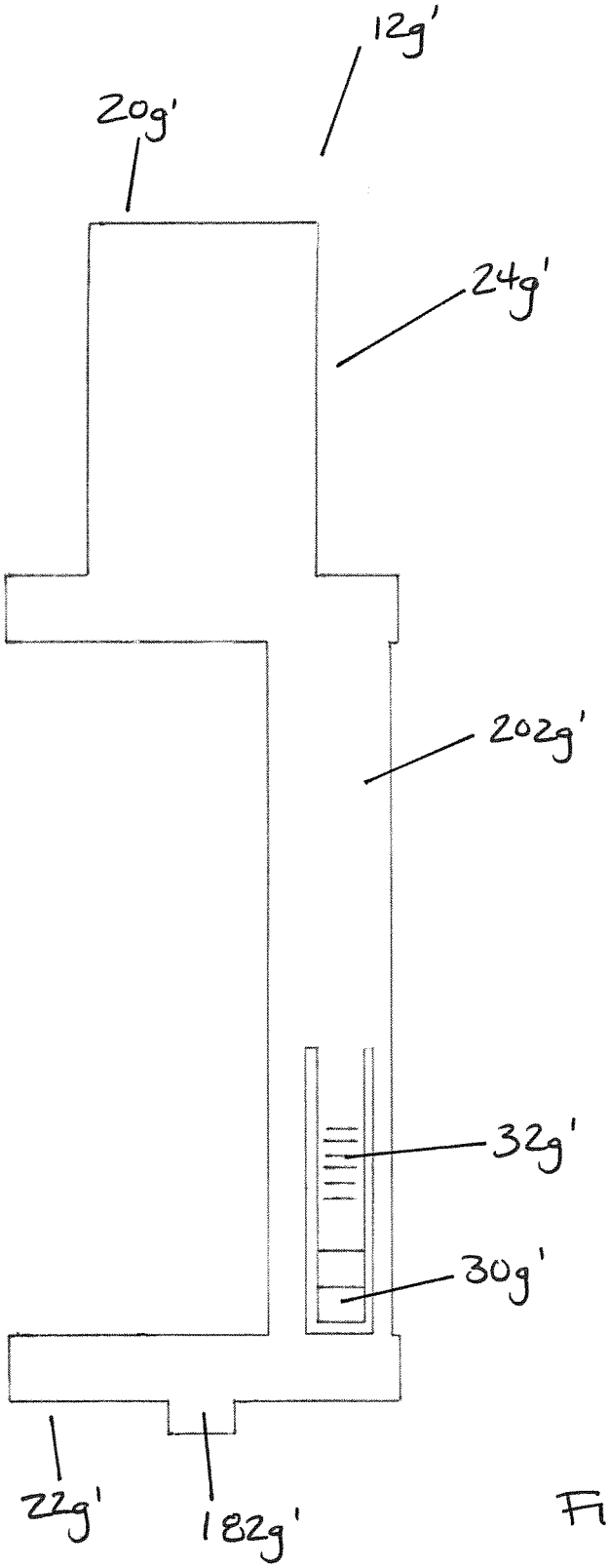
Figure 41A:
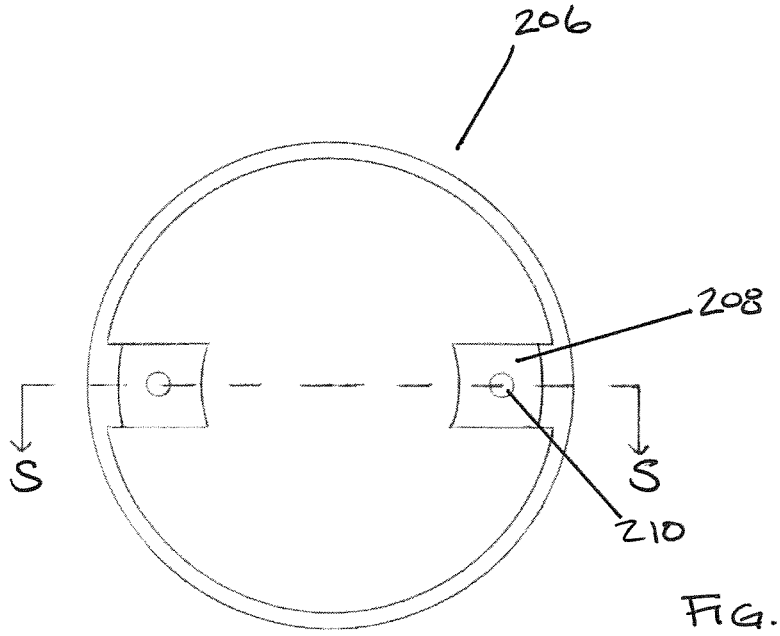
FIGS. 41*a* and 41*b* are front and rear views, respectively, of a slip ring, which is part of a fifth embodiment of a gripper of the invention.
Figure 41B:
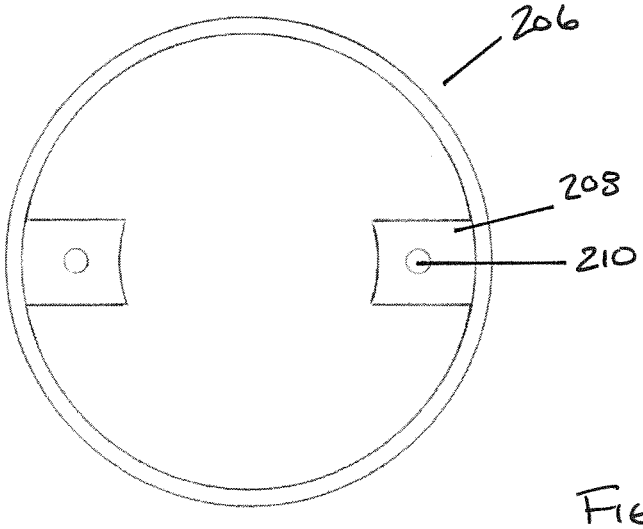
Figure 41C:
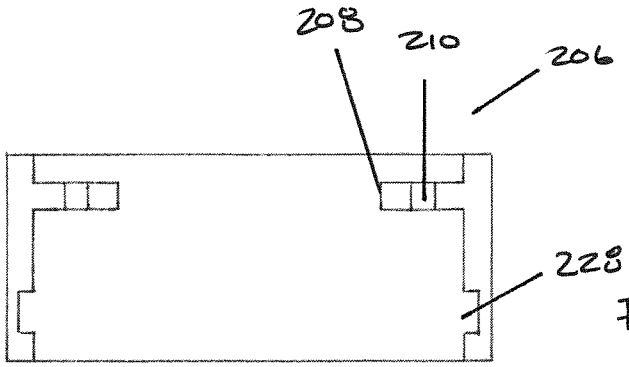
FIG. 41*c* is a sectional view of the slip ring, taken along line S-S of FIG. 41*a;*
Figure 42C:
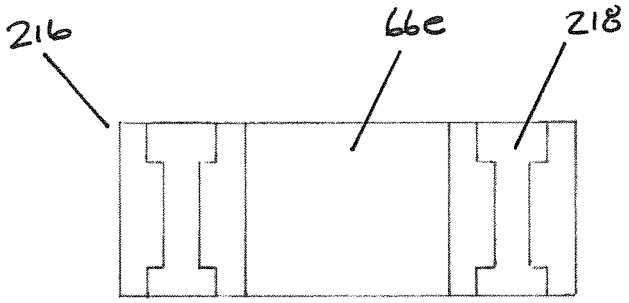
FIG. 42*c* is a sectional view of the core, taken along line T-T of FIG. 42*a;*
Figure 42D:
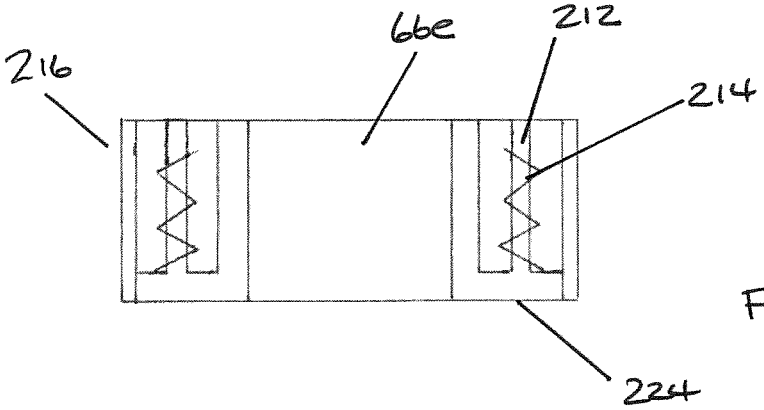
FIG. 42*d* is a sectional view of the core, taken along line U-U of FIG. 42*b;*
Figure 42A:
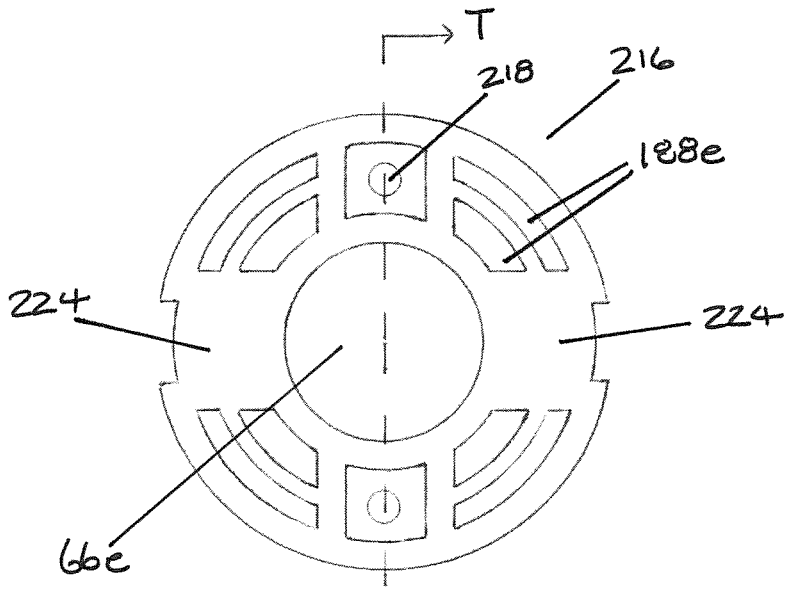
FIGS. 42*a* and 42*b* are front and rear views, respectively, of a core, which is also part of a fifth embodiment of a gripper of the invention.
Figure 42B:
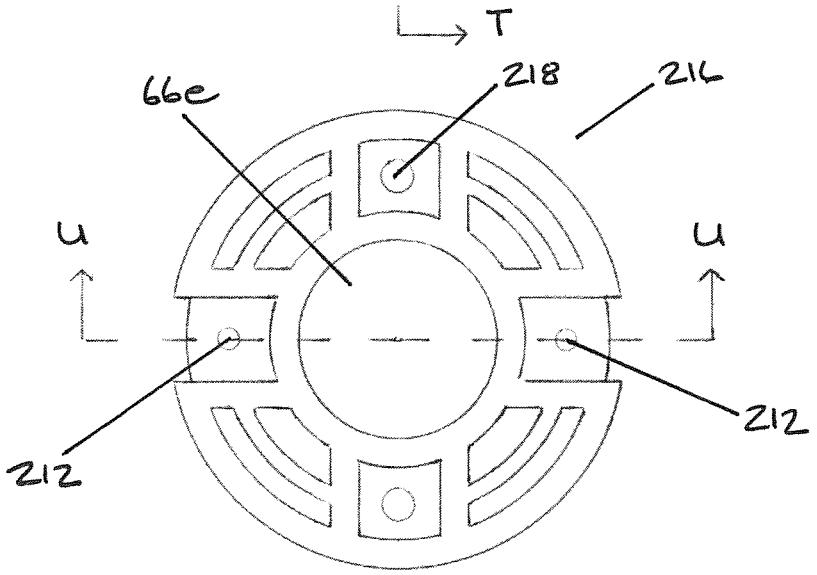
Figure 43A:
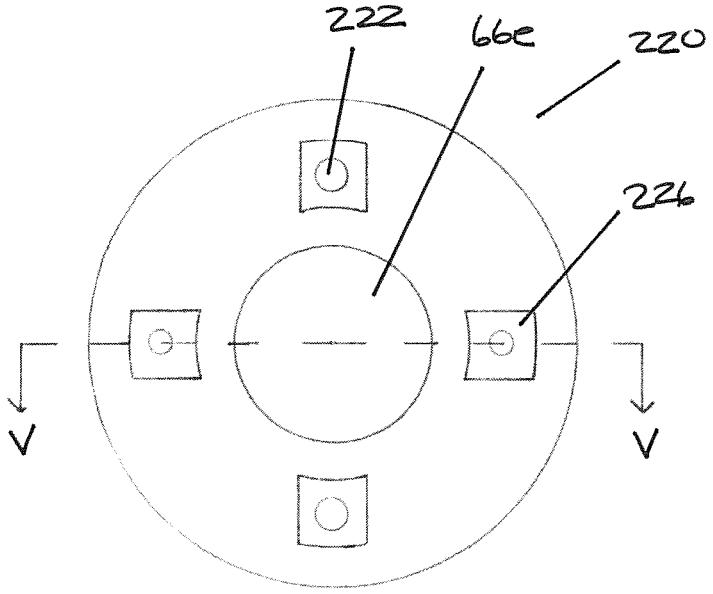
FIGS. 43*a* and 43*b* are front and rear views, respectively, of a back plate, which is also part of a fifth embodiment of a gripper of the invention.
Figure 43B:
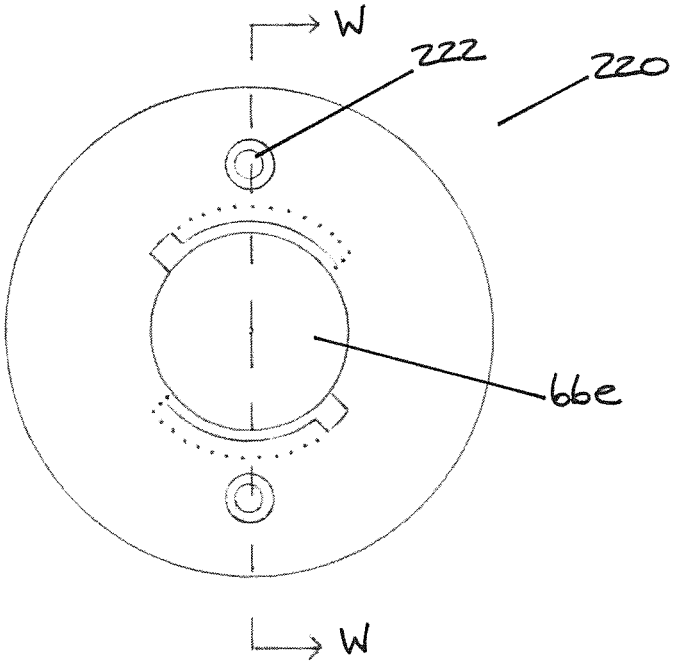
Figure 43C:
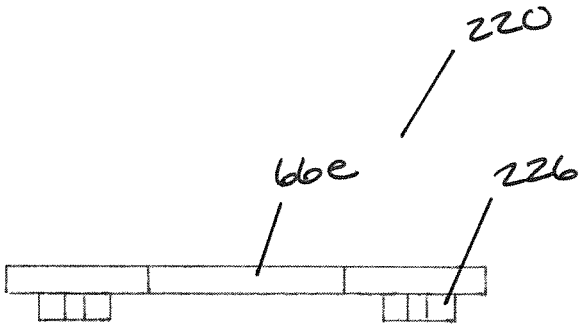
FIG. 43*c* is a sectional view of the back plate, taken along line V-V of FIG. 43*a;*
Figure 43D:
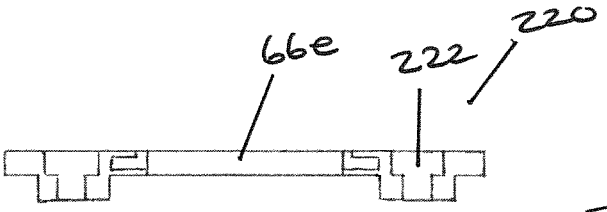
FIG. 43*d* is a sectional view of the back plate, taken along line W-W of FIG. 43*b;*
Figure 49A:
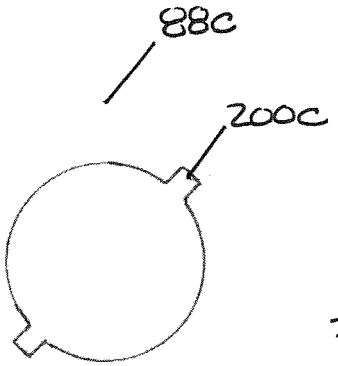
FIGS. 49*a*-49*c* are inside, side and outside views, respectively, of a third embodiment of a refill plug for a magazine according to the invention.
Figure 49B:
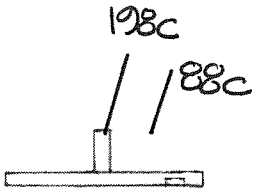
Figure 49C:
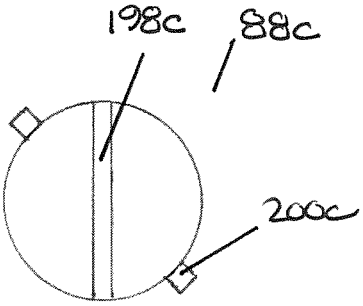
Figure 50:
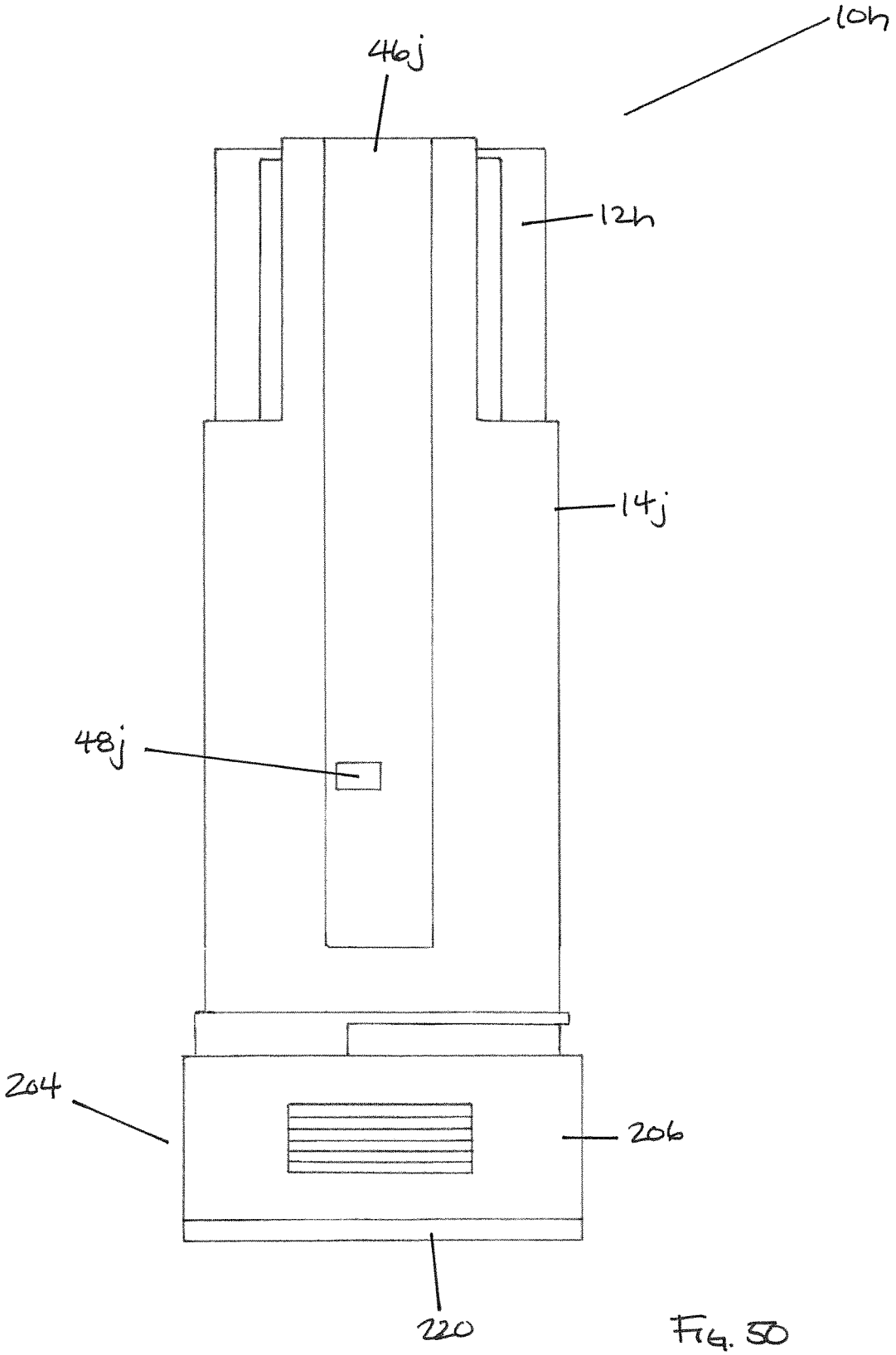
FIG. 50 is a side view of an assembled magazine, according to an eighth embodiment of the invention.
Figure 51A:
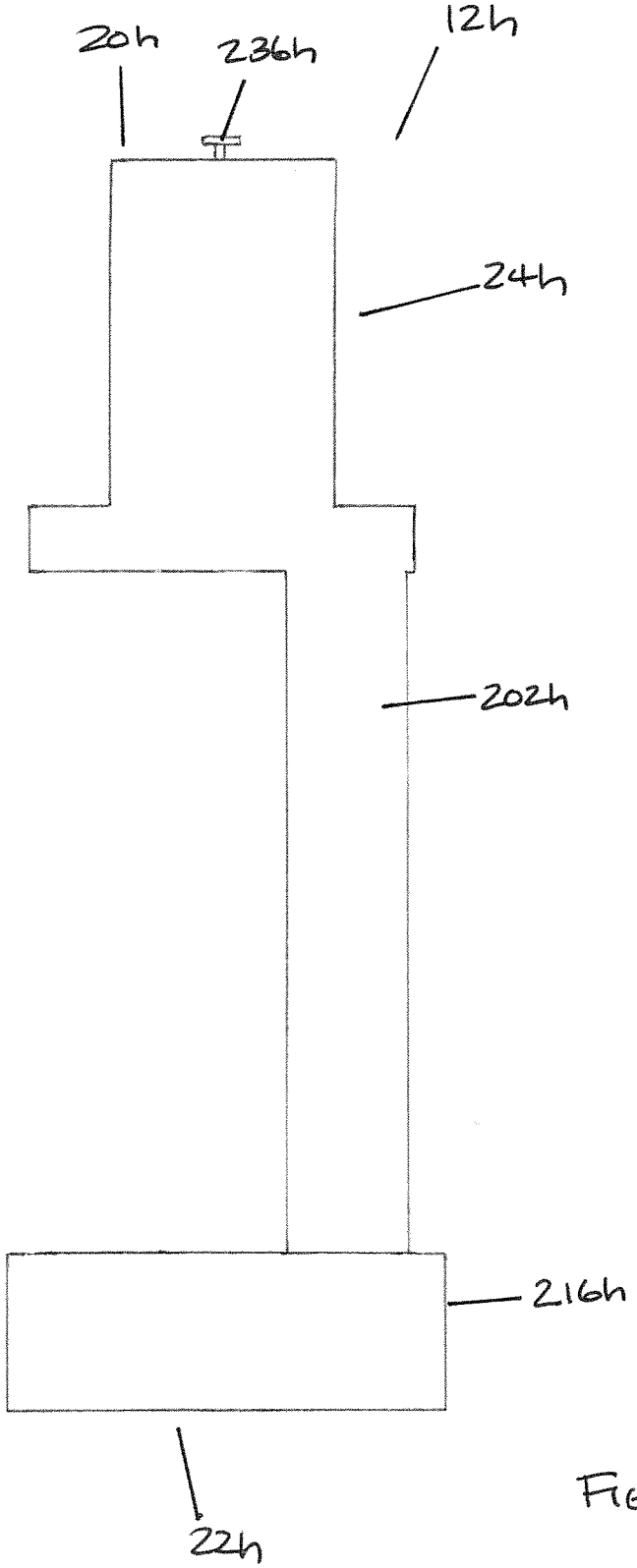
FIGS. 51*a*-51*b* are side and top views, respectively, of a ninth embodiment of an inner tube of the invention.
Figure 51B:
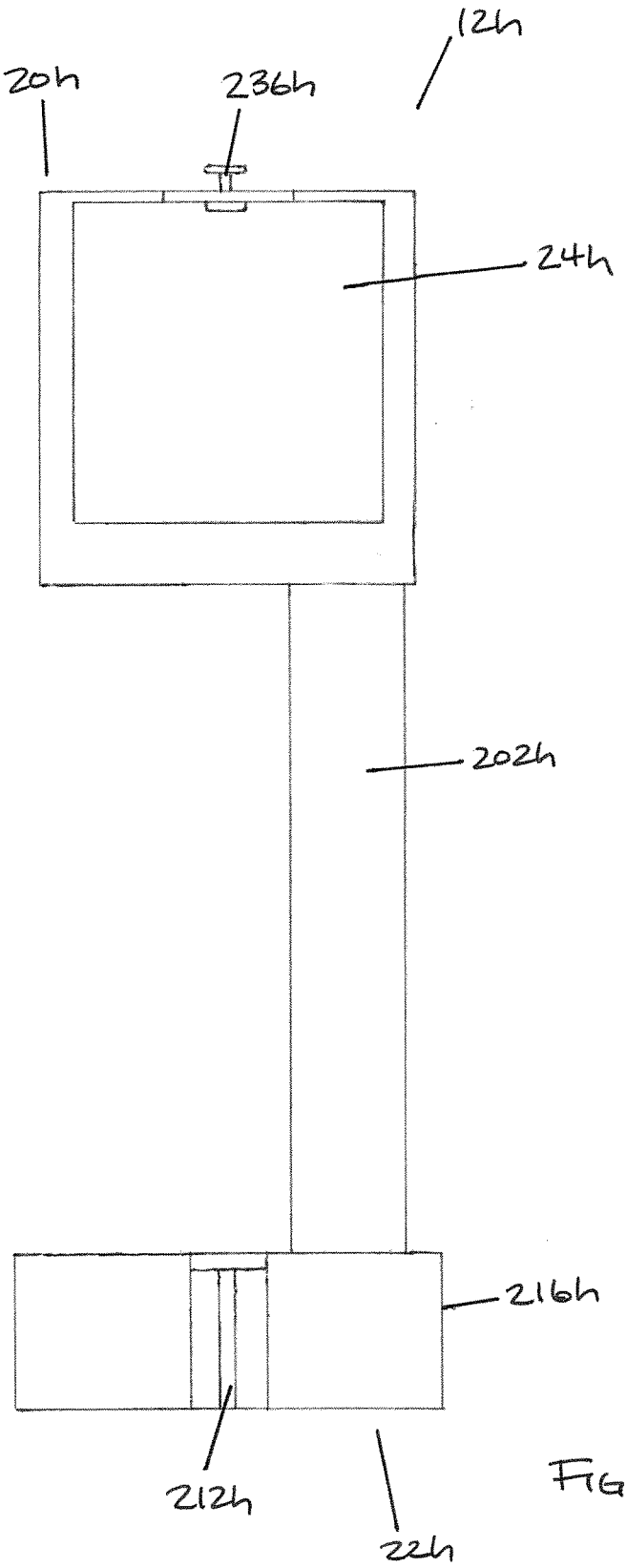
Figure 52A:
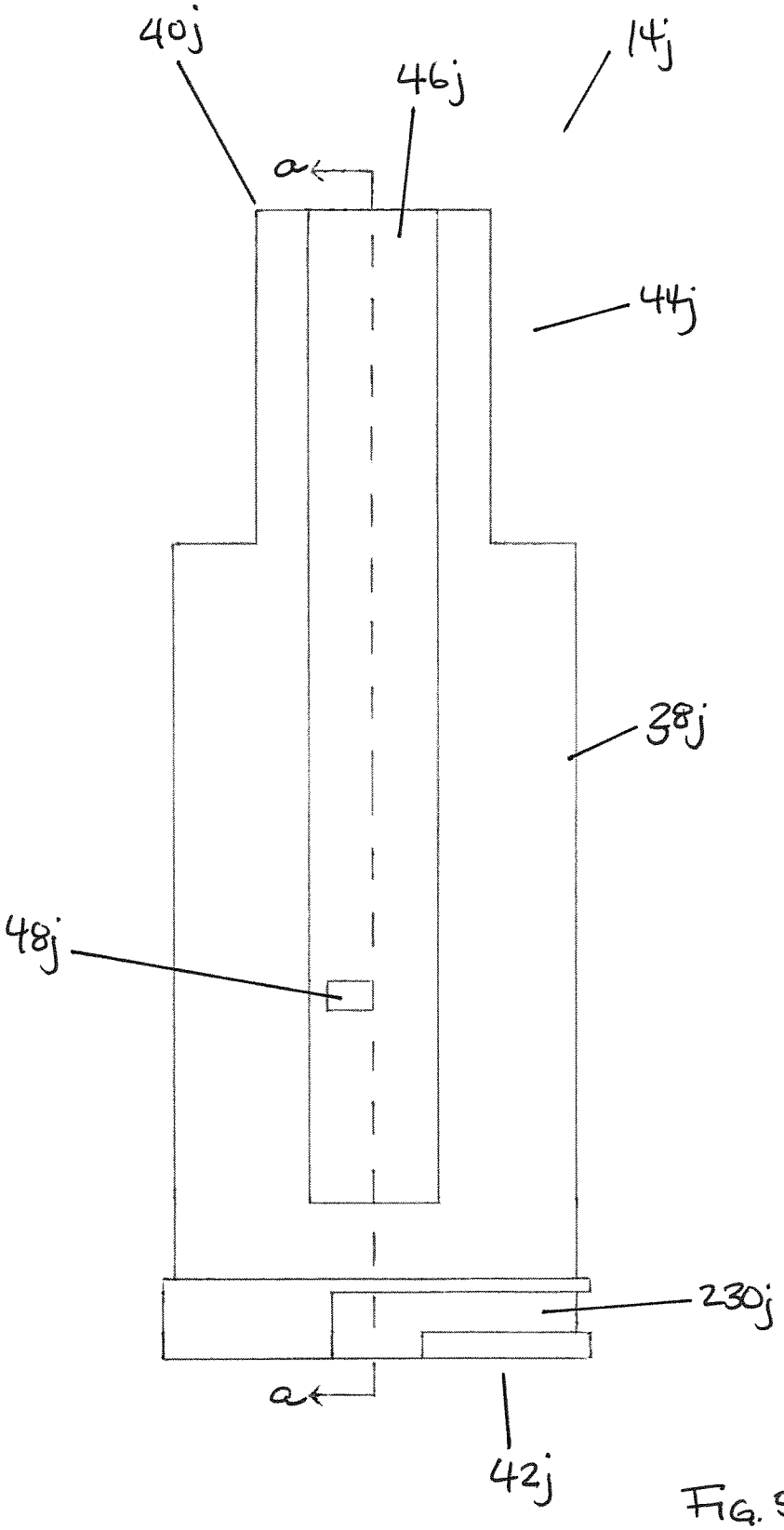
FIGS. 52*a*-52*d* are top, side, front and rear views, respectively, of a tenth embodiment of an outer shell of the invention.
Figure 52B:
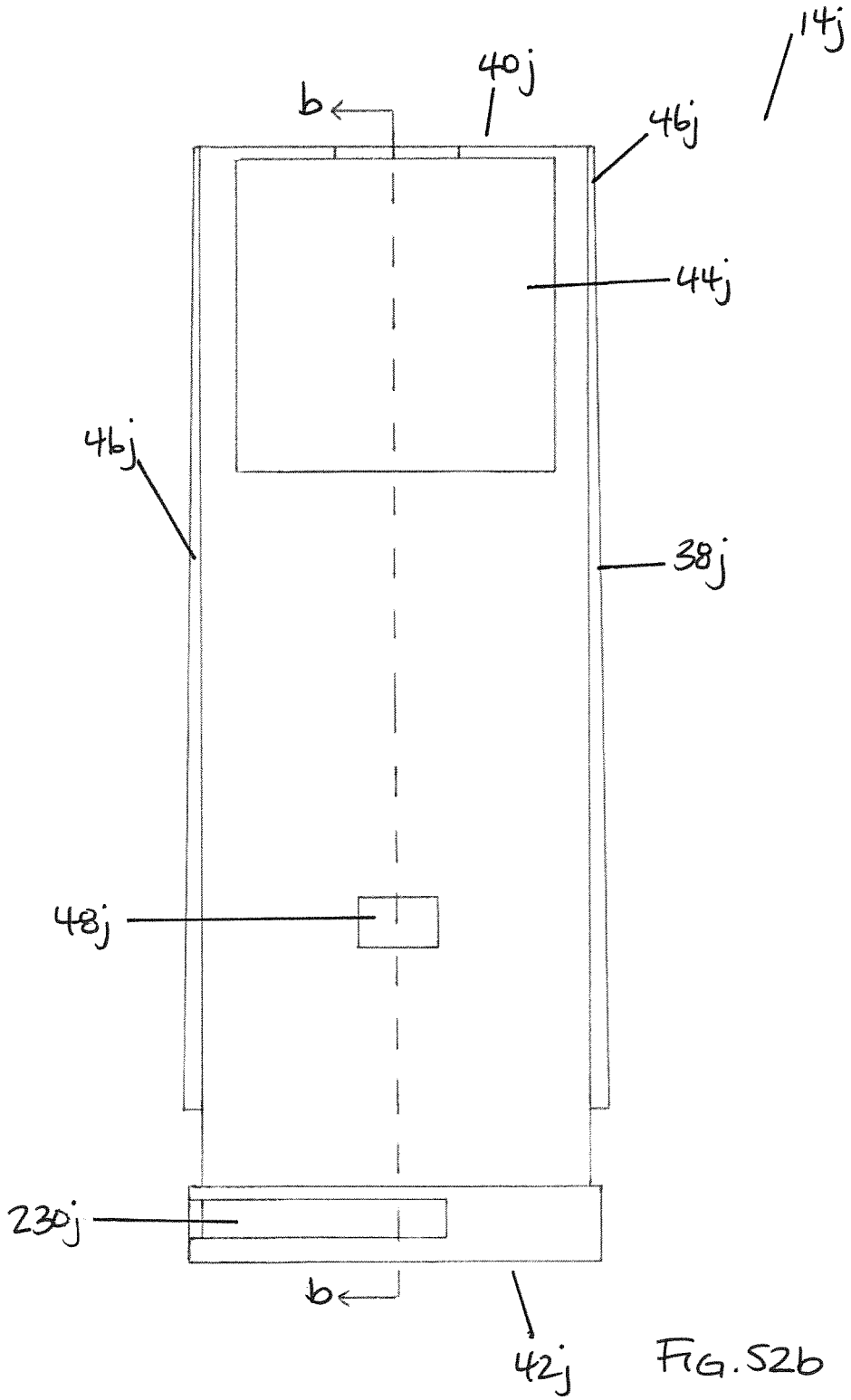
Figure 52C:
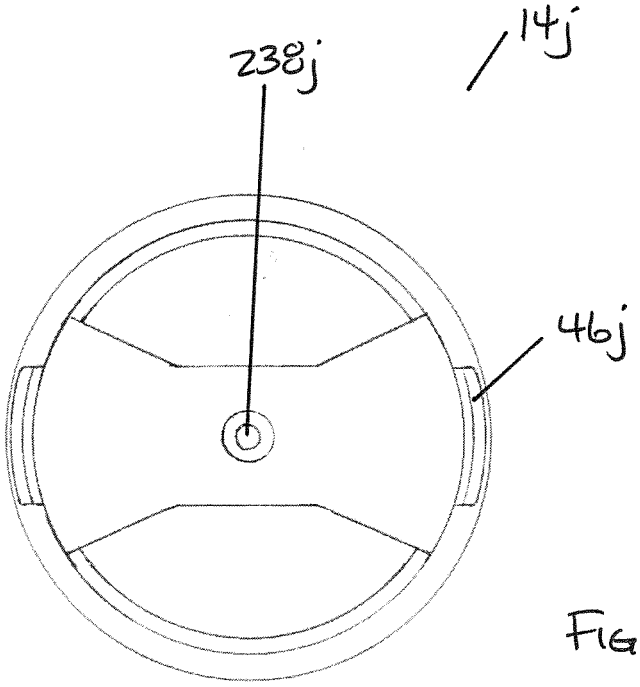
Figure 52D:
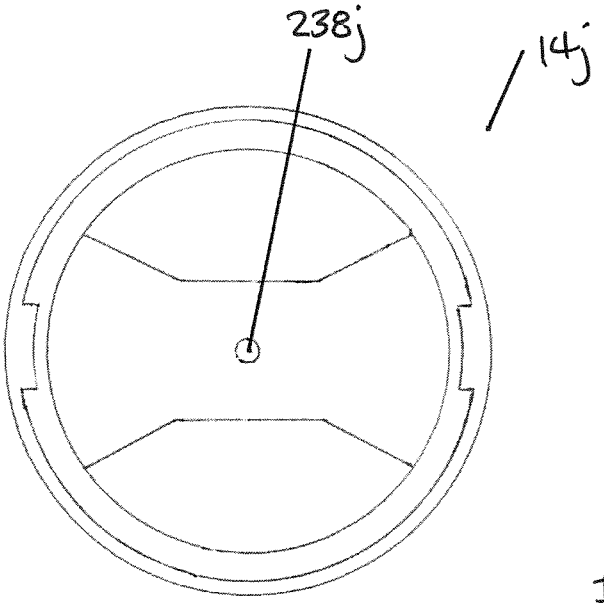
Figure 53:
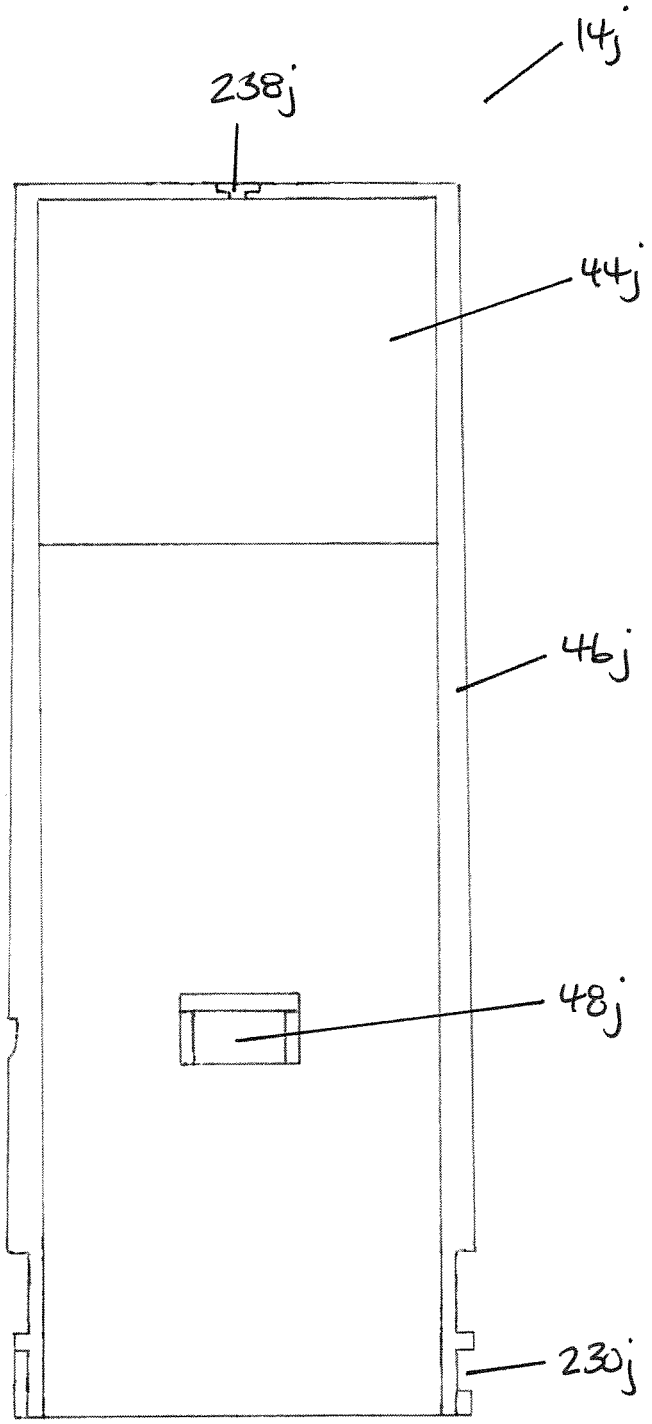
FIG. 53 is a cross-sectional view of the shell of FIG. 52*a*, taken along line a-a.
Figure 54:
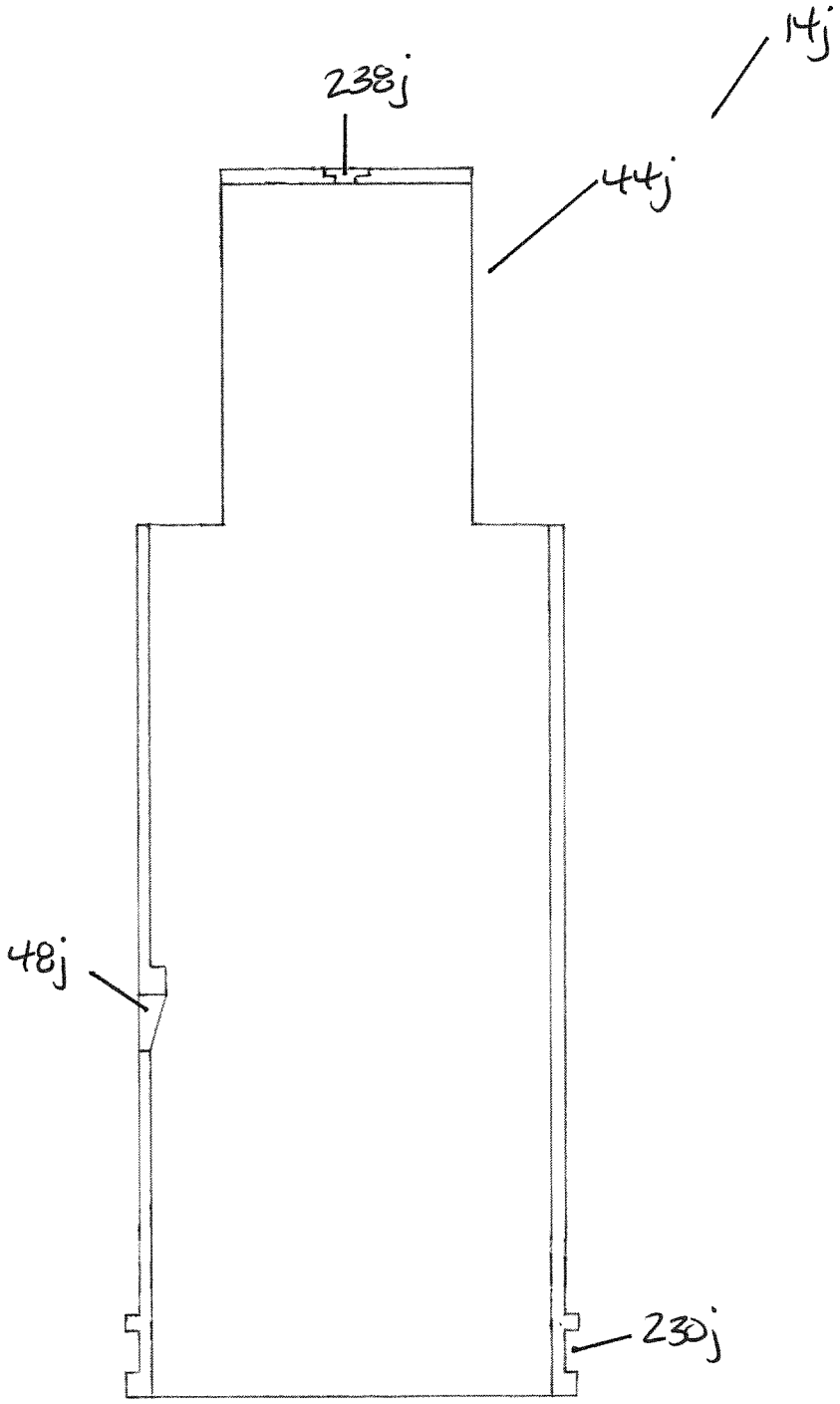
FIG. 54 is a cross-sectional view of the shell of FIG. 52*b*, taken along line b-b.
Figure 55:
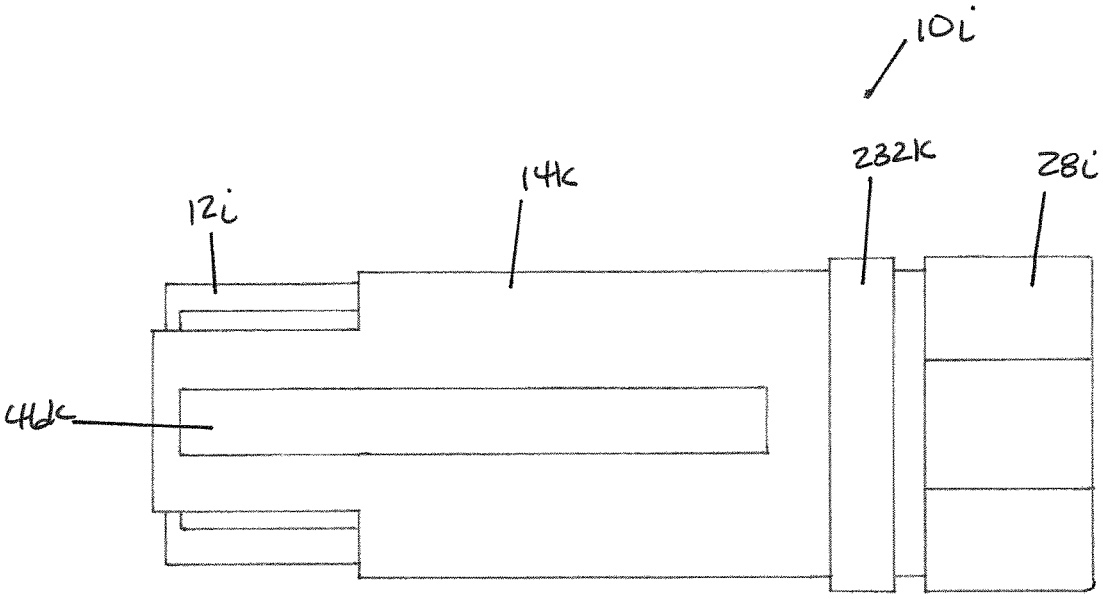
FIG. 55 is a side view of an assembled magazine, according to a ninth embodiment of the invention.
Figure 56A:
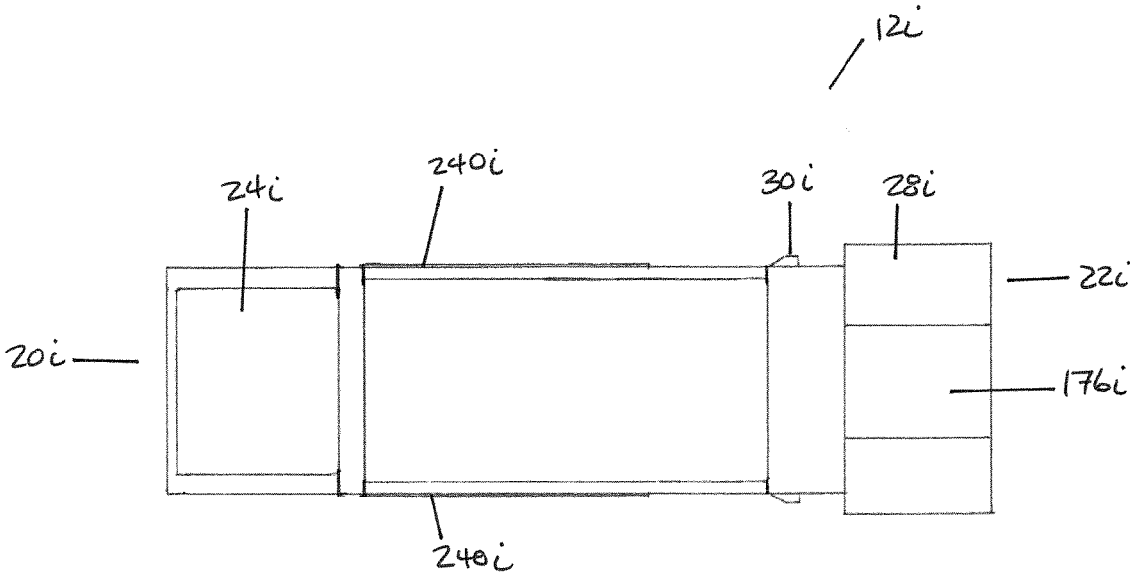
FIGS. 56*a*-56*d* are top, side, front and rear views, respectively, of a tenth embodiment of an inner tube of the invention.
Figure 56B:
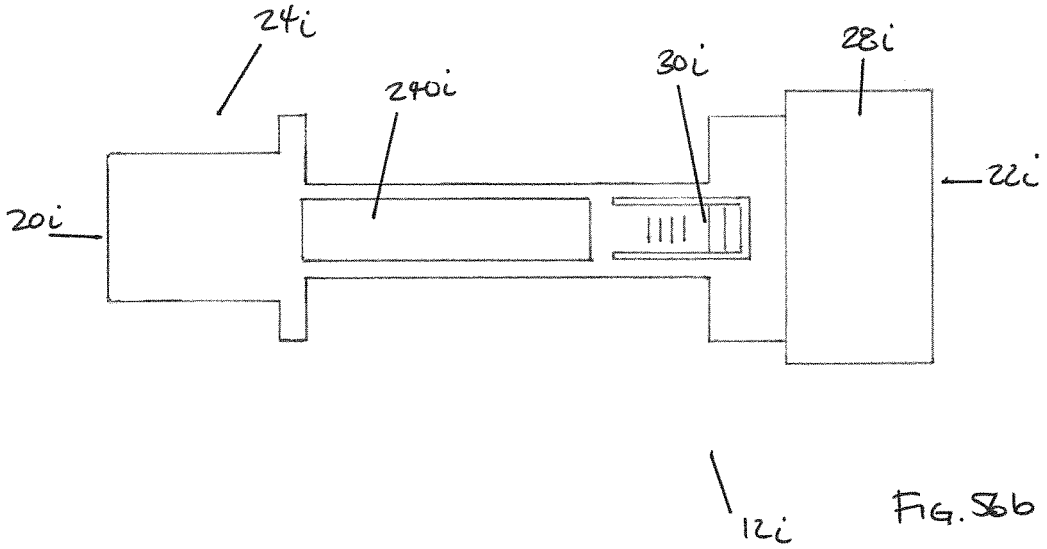
Figure 56C:
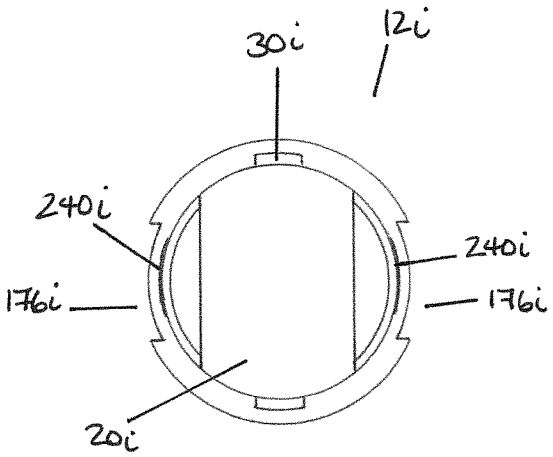
Figure 57C:
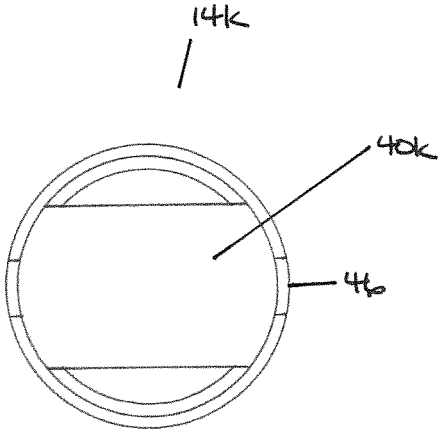
FIGS. 57*a*-57*d* are top, side, front and rear views, respectively, of an eleventh embodiment of an outer shell of the invention.
Figure 56D:
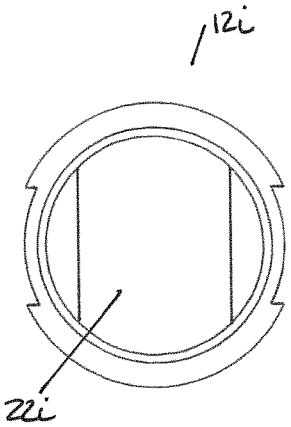
Figure 57D:
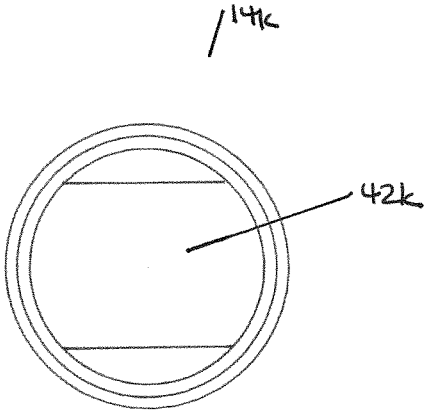
Figure 57A:
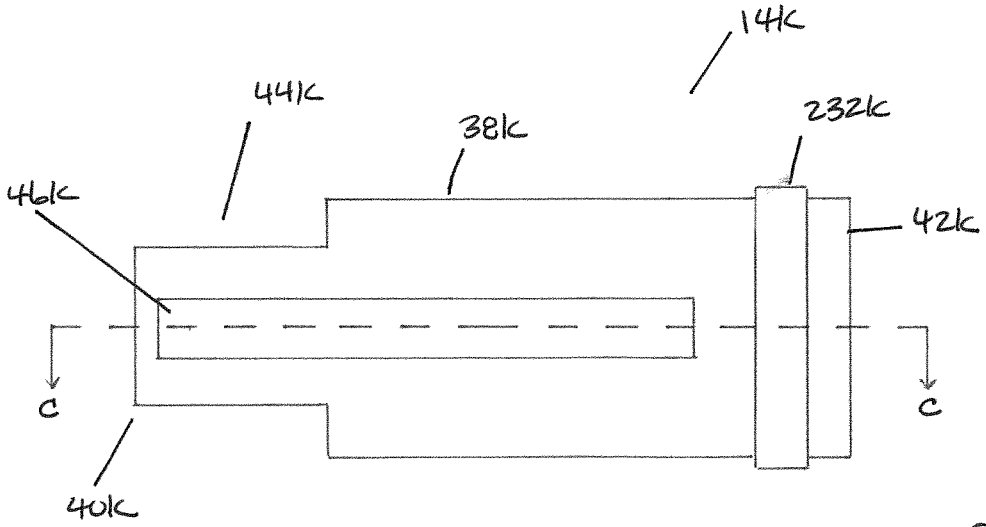
Figure 58:
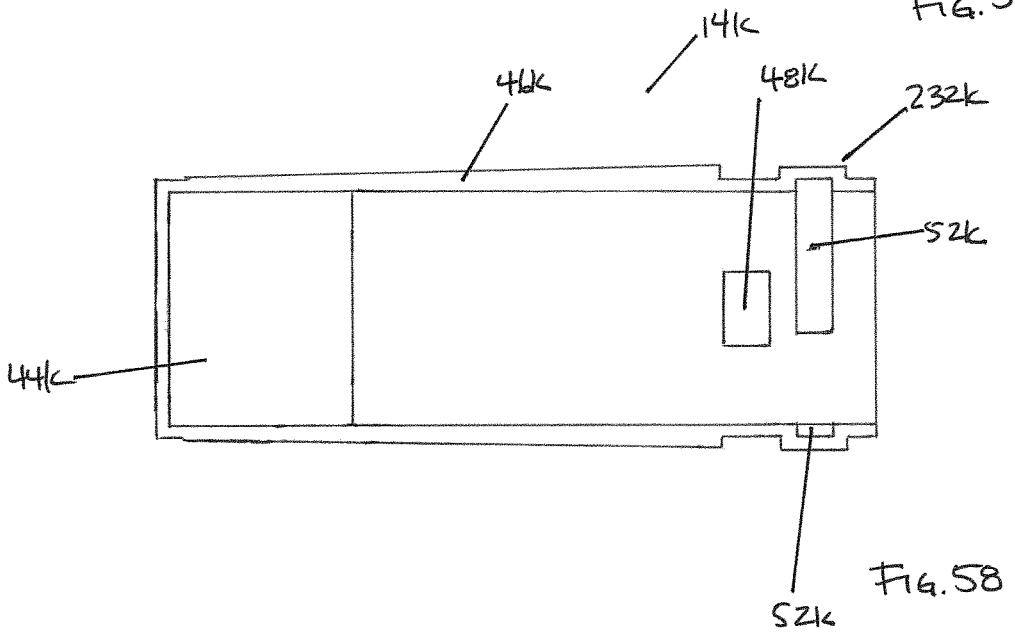
FIG. 58 is a cross-sectional view of the shell of FIG. 57*a*, taken along line c-c.
Figure 57B:
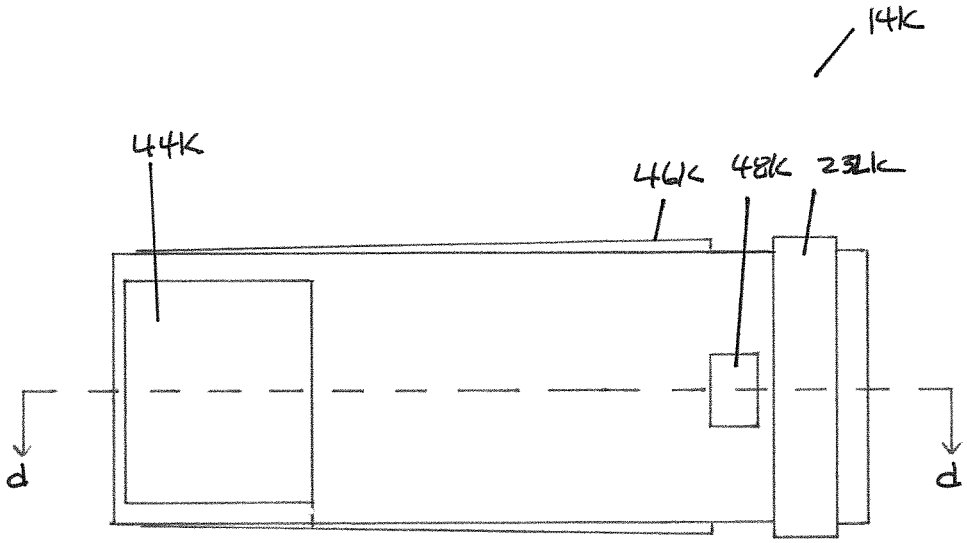
Figure 59:
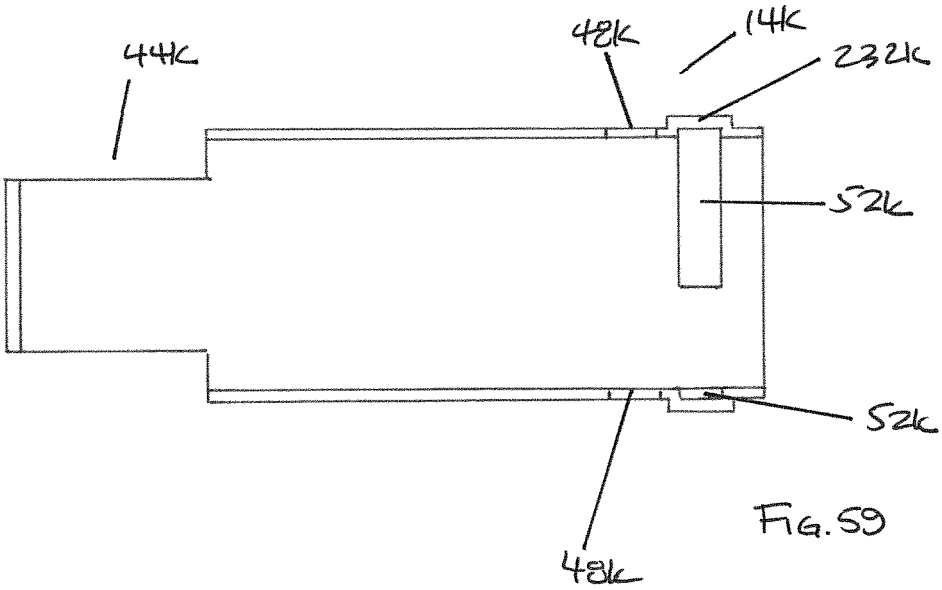
FIG. 59 is a cross-sectional view of the shell of FIG. 57*b*, taken along line d-d.
Figure 60A:
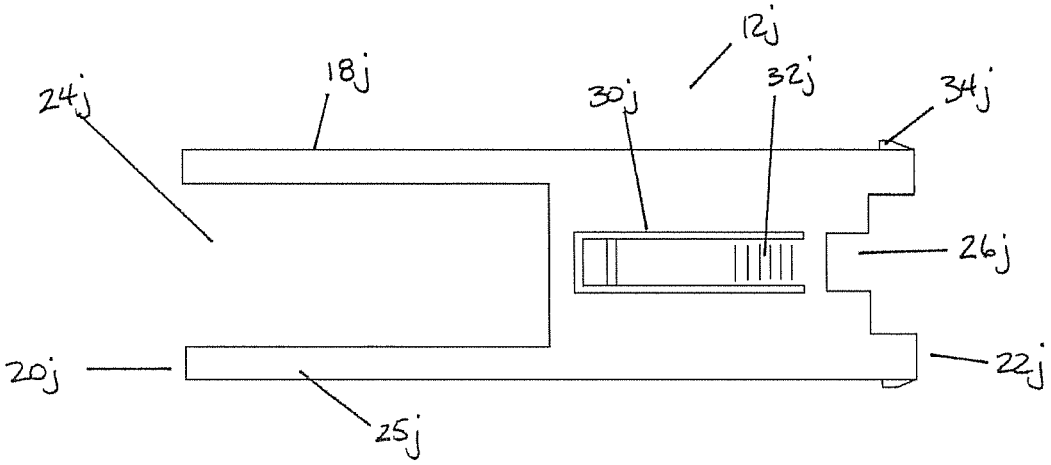
FIGS. 60*a* and 60*b* are side and top views, respectively, of an eleventh embodiment of an inner tube of the invention.
Figure 60B:
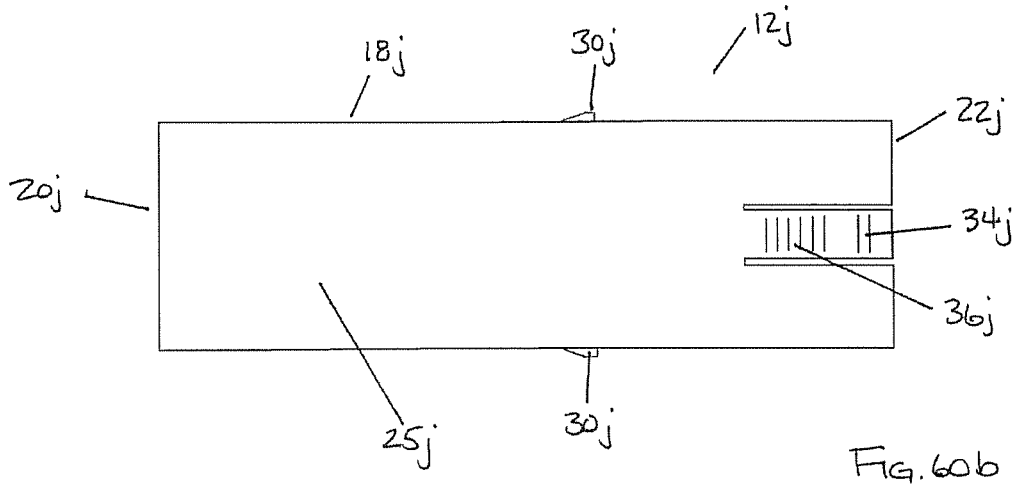
Figure 61A:
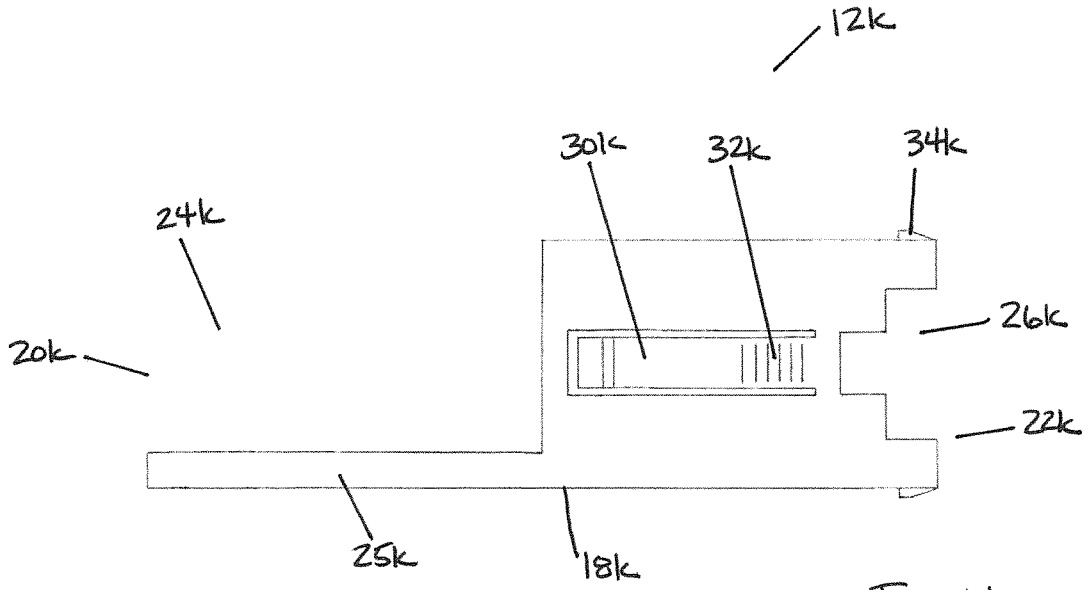
FIGS. 61*a* and 61*b* are side and top views, respectively, of a twelfth embodiment of an inner tube of the invention.
Figure 61B:
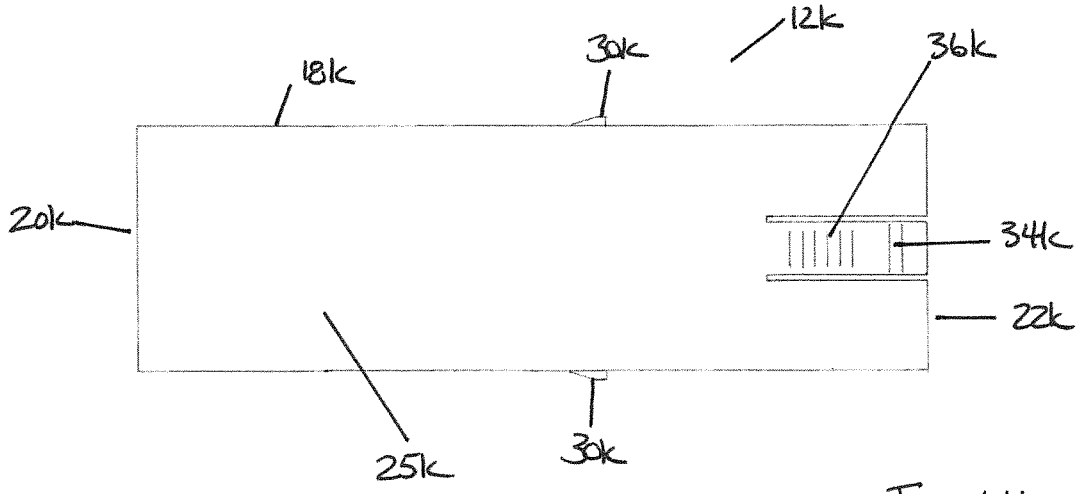
Figure 62A:
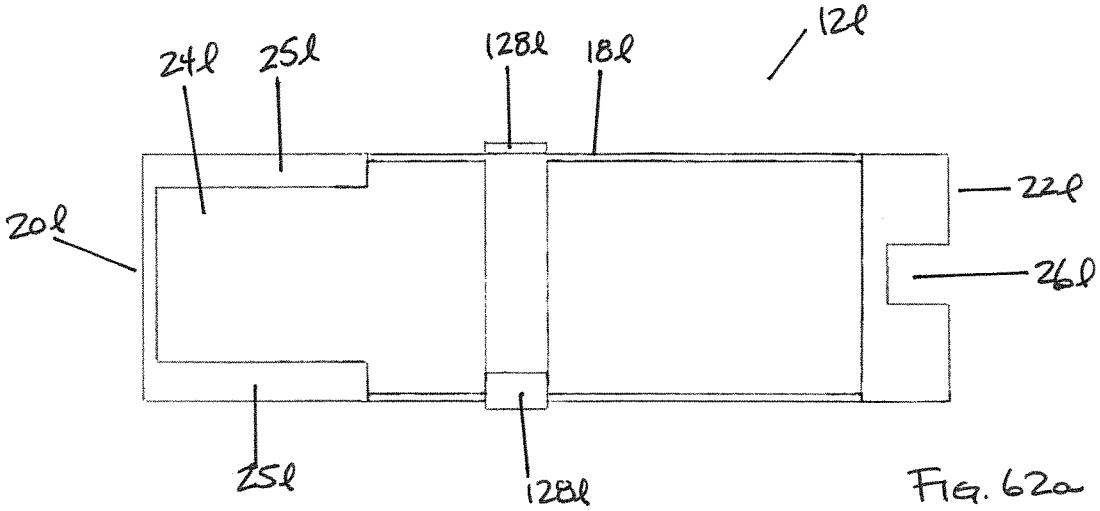
FIGS. 62*a* and 62*b* are side and top views, respectively, of a thirteenth embodiment of an inner tube of the invention.
Figure 62B:
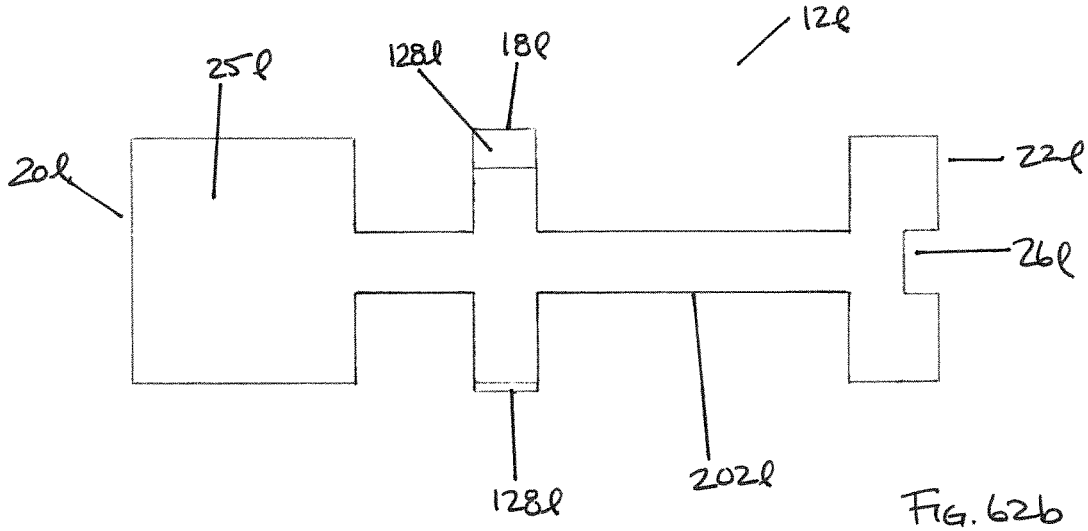
Figure 63A:
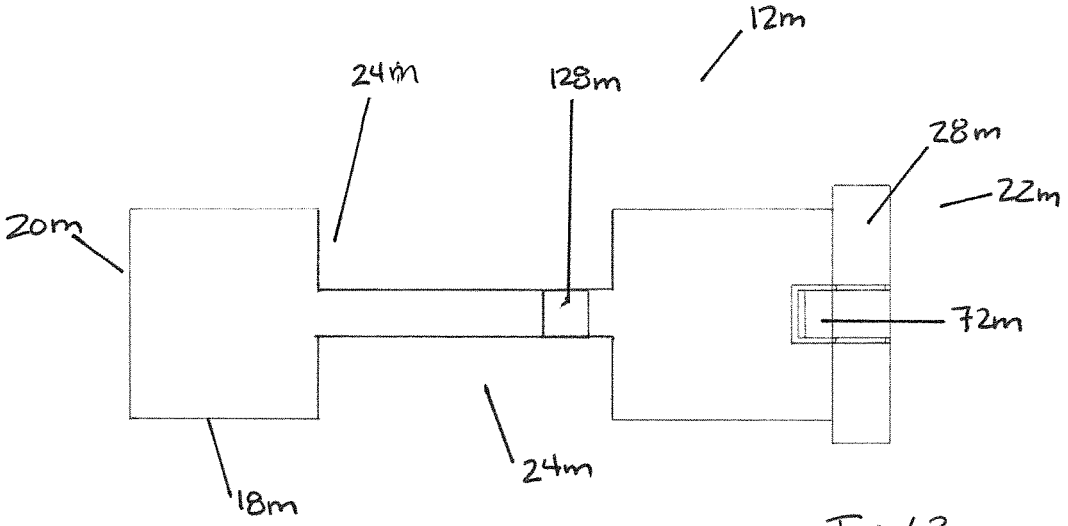
FIGS. 63*a* and 63*b* are side and top views, respectively, of a fourteenth embodiment of an inner tube of the invention.
Figure 63B:
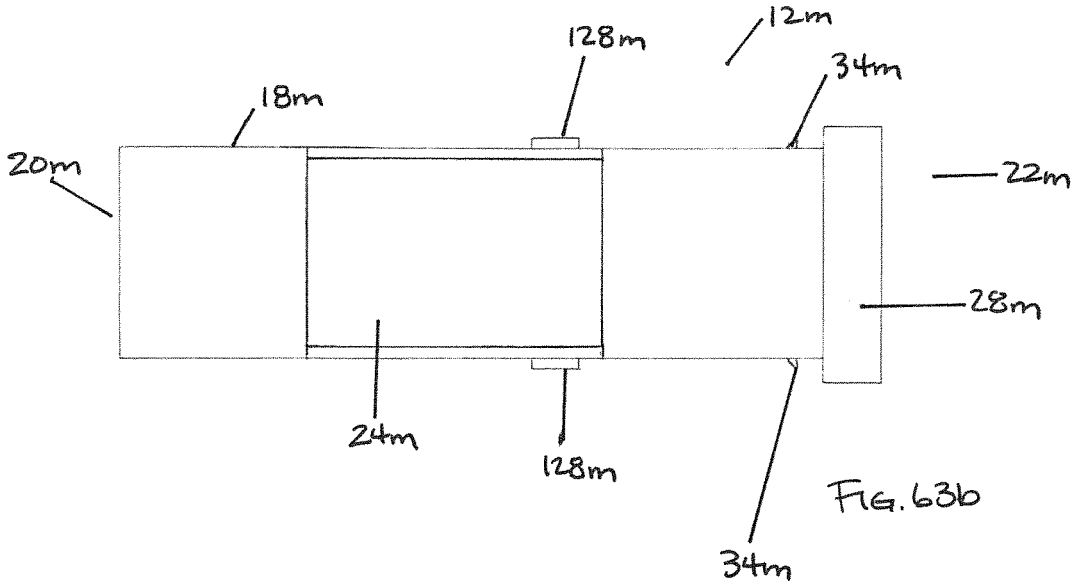

An alternative embodiment of closure means is shown in detail in FIGS. 12*a*-12*c* as refill plug 88*a*, which may provide a slightly different magazine profile. Refill plug 88*a* comprises a disk shape and a threaded portion 90 around its outer circumference, again being of a size to mate with a threaded end of an outer shell. Refill plug 88*a* may also be provided with one or more slots 92*a*, arranged in an X as shown, a slot, or any other suitable shape, by which a suitable tool such as a screwdriver or a coin may be inserted to tighten or loosen the refill plug in the end of shell 14. Alternatively, refill plug 88*a* may be provided without a threaded portion, and may simply be friction-fitted into an end of an outer shell. In a further alternative, best shown in FIGS. 37*a*-37*c*, refill plug 88*b* may be provided with an extending divider tab 198*b*, which may be grasped and operated solely by a user's fingers. In yet another embodiment, best shown in FIGS. 49*a*-49*c*, refill plug 88*c* may be provided with one or more extending tabs 200*c*, which would cooperate with one or more slots in a magazine. In this case, it may be possible to omit threads, making it faster to secure the refill plug to the magazine.

In one embodiment, shown in FIGS. 13*a*-13*d*, receiver 16*a* comprises a feed neck 94*a* through which paintballs received from a magazine 10 are passed to the marker. Feed neck 94*a* may be of any suitable configuration such that its exterior may be securely mounted on the marker. The receiver may be flat or tilted slightly with respect to the marker. The receiver is integrated with the marker or mounted thereon by any suitable means, such as clamping, friction fit, pressure fit, or any other means suited to or dictated by the particular marker and does not form part of the present invention. Receiver 16*a* also includes an opening, such as socket 96*a*, shaped and sized to receive a magazine and to secure it within the depths of the opening. Receiver 16*a* further includes a guide by which a user can ensure that magazine is being correctly inserted into socket 96*a*. In the embodiment shown, a pair of opposed guide slots 98*a* are provided, which would accommodate opposed guide rails on the magazine, but it will be understood that any suitable number of guide slots may be provided, and that they may be placed in any suitable orientation within receiver 16*a*. Further, the dimensions of guide slots 98*a* may change, for example by tapering, in order to facilitate the insertion of a magazine into the receiver 16*a*. It will also be understood that guide rails may be used on the receiver, which would accommodate the guide slots 64*b* of the outer shell embodiment shown in FIGS. 9*a*-9*d*. Receiver 16*a* may further comprise a magazine lock mechanism 100*a* that interacts with a magazine to secure the magazine within the socket 96*a*. Magazine lock mechanism 100*a* comprises a catch 102*a* that is biased, such as by spring 104*a*, to protrude into socket 96*a* through an opening 106*a*. The catch 102*a* is located and sized to interact with a lock slot in an outer shell, such that when the magazine is inserted, catch 102*a* automatically engages the lock slot to lock the magazine into place. When the magazine is to be removed, an actuator, such as lever 108*a*, may be moved to overcome the biasing force and disengage catch 102*a*, releasing the magazine.

Figure 64:
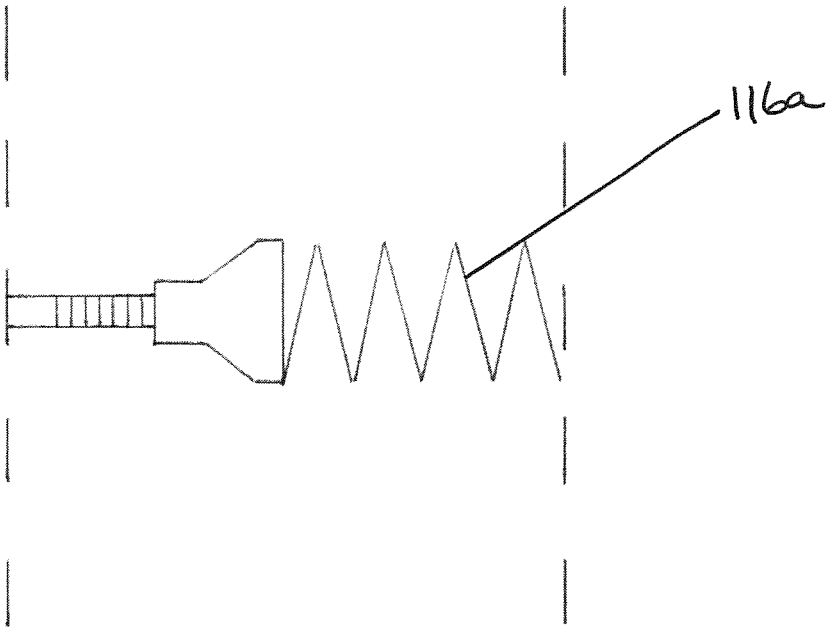
FIG. 64 is an enlarged view of a spring tension adjustment mechanism for use with the invention.
Figure 65A:
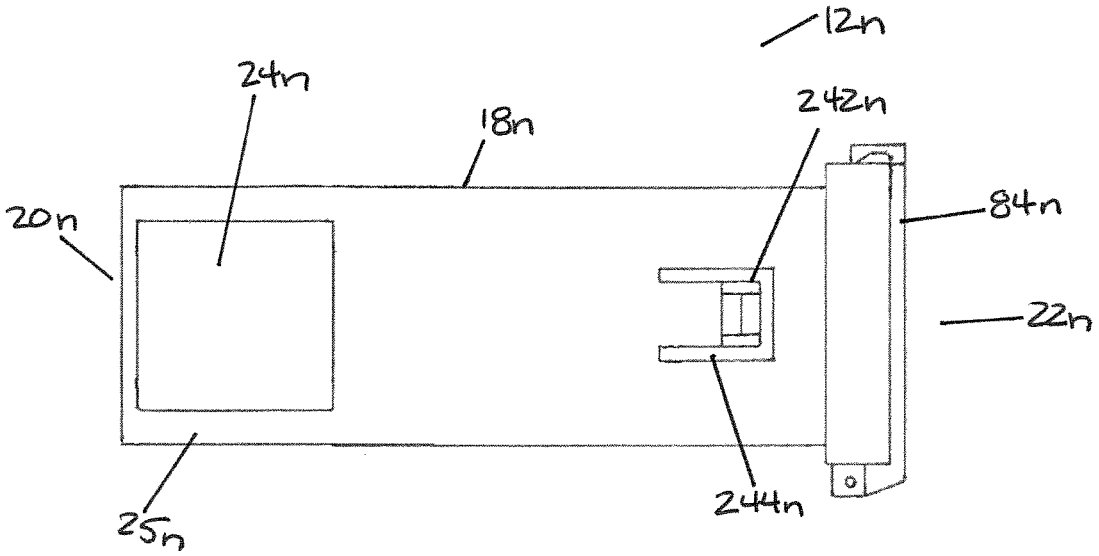
FIGS. 65*a*-65*d* are top, side, front and rear views, respectively, of a fifteenth embodiment of an inner tube of the invention.
Figure 65B:
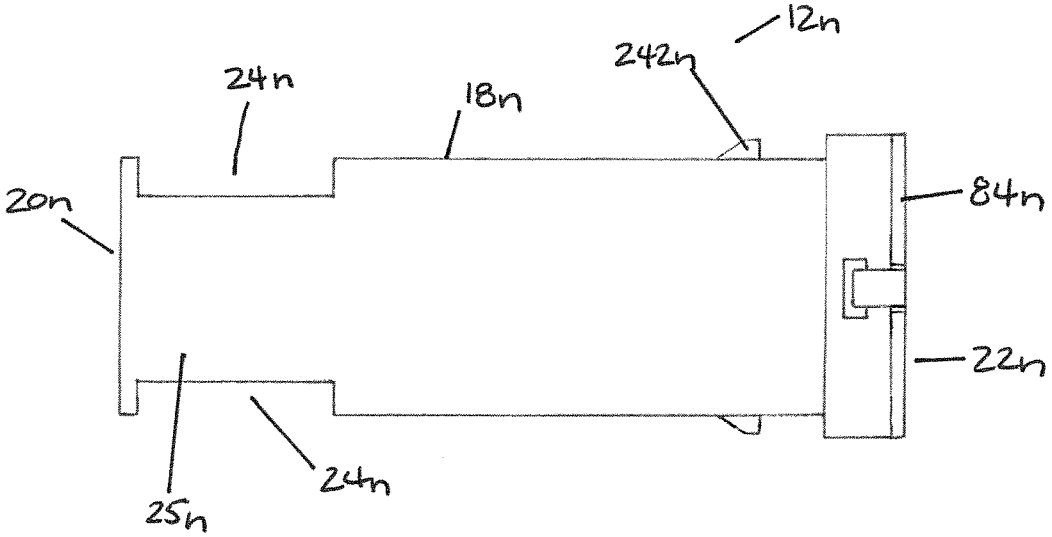
Figure 65C:
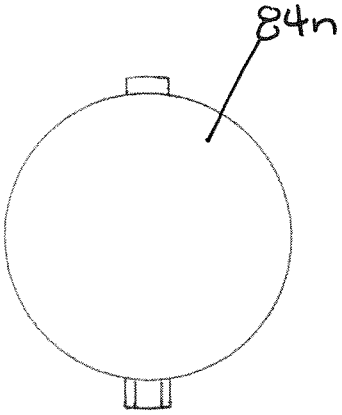
Figure 66C:
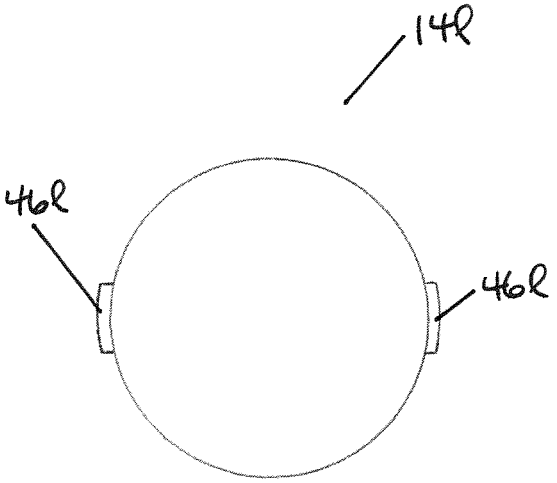
FIGS. 66*a*-66*d* are top, side, front and rear views, respectively, of a twelfth embodiment of an outer shell of the invention.
Figure 65D:
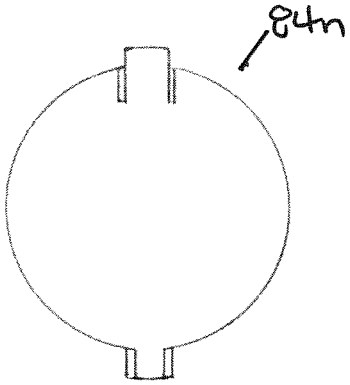
Figure 66D:
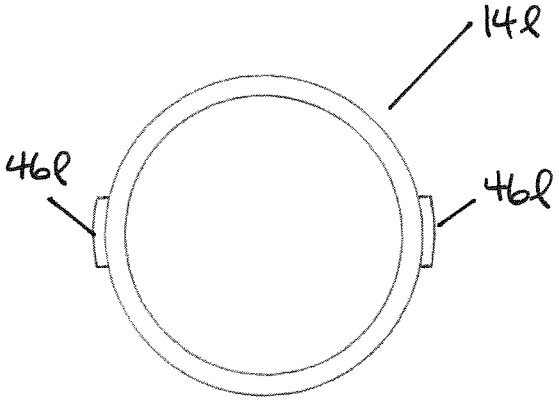
Figure 66A:
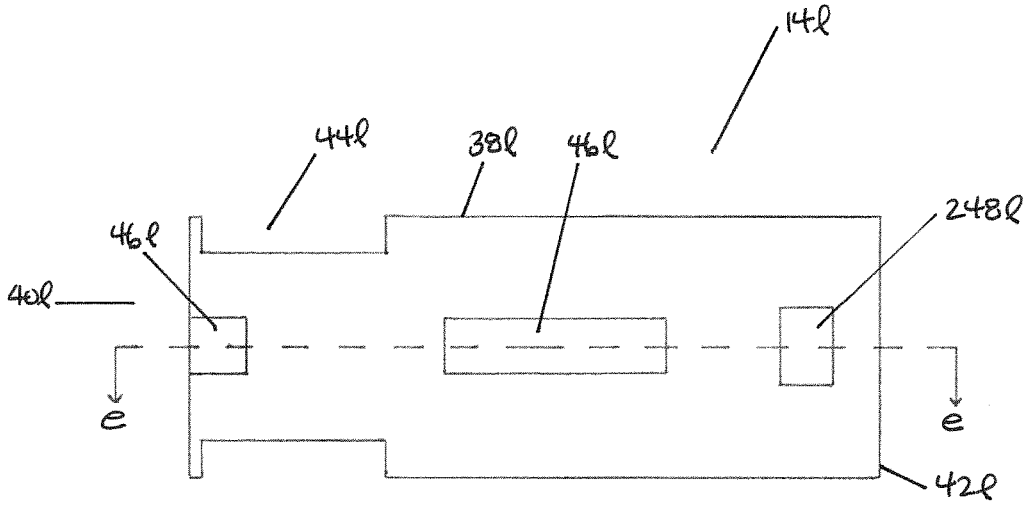
Figure 67:
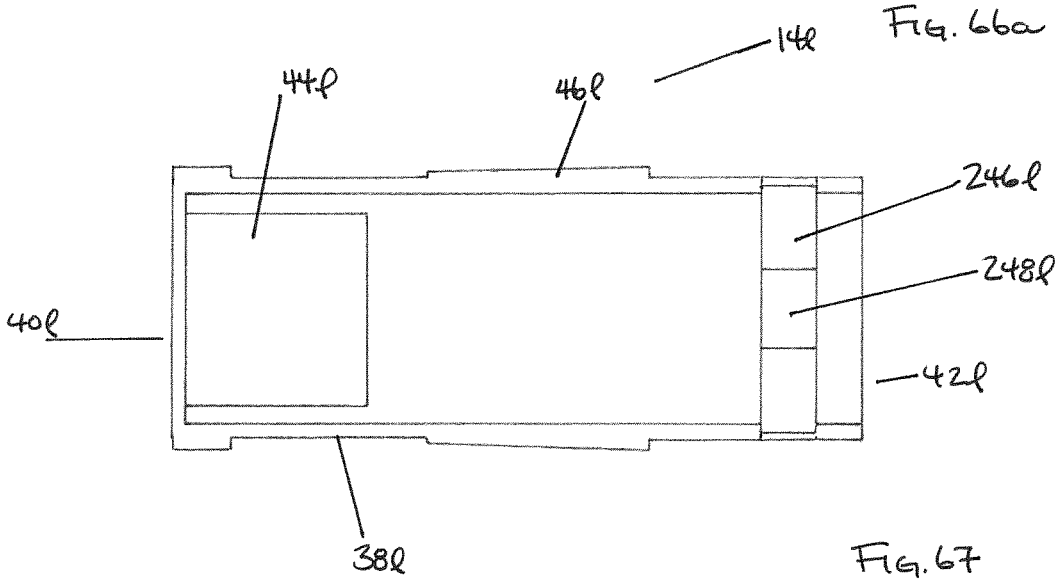
FIG. 67 is a cross-sectional view of the shell of FIG. 66*a*, taken along line e-e.
Figure 66B:
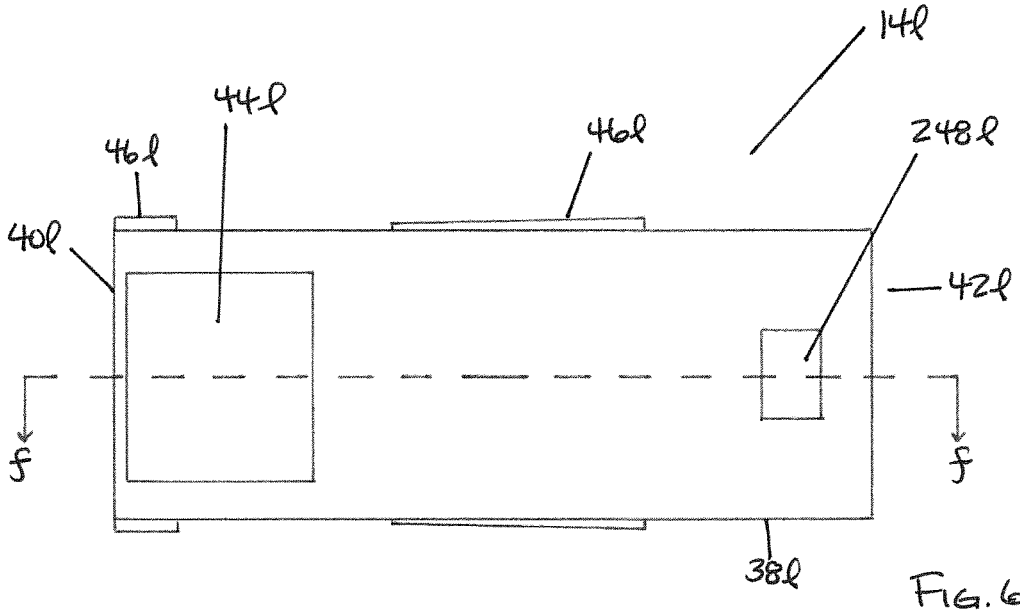
Figure 68:
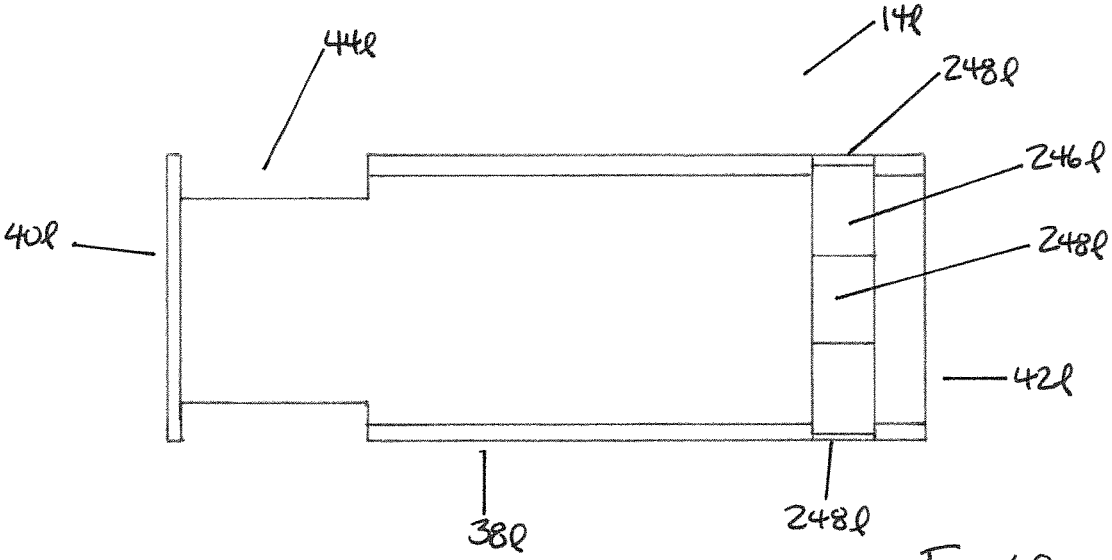
FIG. 68 is a cross-sectional view of the shell of FIG. 66*b*, taken along line f-f.

Within the socket 96*a*, this embodiment features an open end 110*a*, which extends approximately halfway around a magazine. The open end 110*a* simplifies insertion of the magazine into the receiver by providing more available area in which to make the correct connection. The socket 96*a* also features a closed end 112*a*, which is intended to fully encompass part of the magazine, and which assists in holding the magazine in place, down against the receiver. Between the open 110*a* and closed 112*a* ends, a buffer area 114*a* is provided, which consists of a buffer spring 116*a* behind a buffer gate 118*a*. When a magazine is loaded, buffer gate moves deeper into the socket 96*a*, compressing buffer spring 116*a*. It is held in that position when lock mechanism 100*a* engages the magazine. When the lock mechanism 100*a* is released, buffer spring 116*a* will expand to assist with the ejection of the magazine from the socket 96*a*. Buffer spring 116*a* may be provided in one or more spring strengths, chosen to provide different responses. For example, a stronger spring would eject a magazine with more force, which may or may not be preferred by a particular user. Alternatively or in addition, an adjustable spring arrangement such as that shown in FIG. 64 may be provided. Buffer area 114*a* also allows easy and intuitive magazine insertions, as it is sized to prevent a magazine from going too deeply into the socket and perhaps becoming jammed. The presence of buffer spring 116*a* also slightly cushions the magazine as it is being inserted, minimizing the chances that the magazine will be damaged. Buffer gate 118*a* is aligned within socket 96*a*, such as by guide mechanism 120*a*, and travels between a first position, in which the buffer spring 116*a* is extended, and a second position where the buffer spring 116*a* is compressed. In the first position, buffer gate 118*a* is positioned to substantially cover the mouth of the feed neck 94*a*. This allows the user to fire or manipulate the marker in between magazine changes (i.e. when there is no magazine in the receiver) without spilling rounds out of the receiver. When the magazine is inserted, the buffer gate 118*a* is pushed into the second position, uncovering the mouth of the feed neck 94*a*, allowing paintballs to flow from the magazine (once it is armed) into the feed neck 94*a*. The buffer gate 118*a* provides a clean way to change magazines, in which a magazine can be removed and replaced even if it is not yet empty. In prior art receivers without separate protection over the feed neck and a way to close the magazine, it is possible for a user to eject a magazine which is not yet empty and which is therefore still feeding paintballs to the receiver. In that case, it is very likely that a paintball will get caught and break while the magazine is being ejected, creating a mess within the receiver and on the marker and magazine. The use of the buffer area 114*a* may allow a user to take advantage of a convenient time to reload, rather than being forced to wait until a magazine is completely empty.

Figure 14B:
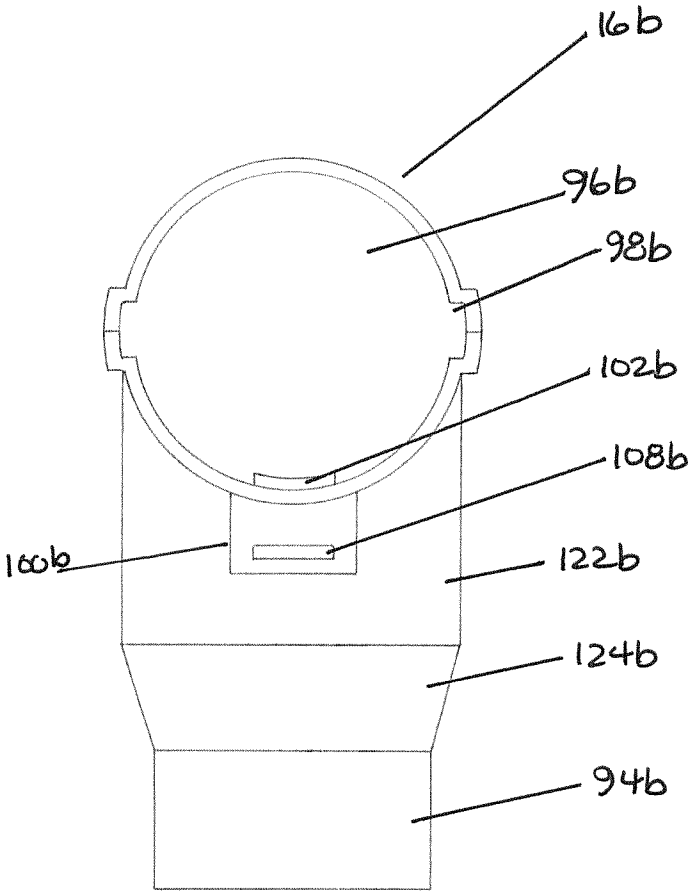
FIGS. 14*a* and 14*b* are side and front views, respectively, of a second embodiment of a receiver according to the invention.
Figure 13B:
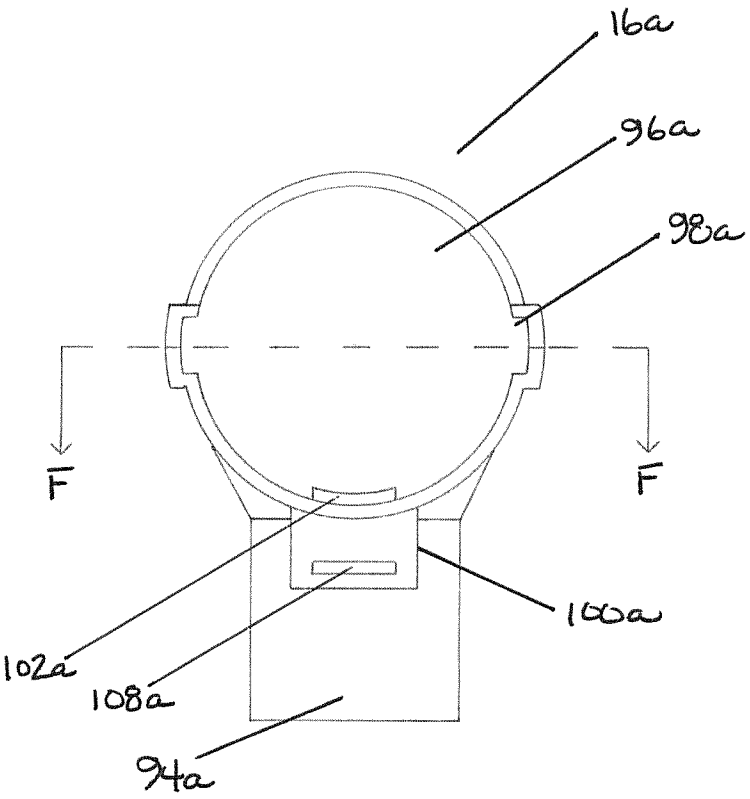
Figure 13C:
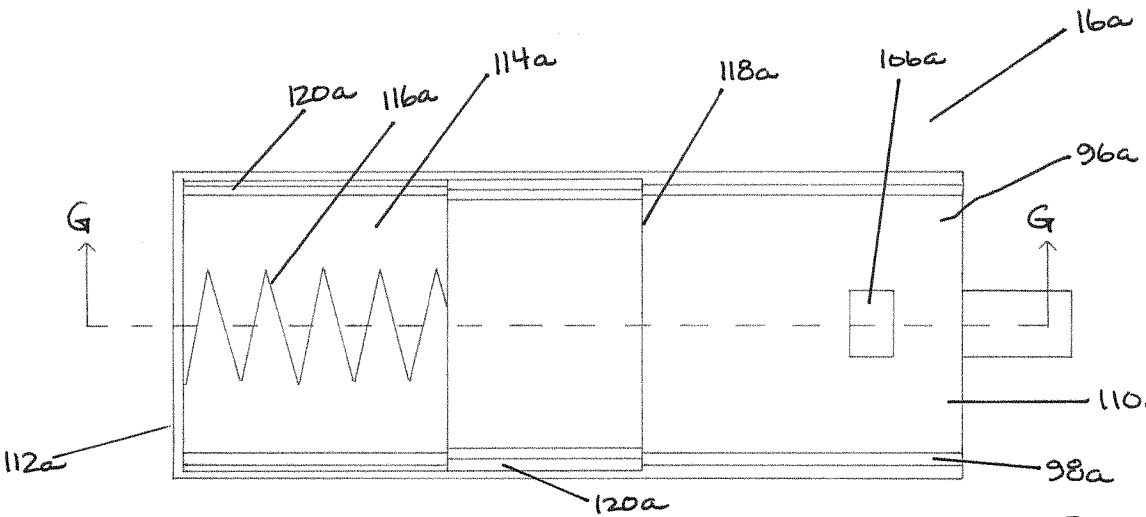
FIG. 13*c* is a sectional view of the receiver of FIG. 13*b*, taken along line F-F.
Figure 13D:
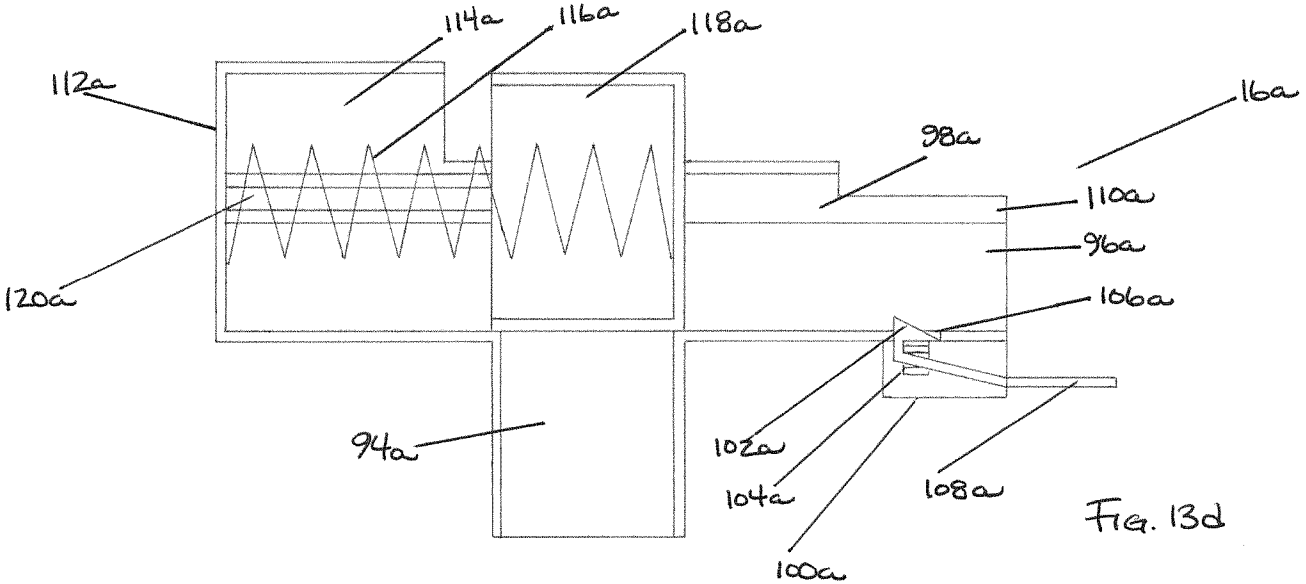
FIG. 13*d* is a sectional view of the receiver of FIG. 13*c*, taken along line G-G.
Figure 14A:
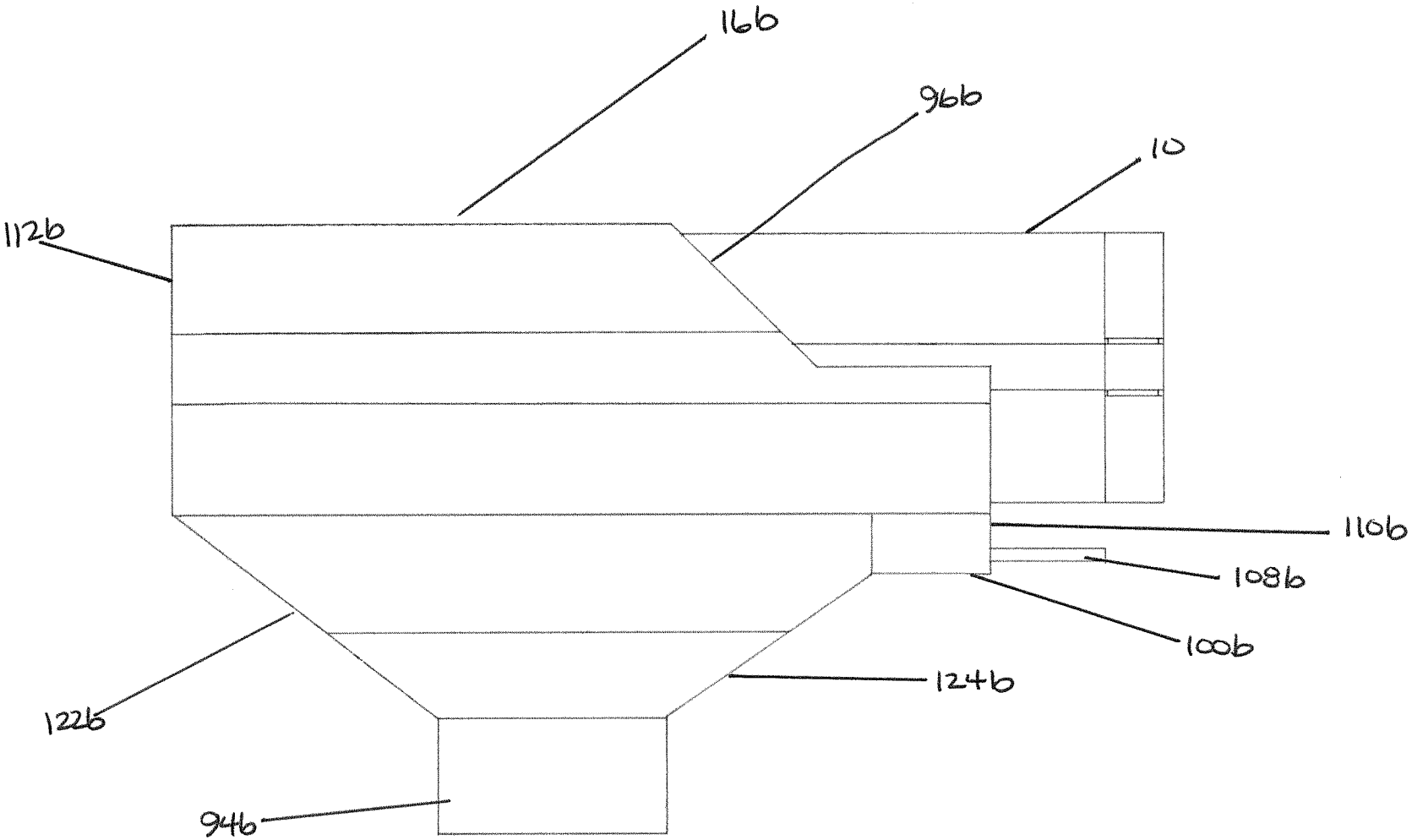
Figure 15A:
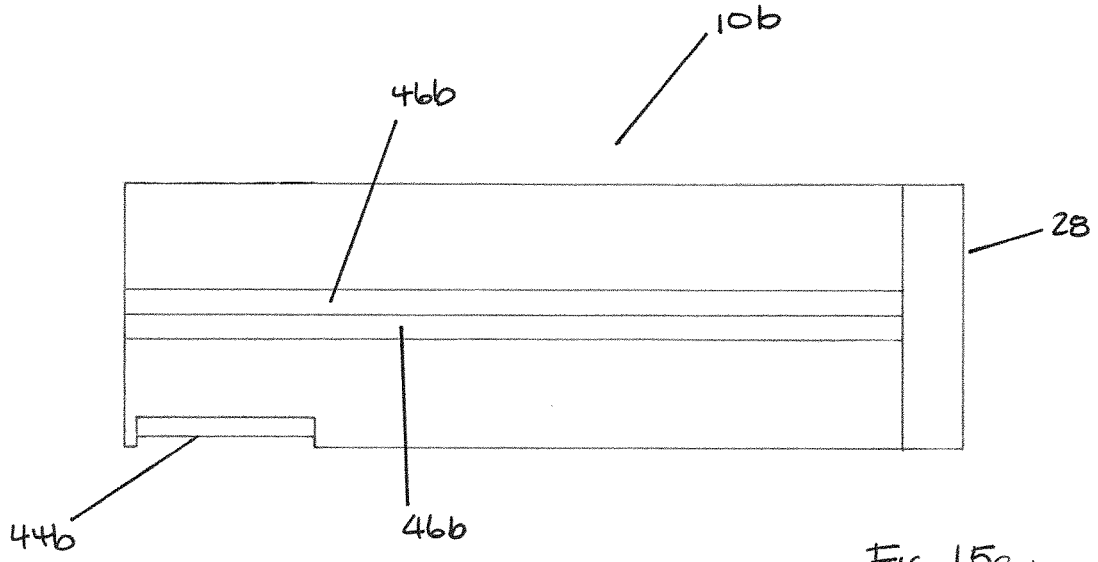
FIGS. 15*a* and *b* are side and bottom views, respectively, of a second embodiment of the magazine of the invention.
Figure 15B:
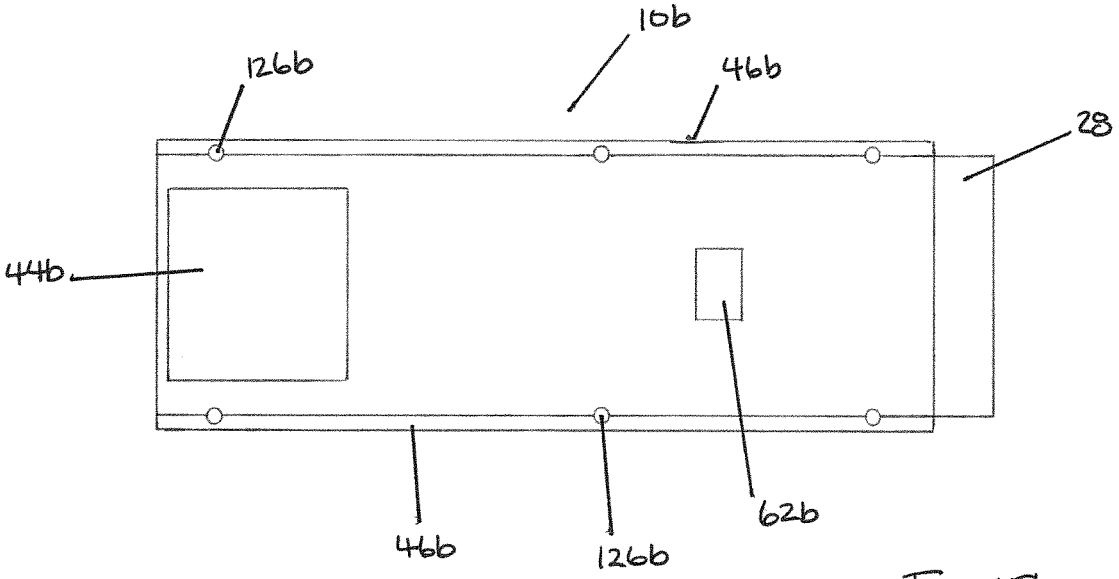
Figure 16A:
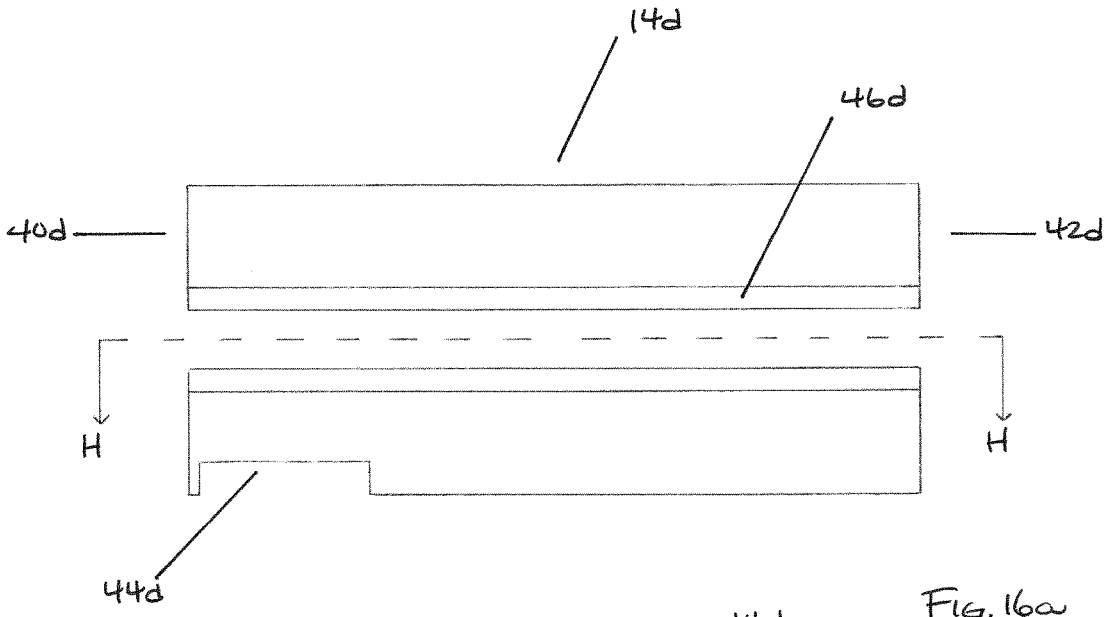
FIGS. 16*a*-16*d* are side, sectional (taken along line H-H in FIG. 16*a*), bottom, front and rear views, respectively, of a fourth embodiment of an outer shell of the invention.
Figure 16B:
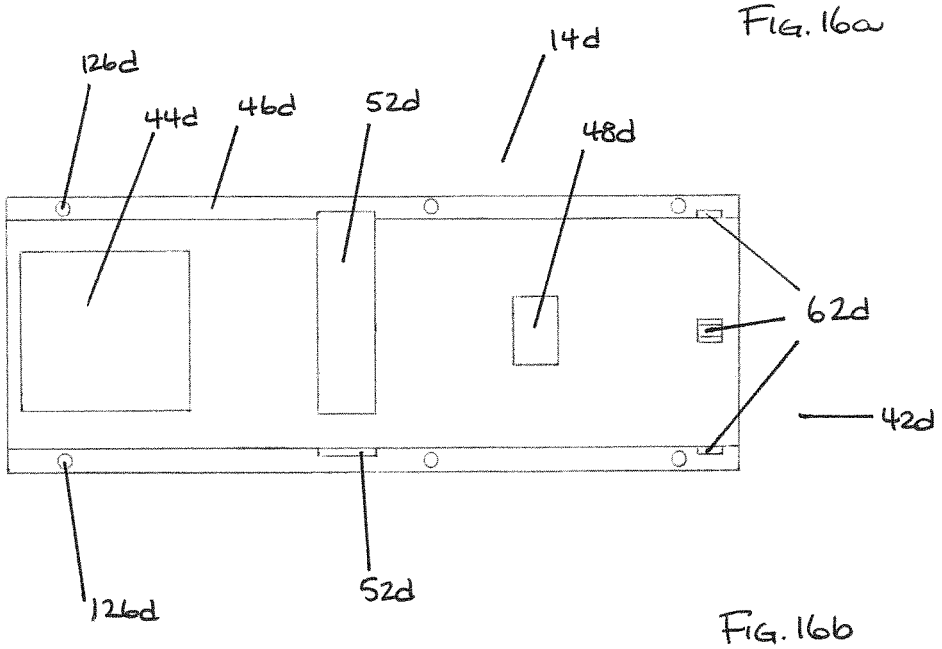
Figure 16C:
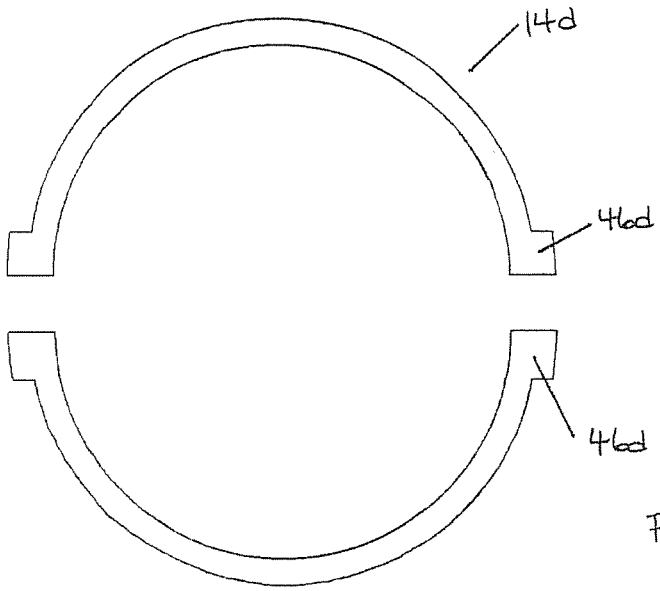
Figure 16D:
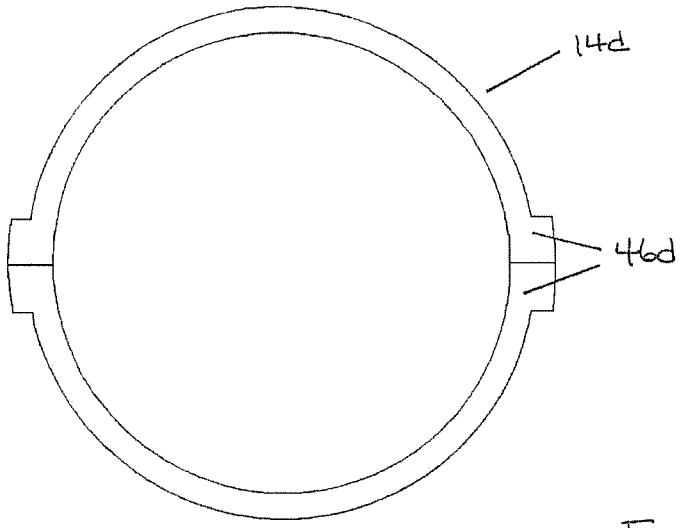

In the embodiment shown in FIGS. 14*a* and 14*b*, receiver 16*b* includes similar parts as the first embodiment, such as a feed neck 94*b*, socket 96*b*, opposed guide slots 98*b* and magazine lock mechanism 100*b*. Receiver 16*b* may be sized to also serve a hopper function, for example by providing enlarged area 122*b*, which may be of any suitable size to hold one or more paintballs between the magazine and the marker, ready to provide a paintball to the marker on demand. This may expedite loading paintballs into the marker, as the user does not have to wait for all paintballs in the current magazine to be fed through to the marker before replacing the magazine. Paintballs may move towards the marker by any suitable means, including under gravity feed or with the assistance of a mechanical, pneumatic or electric feeding means associated with the marker. Receiver 16*b* may instead or in addition be provided with an area 124*b*, which is sized to accommodate mechanical, pneumatic or electric feeding assist means, such as an agitator, paddle, auger or other means to move the paintballs and clear any jammed paintballs.

Referring now to FIGS. 15*a*-16*d*, magazine 10*b* may be provided with the body 38*d* of outer shell 14*d* as a two-piece tube, most simply split along guide rails 46*d* and held together with suitable fasteners in one or more fastener holes 126*d*. This embodiment also includes twist channel 52*d*, which cooperates with twist guides on the inner tube, as will be discussed.

Figure 17A:
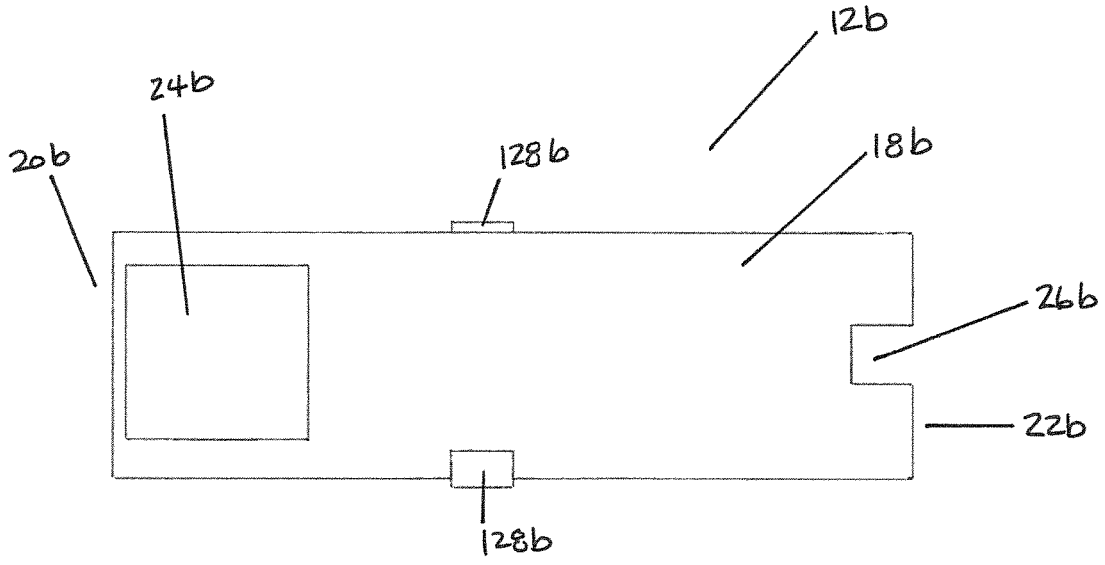
FIGS. 17*a*-17*d* are side, top, front and rear views, respectively, of a second embodiment of an inner tube of the invention.
Figure 17B:
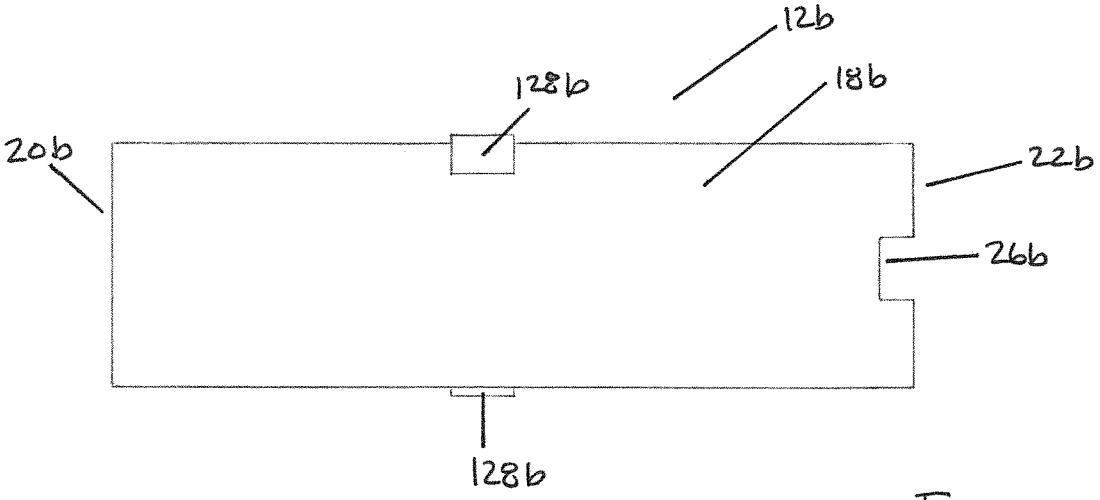
Figure 17C:
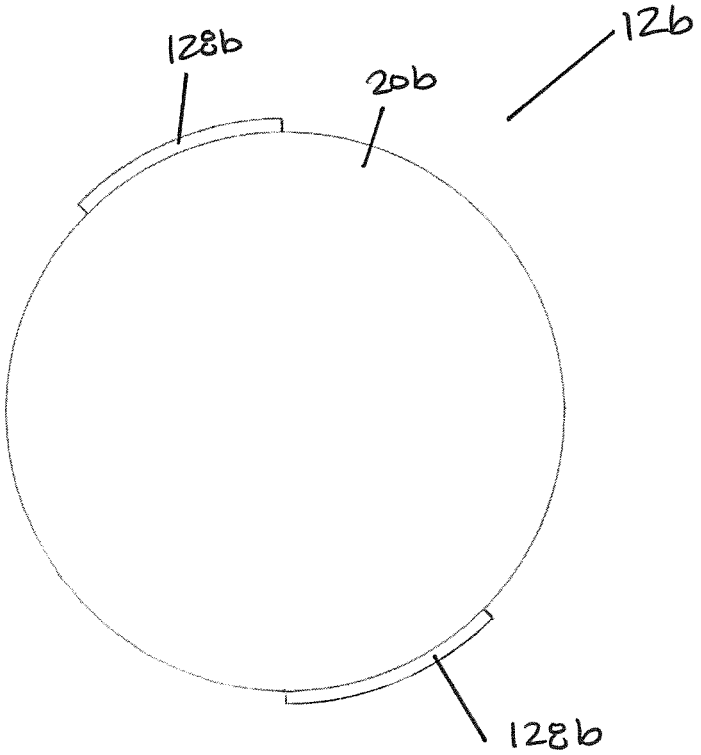
Figure 17D:
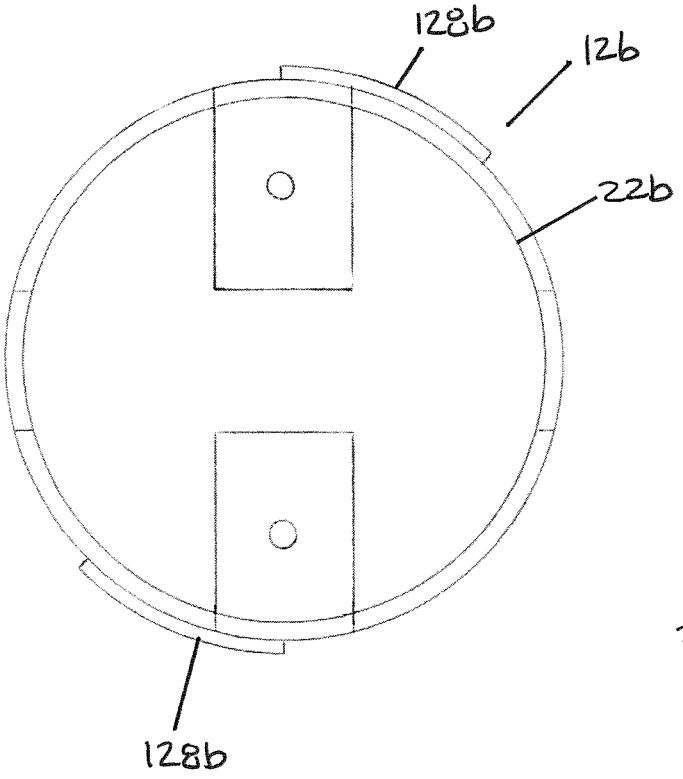
Figure 18A:
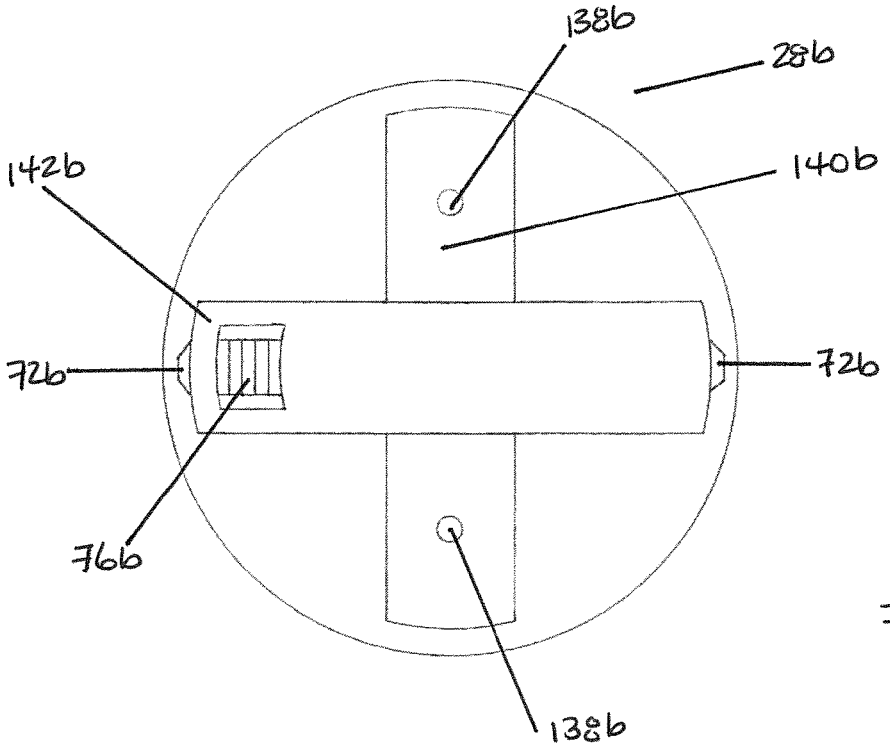
FIGS. 18*a* and 18*b* are views of two sides of a second embodiment of a gripper ring according to the invention.
Figure 18B:
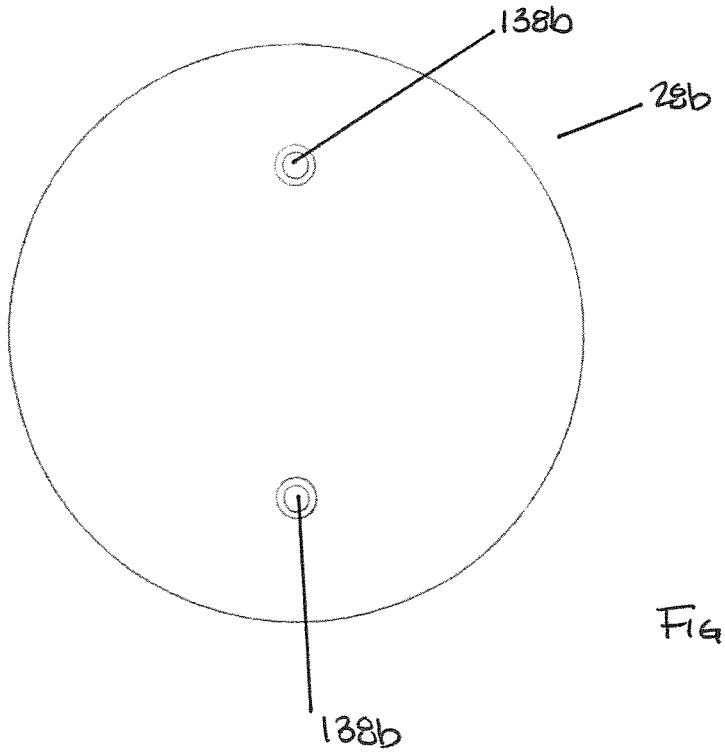
Figure 18C:
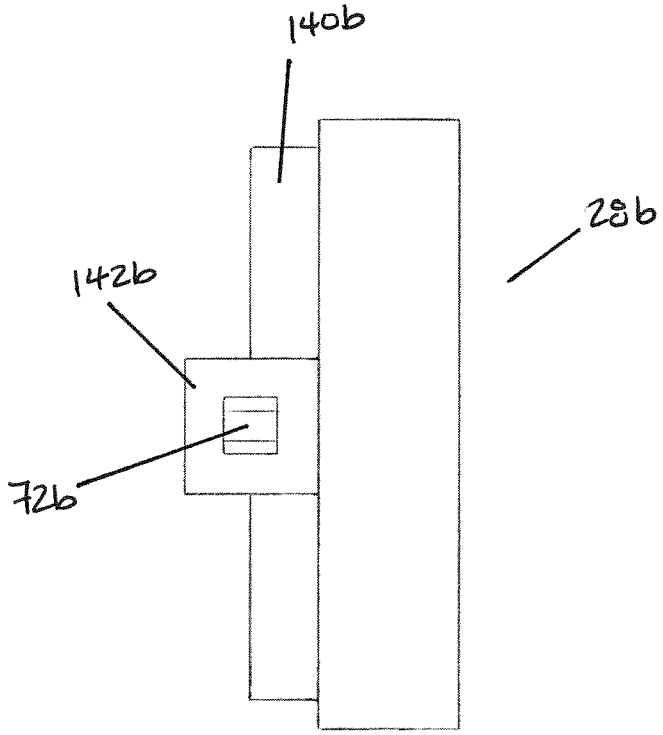
FIGS. 18*c* and 18*d* are top and side views, respectively, of the ring of FIG. 17*a;*
Figure 18D:
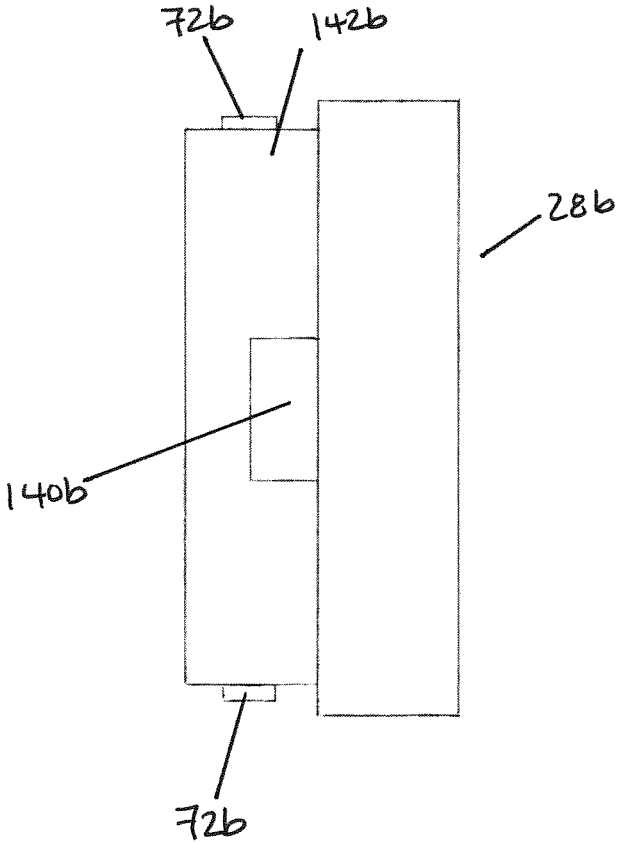

In the embodiment shown in FIGS. 17*a*-17*d*, inner tube 12*b* may be provided with one or more twist guides 128*b* on its outer surface. These will cooperate with the twist channel in an outer shell (e.g. twist channel 52*d* in FIG. 16*b*), to arm an assembled magazine. They will also abut the end of the twist channel if the channel does not extend too far around the circumference of the outer shell, in order to prevent over-rotation of the inner tube within the outer shell. This may eliminate the need for a secondary means to prevent over-rotation, such as on the gripper or at the rear end of the outer tube, or it may act as a backup rotation control. The front end 20*b* of inner tube 12*b* may be of a similar configuration as any of the other embodiments herein described, or may be closed, as shown in FIG. 17*c*. Inner tube 12*b* may also be provided with a plurality of rear apertures 26*b* to engage with a locking and arming mechanism such as a gripper, as will be discussed. Rear apertures may be provided in one or more opposed pairs of apertures 130*b*, 132*b*, depending on the configuration of the tube 12*b*. One or more tabs 134*b* may extend into the tube body 18*b*. One or more holes 136*b* may be provided in each tab 134*b* to accommodate means to fasten a gripper to inner tube 12*b*.

In the embodiment of gripper 28 shown in FIGS. 18*a*-18*d*, the gripper 28*b* is a disc shape having one or more fastener holes 138*b* which will line up with fastener holes to accommodate suitable fasteners. To increase the security of the attachment, fastener holes 138*b* may be provided on a block 140*b* extending from the inside surface of the gripper 28*b*, which will mate with apertures 132*b* on gripper 28*b*. A second block 142*b* may be oriented approximately perpendicularly to block 140*b*, and will preferably be located to mate with apertures 130*b* on gripper 28*b*. One or more spring-biased lock tabs 72*b* may be provided to lock an inner tube into the outer shell.

Figure 19B:
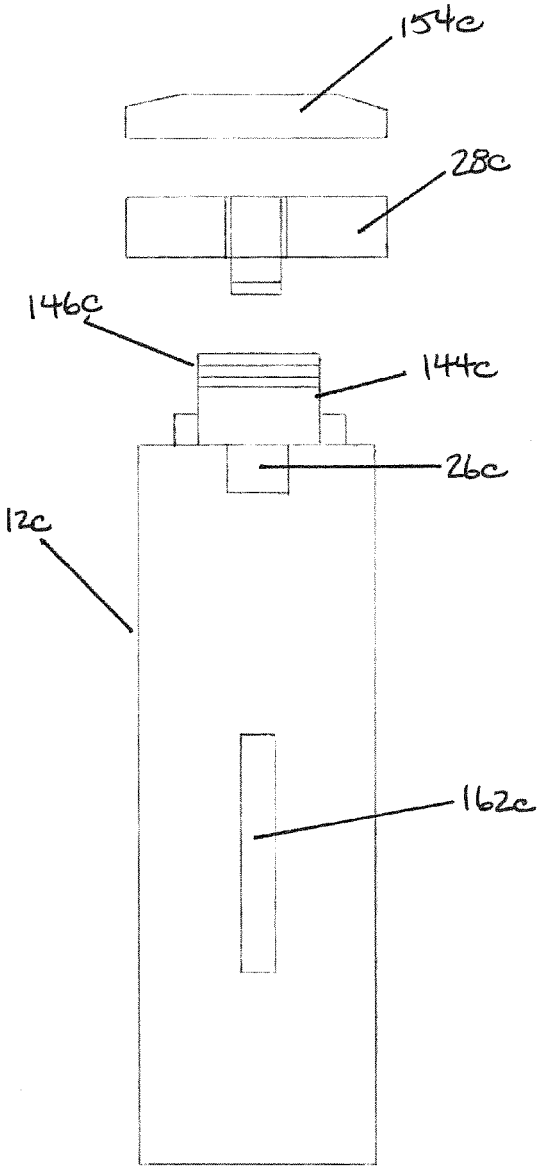
FIG. 19*b* is an exploded view of the magazine of FIG. 19*a;*
Figure 19A:
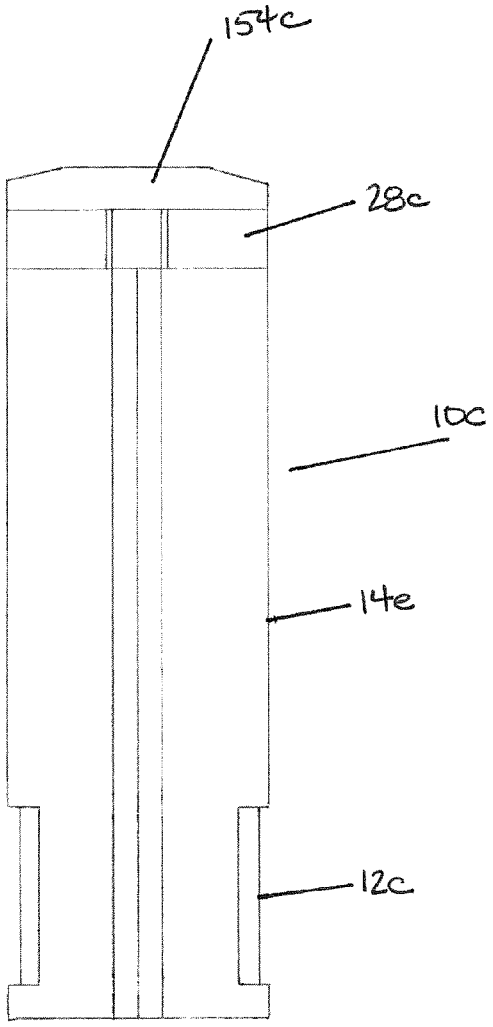
FIG. 19*a* is an assembled view of a magazine according to a third embodiment of the invention.
Figure 20A:
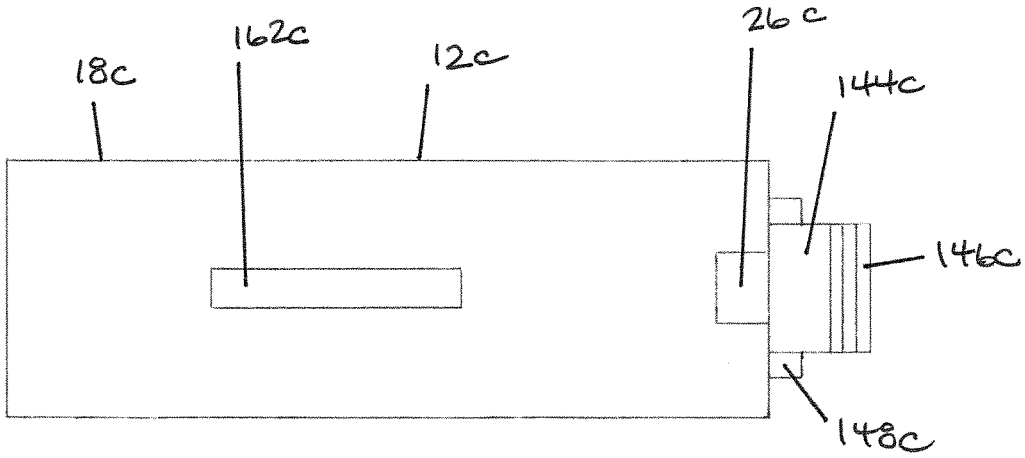
FIGS. 20*a*-20*d* are side, top, front and rear views, respectively of a third embodiment of an inner tube of the invention.
Figure 20B:
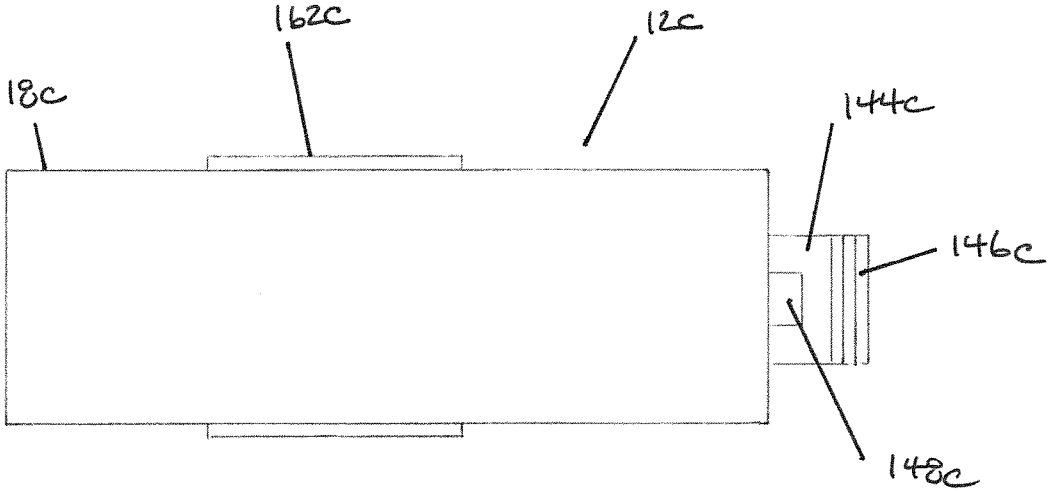
Figure 20C:
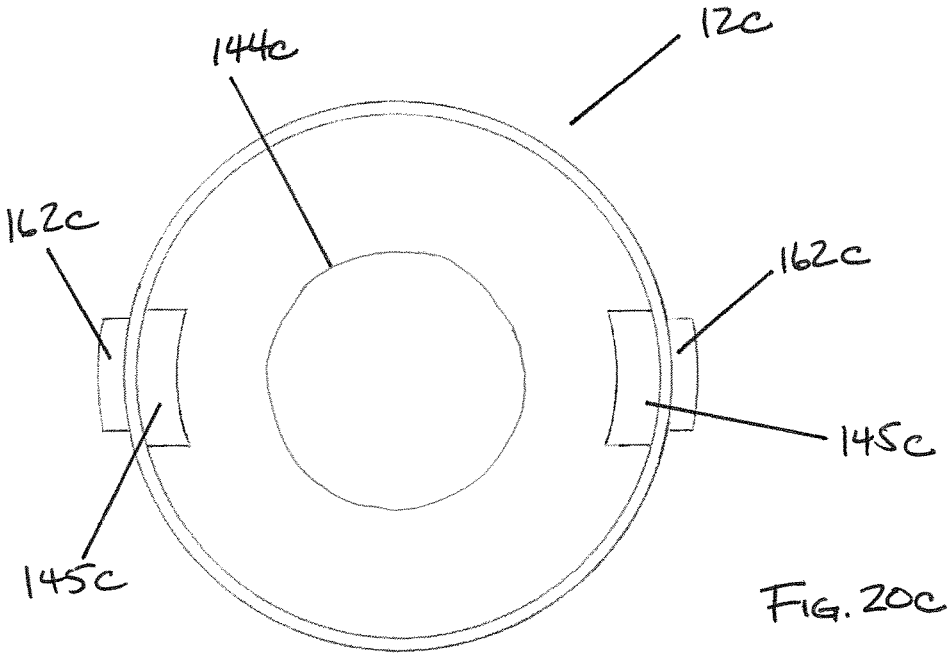
Figure 20D:
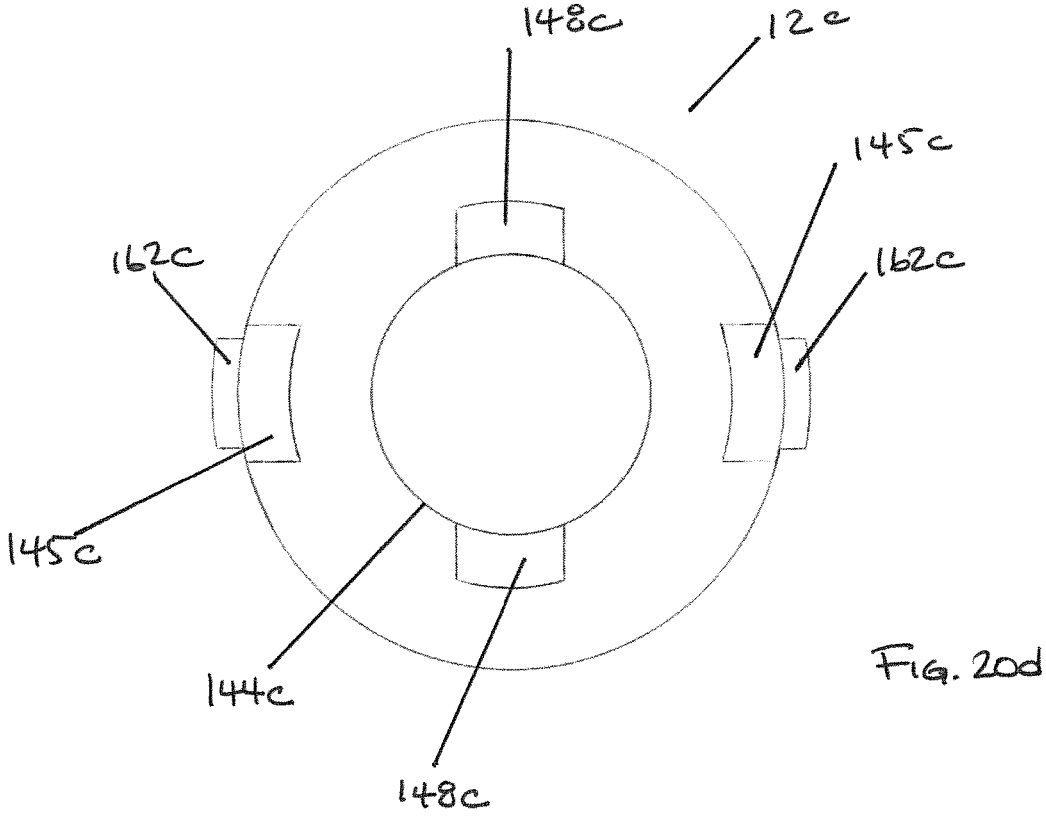
Figure 21A:
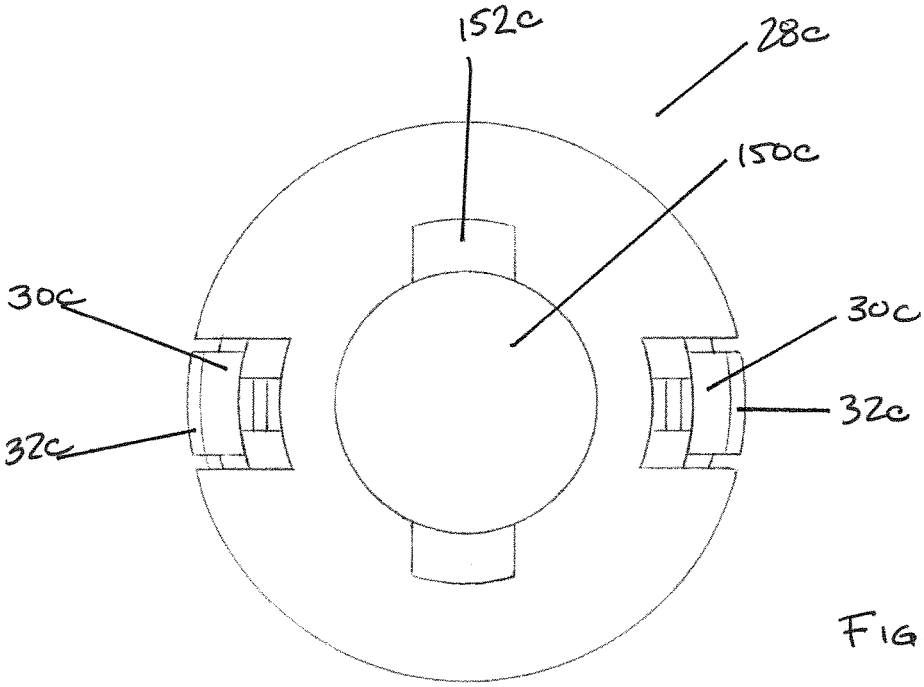
FIGS. 21*a* and 21*b* are views of two sides of a third embodiment of a gripper ring according to the invention.
Figure 21B:
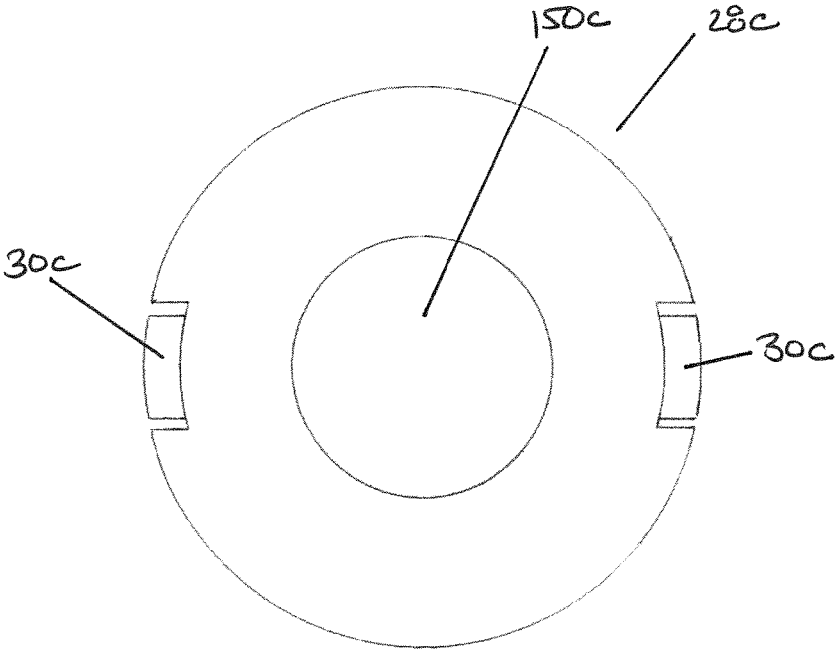
Figure 21C:
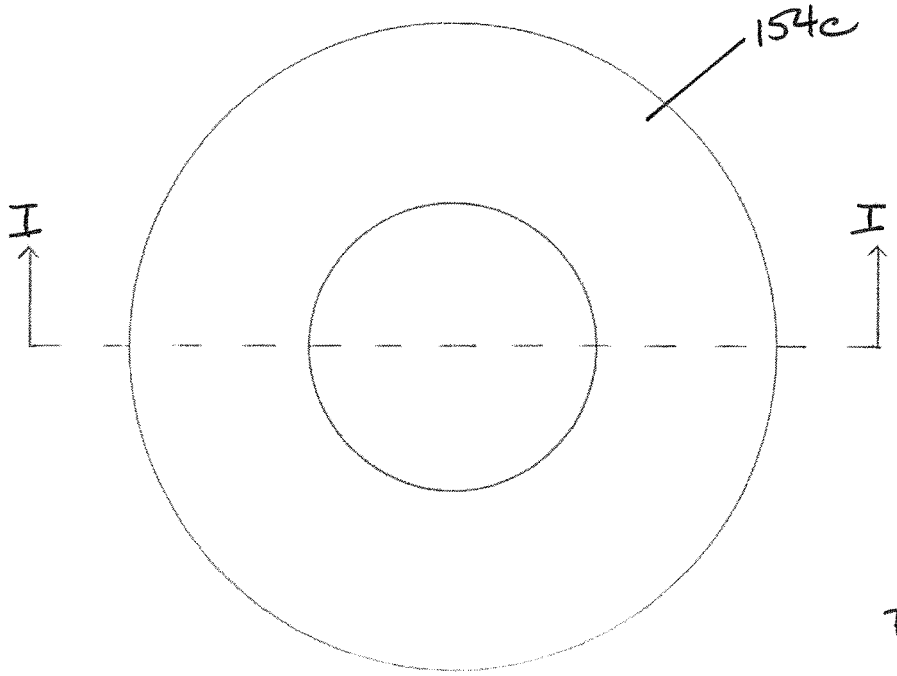
FIG. 21*c* is an inside view of a gripper ring for the embodiment of the magazine shown in FIG. 19.
Figure 21D:
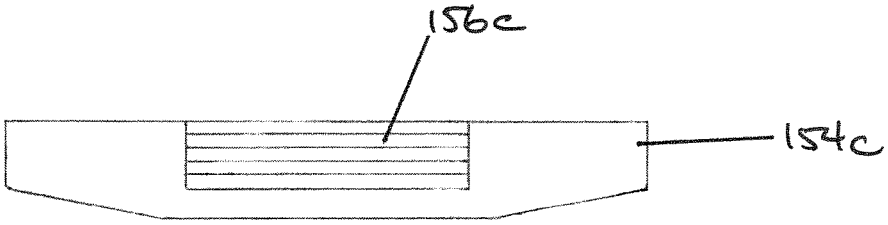
FIG. 21*d* is a cross-sectional view of the gripper ring of FIG. 21*c*, taken along line I-I.
Figure 22A:
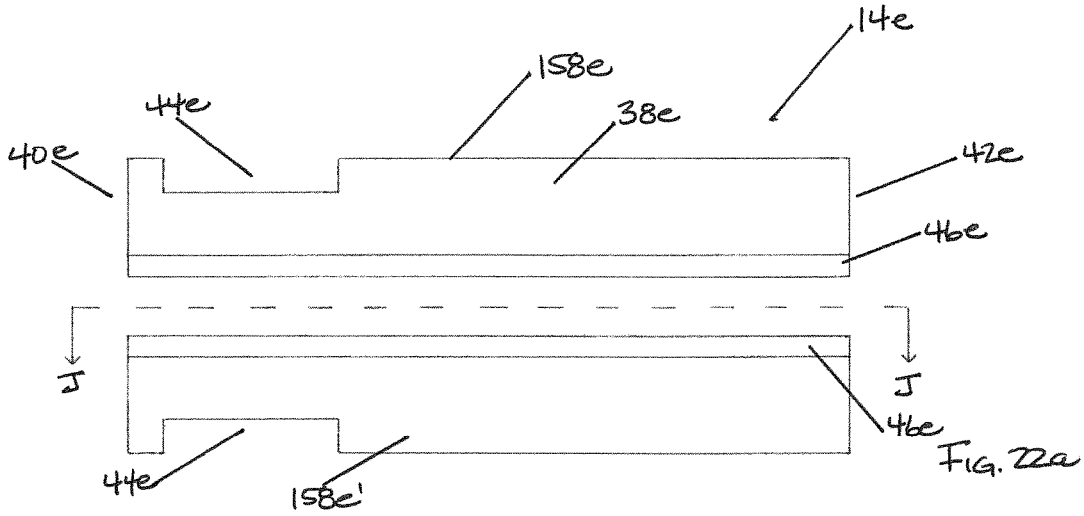
FIG. 22*a* is a side view of a fifth embodiment of an outer shell of the invention.
Figure 22B:
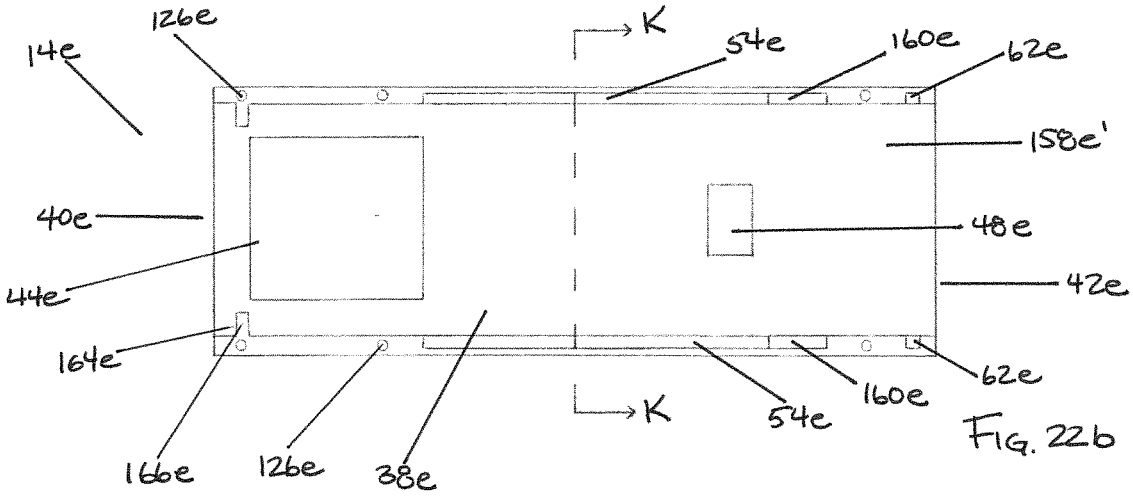
FIG. 22*b* is a cross-sectional view of the shell of FIG. 22*a*, taken along line J-J.
Figure 22C:
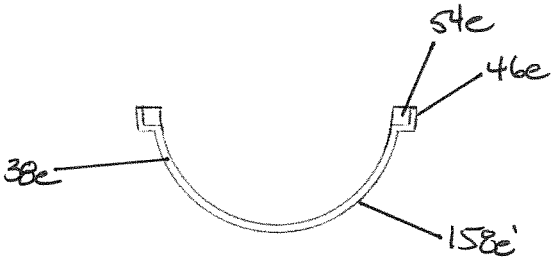
FIG. 22*c* is a cross-sectional view of the shell of FIG. 22*b*, taken along line K-K.
Figure 22E:
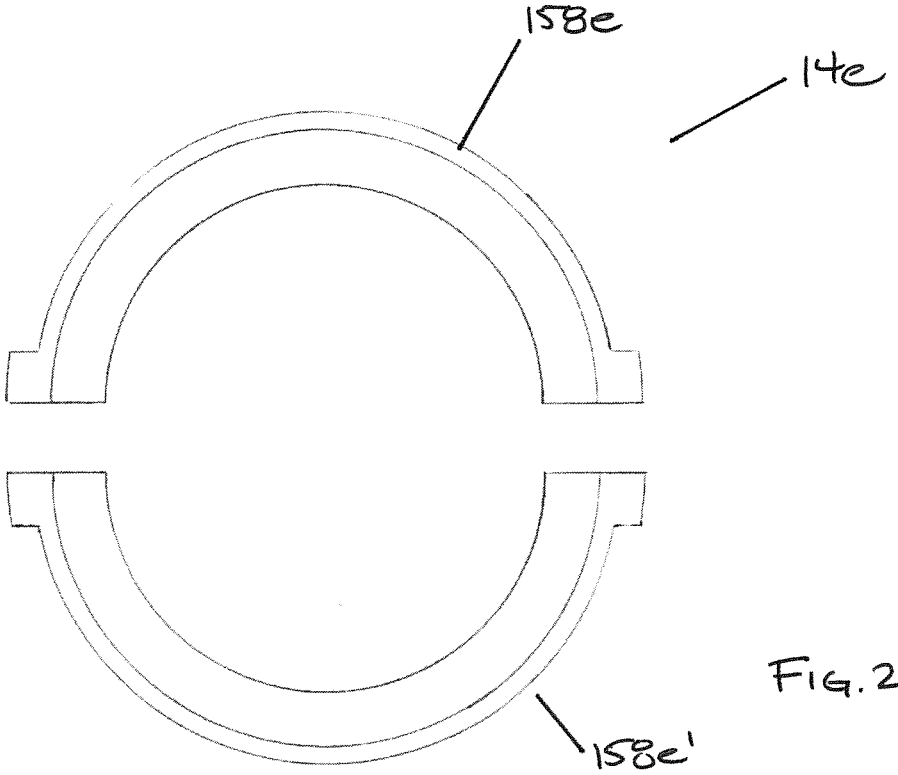
FIGS. 22*d* and 22*e* are exploded and assembled views, respectively, of the shell of FIG. 22*a;*
Figure 22D:
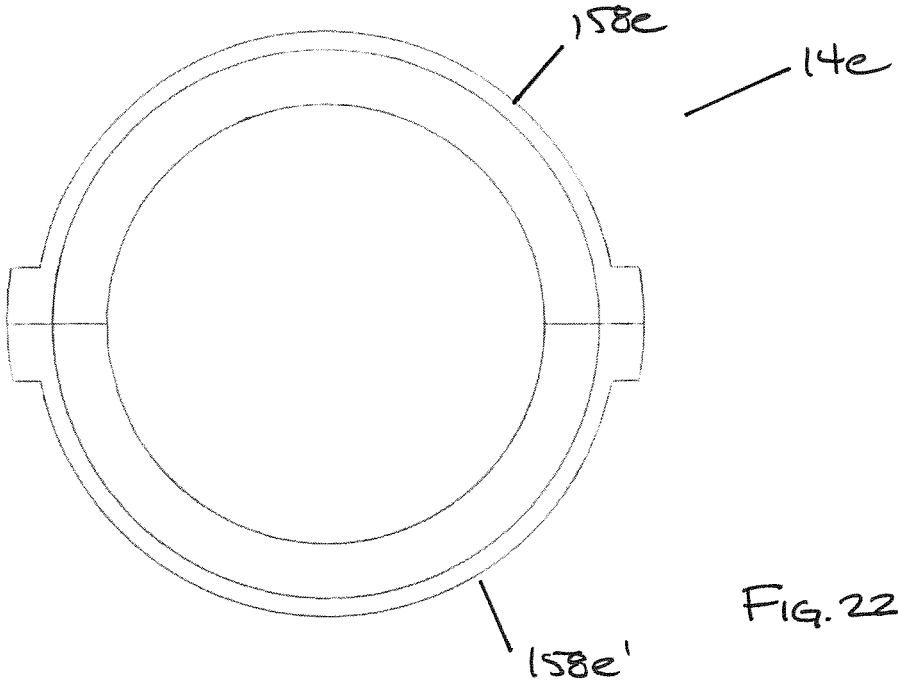
Figure 23:
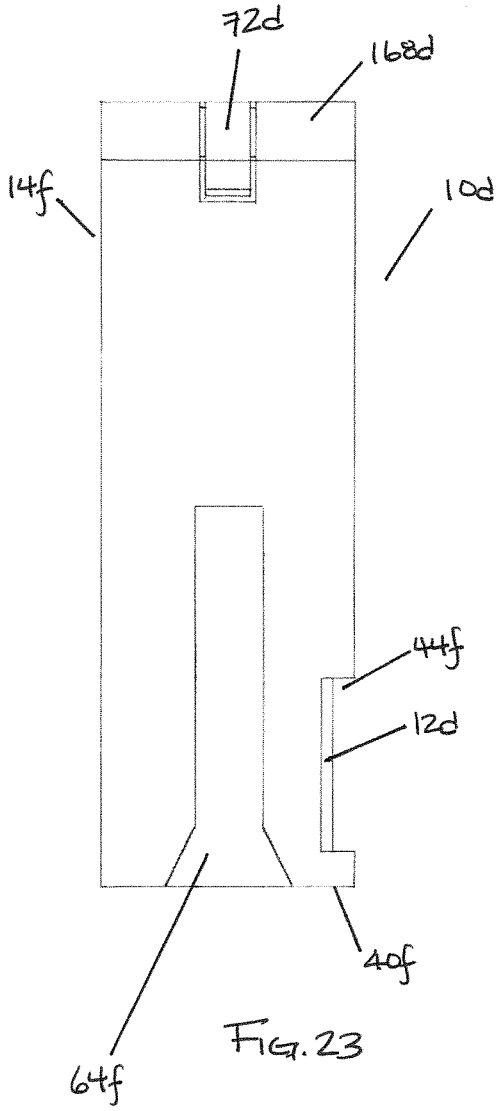
FIG. 23 is a side view of an assembled magazine, according to a fourth embodiment of the invention.
Figure 24A:
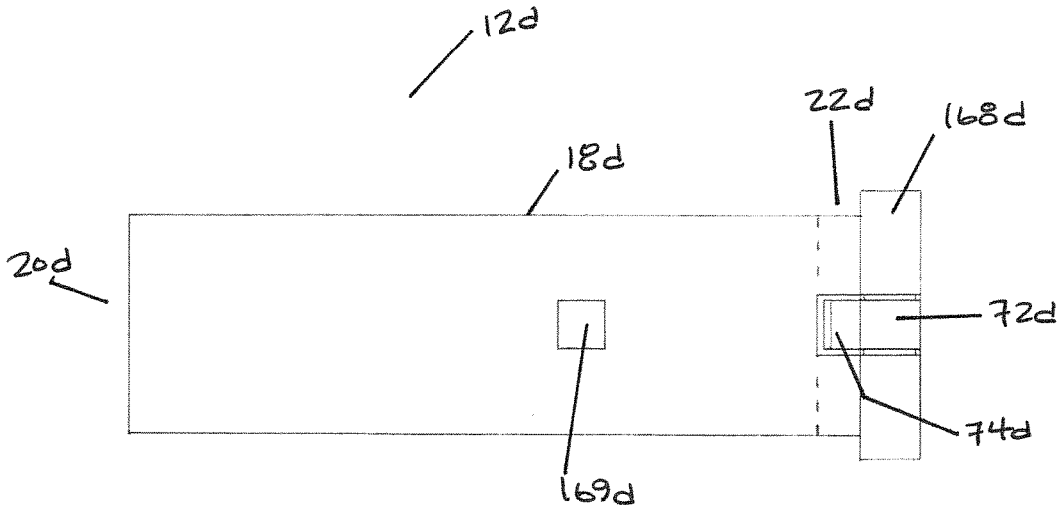
FIGS. 24*a*-24*d* are side, top, front and rear views, respectively, of a fourth embodiment of an inner tube of the invention.
Figure 24B:
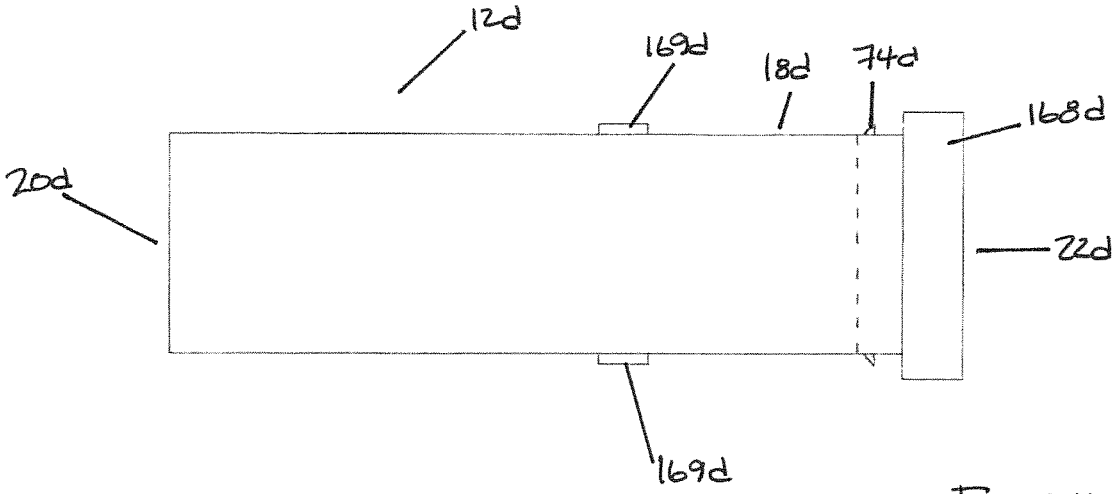
Figure 24C:
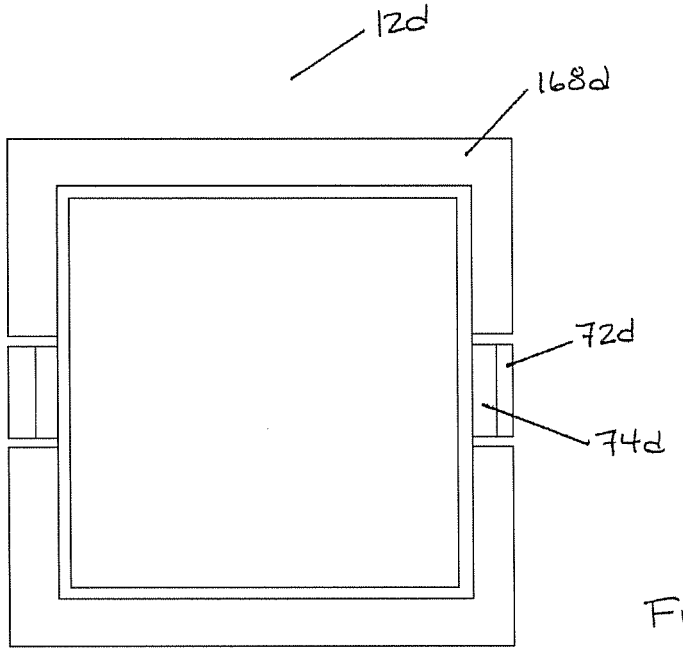
Figure 24D:
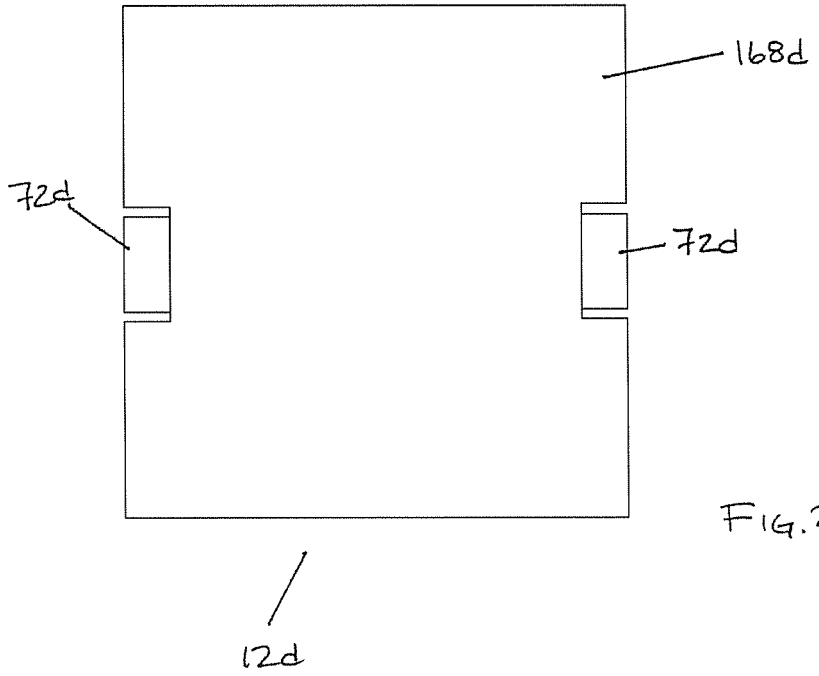
Figure 25A:
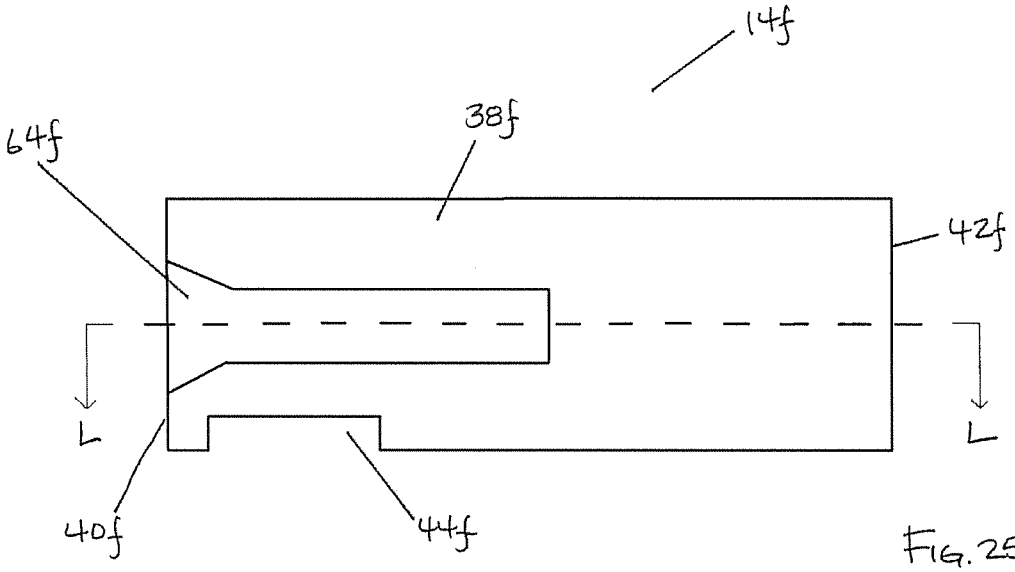
FIGS. 25*a*-25*c* are side, front and rear views, respectively, of a sixth embodiment of an outer shell of the invention.
Figure 25B:
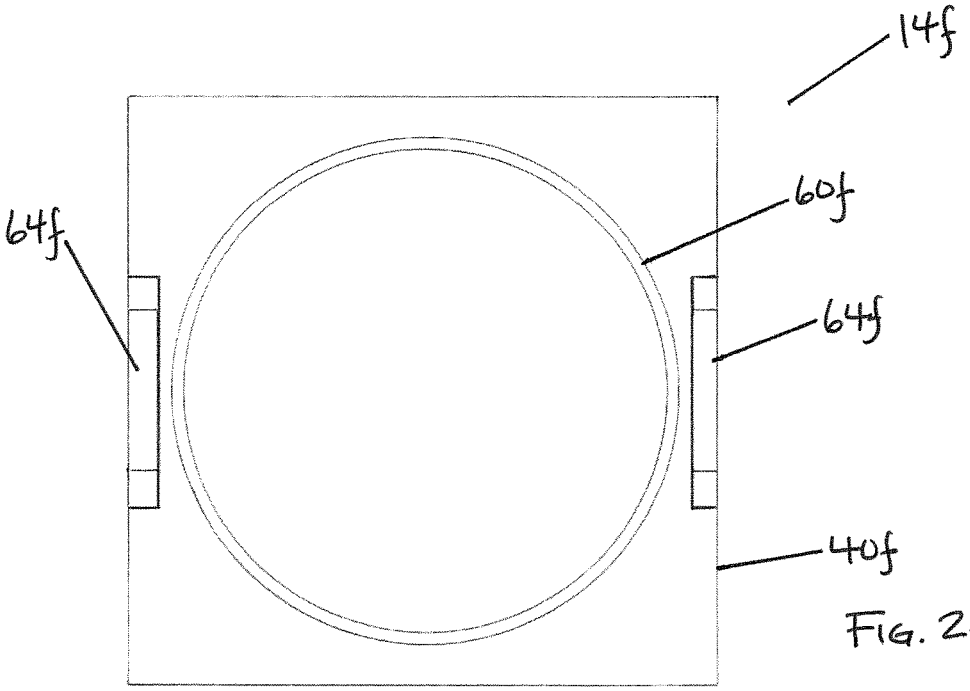
Figure 25C:
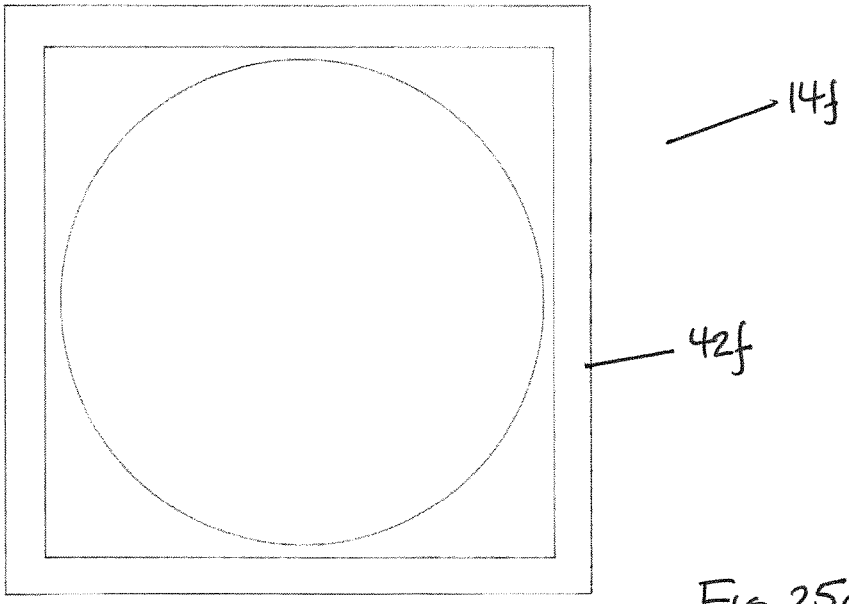
Figure 25D:
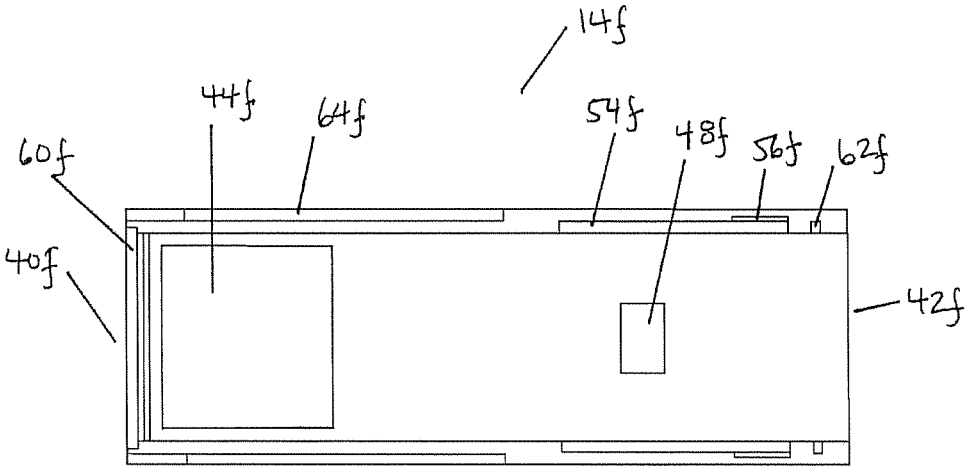
FIG. 25*d* is a cross-sectional view of the shell of FIG. 25*a*, taken along line L-L.

In the embodiment shown in FIGS. 19*a* and 19*b*, the magazine 10*c* is provided with a tube 12*c* having a protruding neck 144*c* for connection with another embodiment of gripper 28. Tube 12*c*, as shown in FIGS. 20*a*-20*d*, is provided with a neck 144*c*, which may be solid or may be hollow to decrease its weight, having threads 146*c* at one end, and one or more alignment blocks 148*c* elsewhere on the neck 144*c*. The tube 12*c* is also provided with one or more spaced pull guides 162*c* on its body 18*c*, which will interact with the outer shell. It will be understood that pull guides 162*c* may be of any suitable length or configuration (compare the pull guides 162*d* in FIGS. 24*a* and 24*b*), although a longer pull guide may offer more support to a fully-loaded magazine, FIGS. 21*a* and 21*b* shown a third embodiment of a gripper 28*c*, having flex locks 34*c* and flex lock releases 36*c*, along with a central aperture 150*c* and one or more spaced slots 152*c*, designed to accommodate alignment blocks on an inner tube. This ensures that the gripper 28*c* fits snugly and securely onto the end of the tube. Further securing the gripper 28*c* in place is a threaded closure cap 154*c*, best shown in FIGS. 21*c* and 21*d*, which comprises a threaded area 156*c* corresponding to threads on an inner tube.

In another embodiment, outer shell 14*e*, best shown in FIGS. 22*a*-22*e*, comprises a body 38*e* having two pieces 158*e*, 158*e*', which may or may not be halves, that fasten together by any suitably secure mechanism, such as clips, magnets or other fasteners, that provides suitable retention. It is also contemplated that the shell pieces 158*e*, 158*e*' may be held together in a configuration that provides physical engagement or frictional retention. One or more pull channels 54*e* accommodate pull guides on an inner tube, while the guide mechanism (protruding guide rails 46*e*, in this case) coordinates with the guide slots on a receiver. If the locations of the pull channels 54*e* and the guide rails 46*e* coincide, it may save space within the magazine. In this embodiment, the front end 40*e* of shell body 38*e* is provided with an aperture 164*e* in which a refill plug may be snugly fitted and retained by friction or other suitable fastening means. A ridge 166*e* may be provided to ensure that the refill plug cannot easily be pushed too far into the outer shell 14*e*. Retainer 160*e*, best shown in FIG. 22*b*, holds an inner tube in an armed position by suitable means such as friction or magnetization; this may not be necessary in embodiments where the fit between the inner tube and outer shell is close enough to prevent unforced movement.

A magazine may be provided with any suitable cross-section besides circular, such as the square magazine 10*d* in the embodiment shown in FIGS. 23-25*d*. This shape may be useful in terms of ensuring that the magazine is properly inserted into the receiver. This embodiment also illustrates an arrangement wherein the arming mechanism at the rear end of the inner tube 12*d* is provided as a single piece, in the form of grip end 168*d* at the rear end 22*d* of the tube body 18*d*, which may be held in place and manipulated by any suitable means such as tabs 72*d* and hooks 74*d*. In the outer shell 14*f* corresponding to this embodiment, an aperture 164*f* may be provided, into which a refill plug or refill cap may be smugly fitted and retained by friction or other suitable fastening means. One or more pull guides 169*d* may be provided to interact with guide slots 64*f*. This embodiment also illustrates that, like guide rails, guide slots 64*f* may change over the length of the outer shell 14*f*; in the exemplary embodiment shown, the guide slots 64*f* flare towards the front end 40*f* of outer shell 14*f*, which may assist a user during insertion of the magazine into a receiver.

Figure 26:
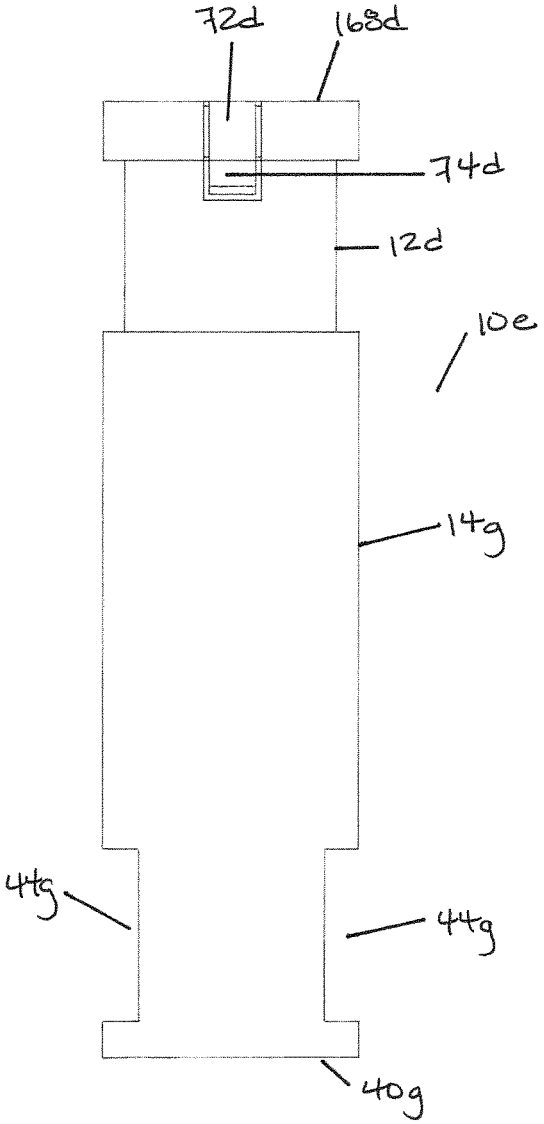
FIG. 26 is a side view of an assembled magazine, according to a fifth embodiment of the invention.
Figure 27A:
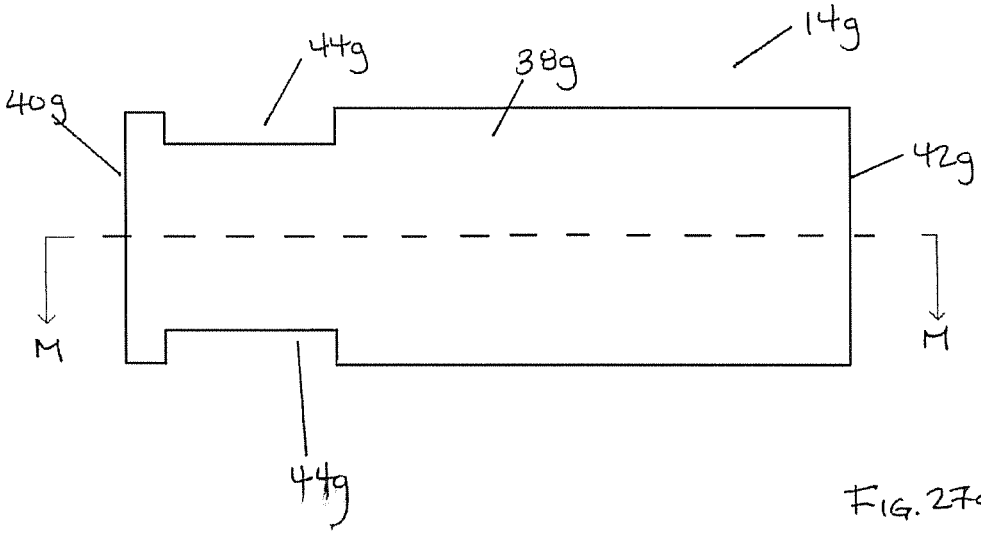
FIGS. 27*a*-27*c* are side, front and rear views, respectively, of a seventh embodiment of an outer shell of the invention.
Figure 27D:
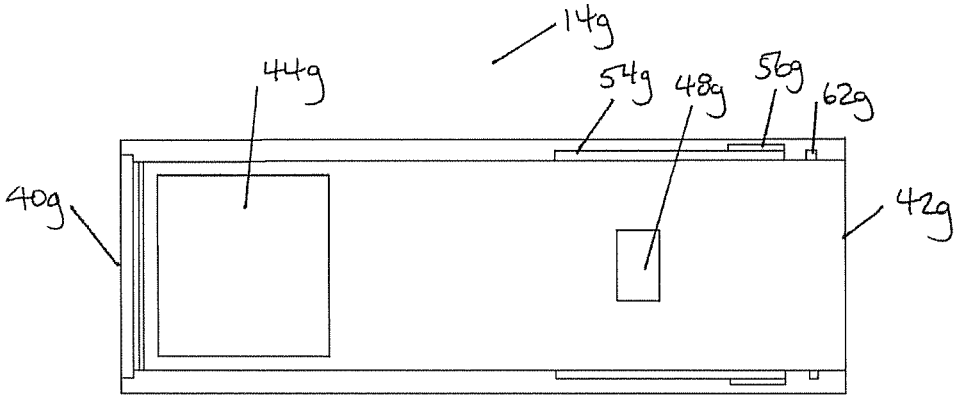
FIG. 27*d* is a cross-sectional view of the shell of FIG. 27*a*, taken along line M-M.
Figure 27B:
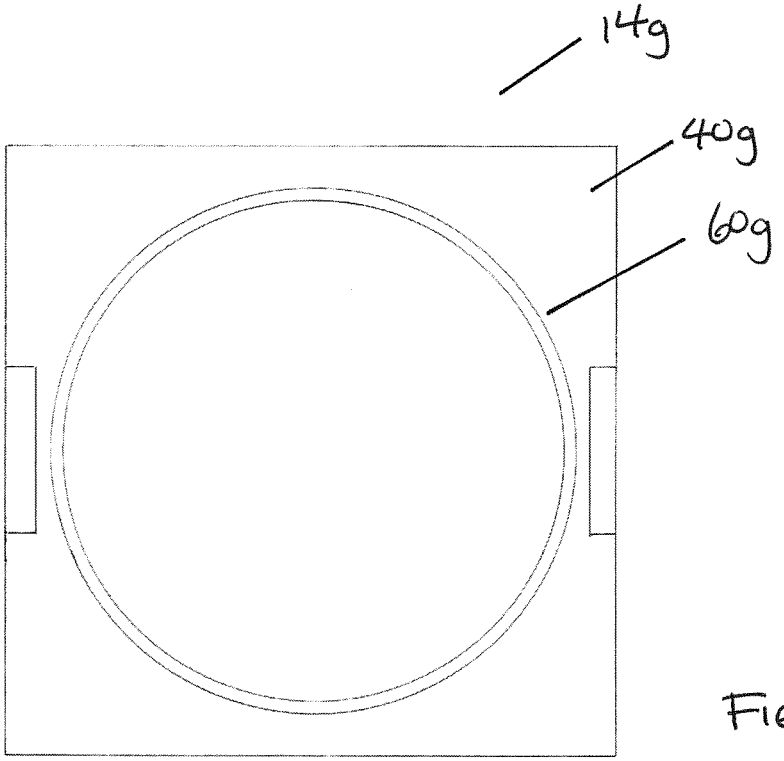
Figure 27C:
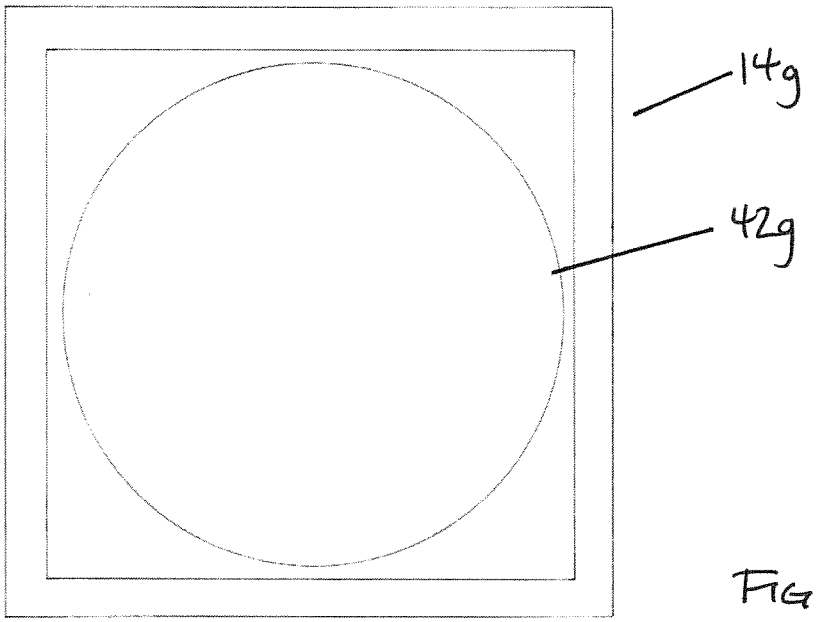
Figure 28A:
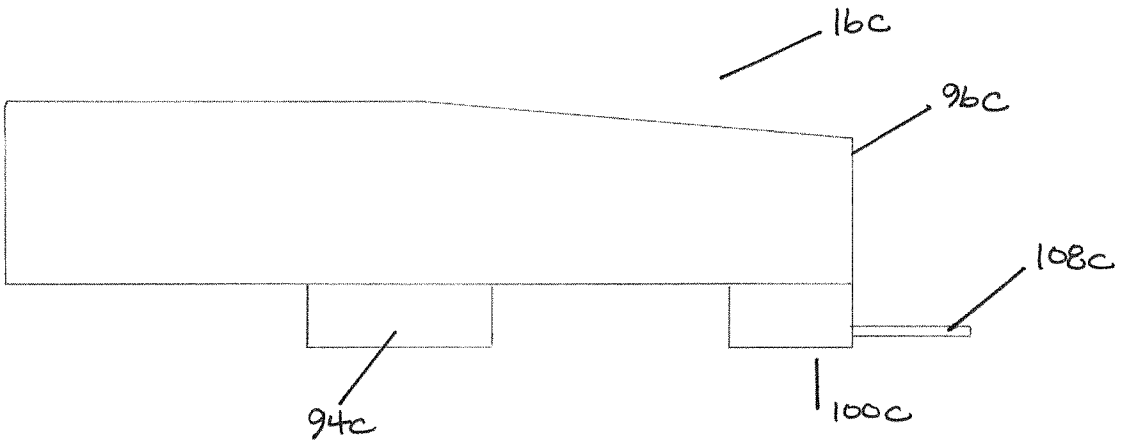
FIGS. 28*a*-28*c* are side, front and top views, respectively, of a third embodiment of a receiver according to the invention.

In the embodiment of the magazine shown in FIGS. 26-27*d*, the magazine 10*e* may be provided without a guide mechanism to assist with proper alignment of the magazine with the receiver. This may be simplest to achieve with a non-circular magazine shape, as shown, without compromising the ability for a user to successfully insert a magazine. However, it will be understood that a guideless embodiment may be provided with any magazine cross-section, as long as the user is reasonably assured of properly inserting the magazine into the receiver.

In the embodiment of the receiver 16*c* shown in FIGS. 28*a*-28*d*, the parts are similar to those shown in earlier embodiments, although this embodiment includes a square cross-section, and provides guide rails 170*c* instead of guide slots. It will be understood that this embodiment may be provided with guide slots, as may be dictated by the configuration of the particular magazine being used with the receiver 16*c*.

Figure 29A:
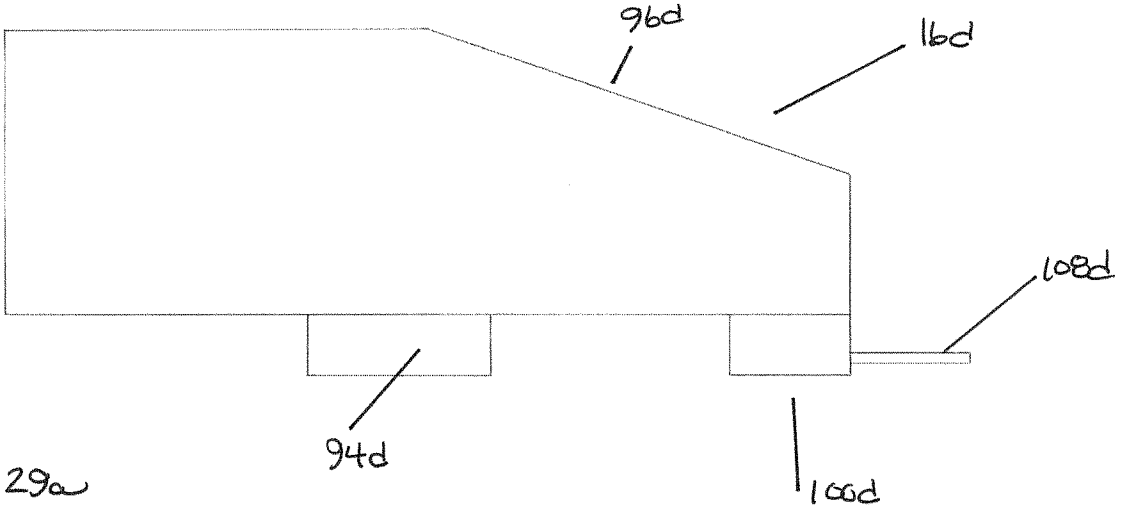
FIGS. 29*a* and 29*b* are side and front views, respectively, of a fourth embodiment of a receiver according to the invention.
Figure 29B:
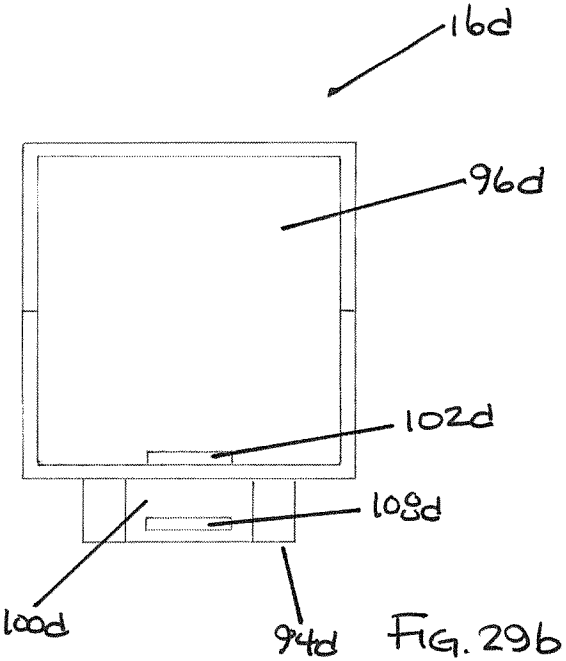
Figure 28B:
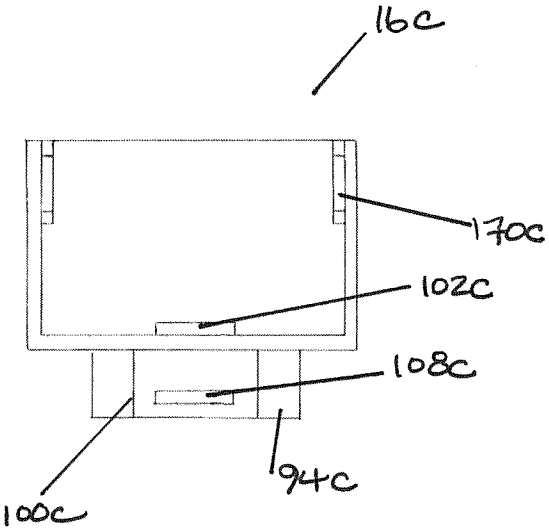
Figure 28C:
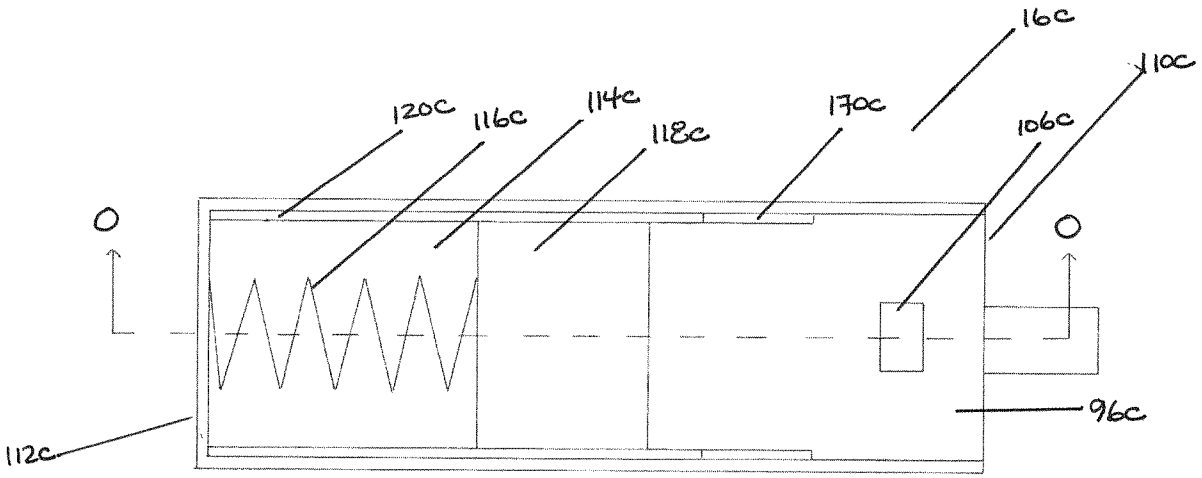
Figure 28D:
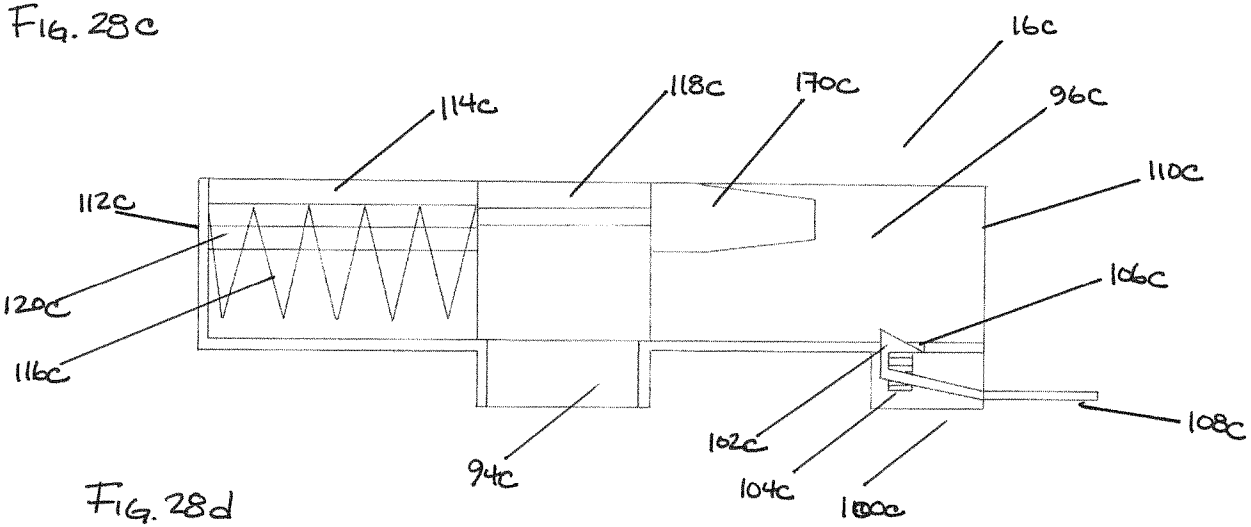
FIG. 28*d* is a sectional view of the receiver of FIG. 28*c*, taken along line O-O.

The receiver 16*d* shown in FIGS. 29*a* and 29*b* illustrates an embodiment in which the receiver lacks a guide rail or guide slots, as might be used with the guideless magazine embodiment of FIGS. 26-27*d* including outer shell embodiment 14*g*. However, this receiver may also be used with a magazine having guide slots, or even guide rails where the overall magazine cross-section can still be accommodated within the receiver 16*d*.

The magazine 10*f* embodiment shown in FIGS. 30-36*b* comprises many of the same features as the earlier embodiments. However, one or both of the inner tube 12*e* and outer shell 14*h* may be provide with one more openings 172*e*, 172*f*, 172*h*, and/or thinned areas 174*h*, which may be employed in a manner sufficient to reduce the overall weight of the magazine 10*f* without affecting its overall strength and stability. In an embodiment in which the outer shell has only a single aperture, the inner tube 12*f* may be cut back entirely, as shown in FIGS. 32*a* and 32*b*, further reducing the overall weight of the magazine 10*f*, without sacrificing strength and stability.

A gripper 28*d* may be provided having a configuration as shown in FIGS. 33*a*-33*d*. The gripper has parts similar to those shown in earlier embodiments, but may also include one or more notches 176*d*, which may provide a more certain grip for a user. The gripper 28*d* may also be provided with one or more stop tabs 178*d*, which engage with slots 190*h* (best shown in FIGS. 35*a* and 36*a*) in the outer shell, to prevent excess rotation during the arming motion. One or more lock tabs 184*d*, which may be actuated by triggers 186*d* or simply rotated by force, serve the same purpose as opposed resilient tabs 72*a* and extending hooks 74*a* in the previous embodiments (see e.g. FIGS. 10-10*g*), to engage with lock tab slots 192*h* (best shown in FIGS. 35*a* and 36*a*) in the outer shell. The gripper may also be lightened, to reduce the overall weight of the magazine, by providing one or more weight-reducing openings 188*d*. Finally, while other embodiments have included mating blocks to fit into apertures in an inner tube, this embodiment shows that the gripper 28*d* may instead be provided with one or more mating slots 180*d*, which will engage with mating block(s) 182*e* (best shown in FIGS. 31*a* and 31*c*) on inner tube 12*e*, to be fastened into place with an appropriate fastener.

Figure 30:
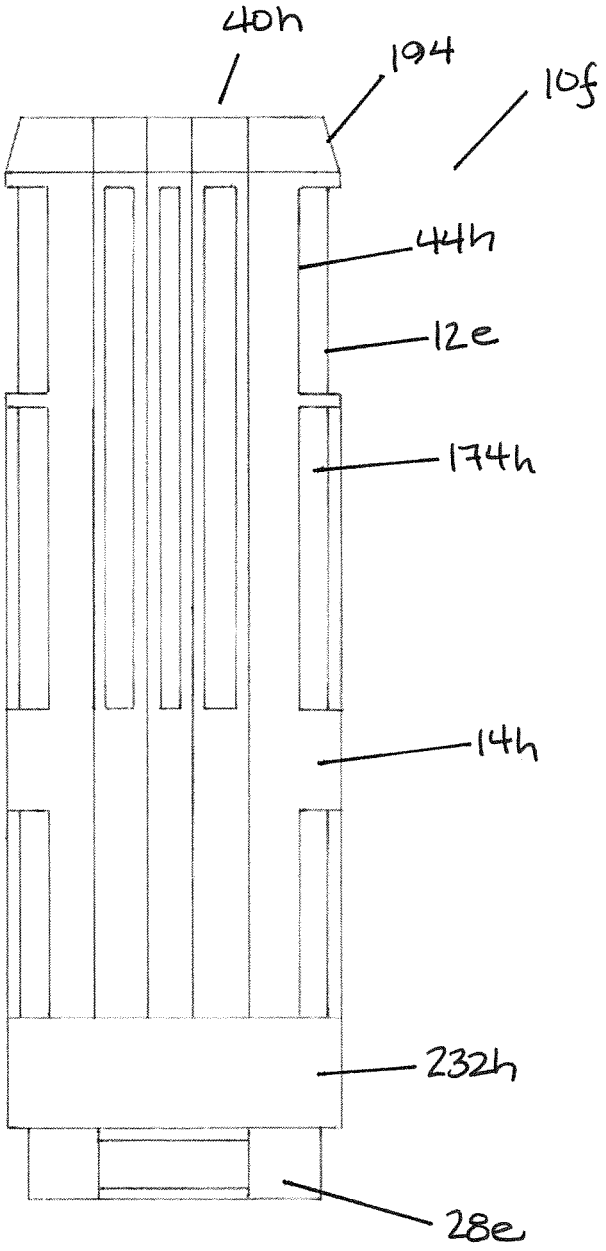
FIG. 30 is a side view of an assembled magazine, according to a sixth embodiment of the invention.
Figure 31A:
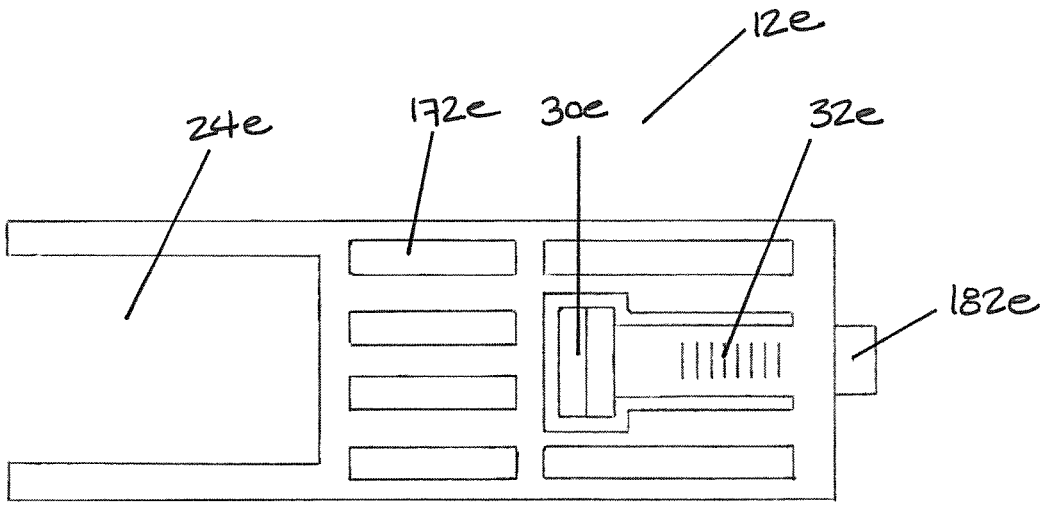
FIGS. 31*a*-31*d* are side, top, front and rear views, respectively, of a fifth embodiment of an inner tube of the invention.
Figure 31B:
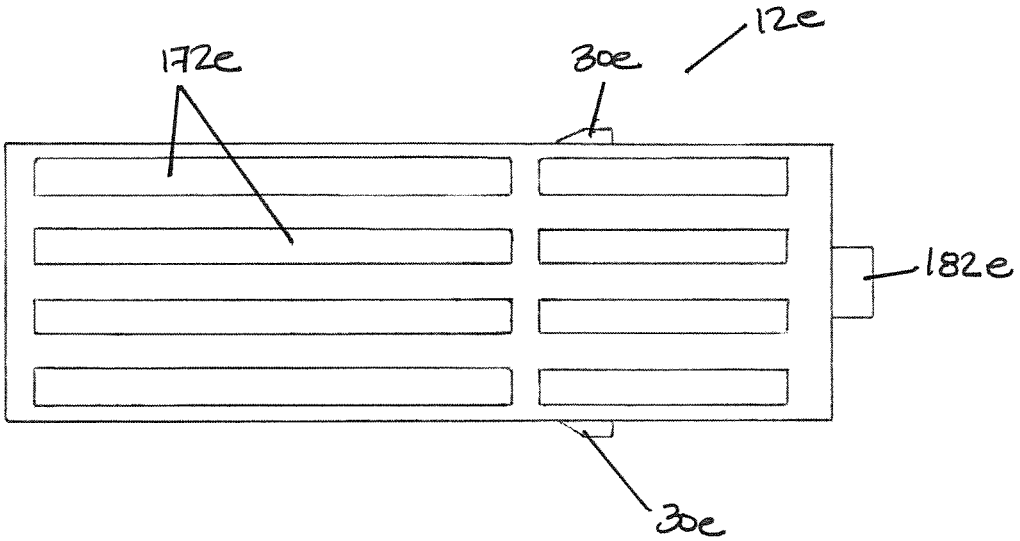
Figure 31C:
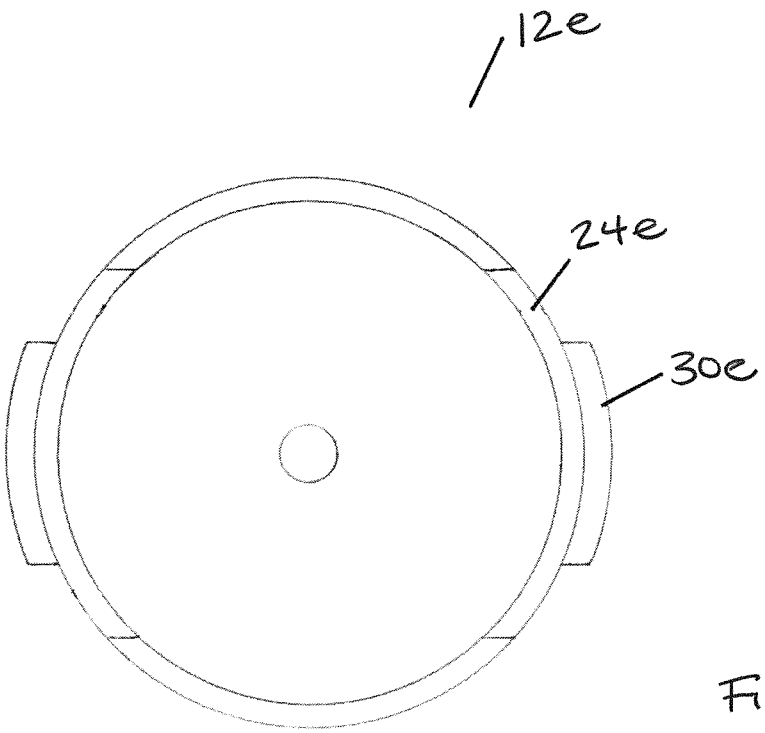
Figure 31D:
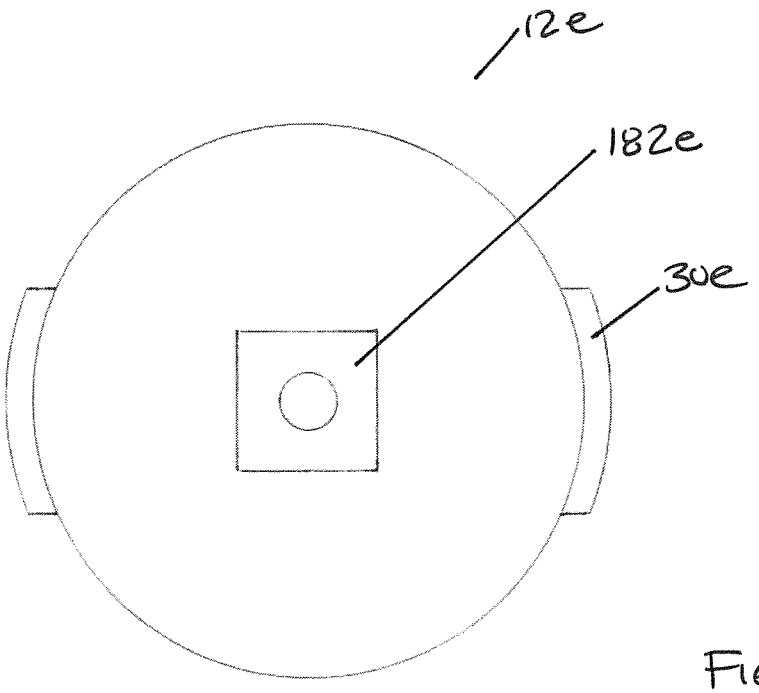
Figure 32A:
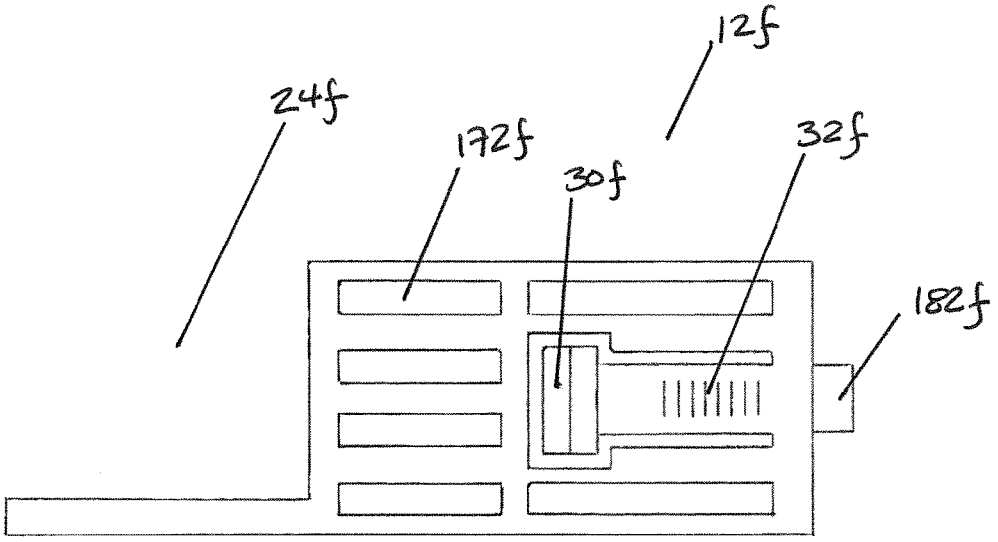
FIGS. 32*a* and 32*b* are side and top views, respectively, of a sixth embodiment of an inner tube of the invention.
Figure 32B:
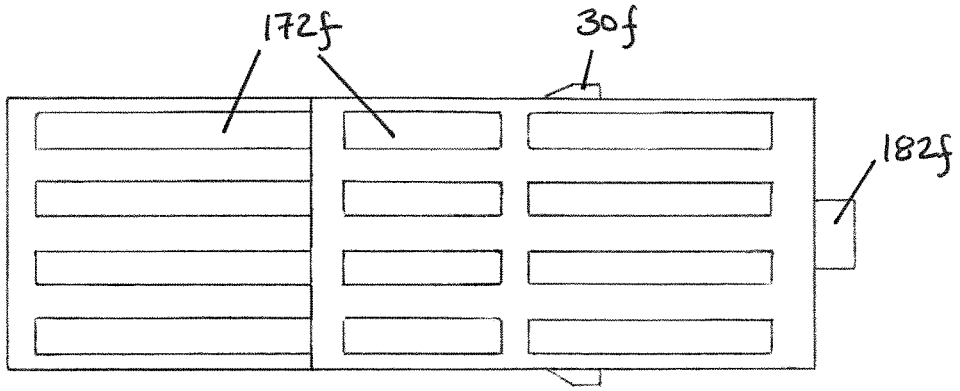
Figure 33A:
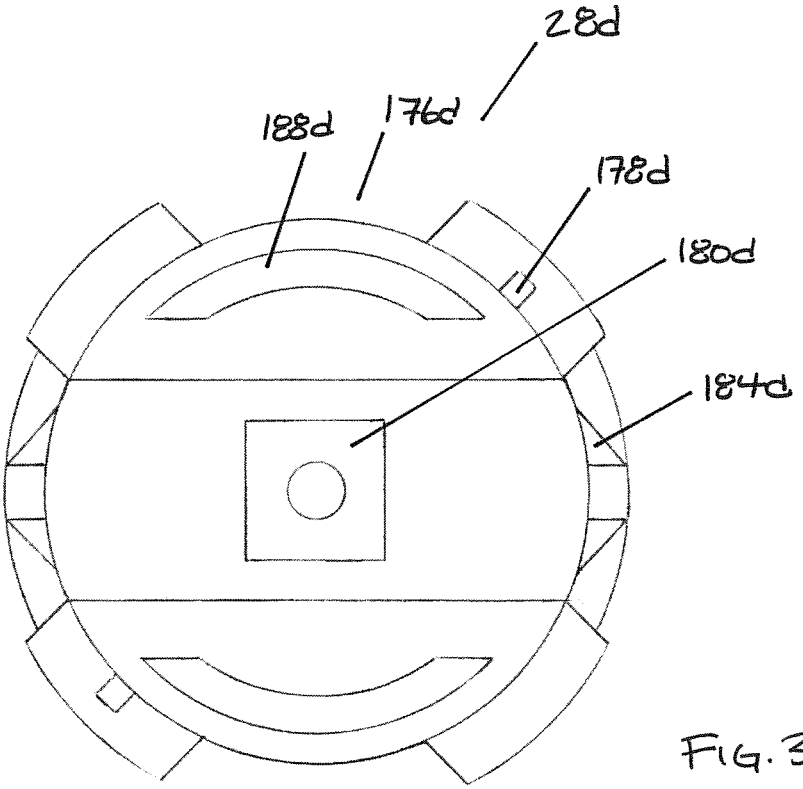
FIGS. 33*a* and 33*b* are views of two sides of a fourth embodiment of a gripper ring according to the invention.
Figure 33B:
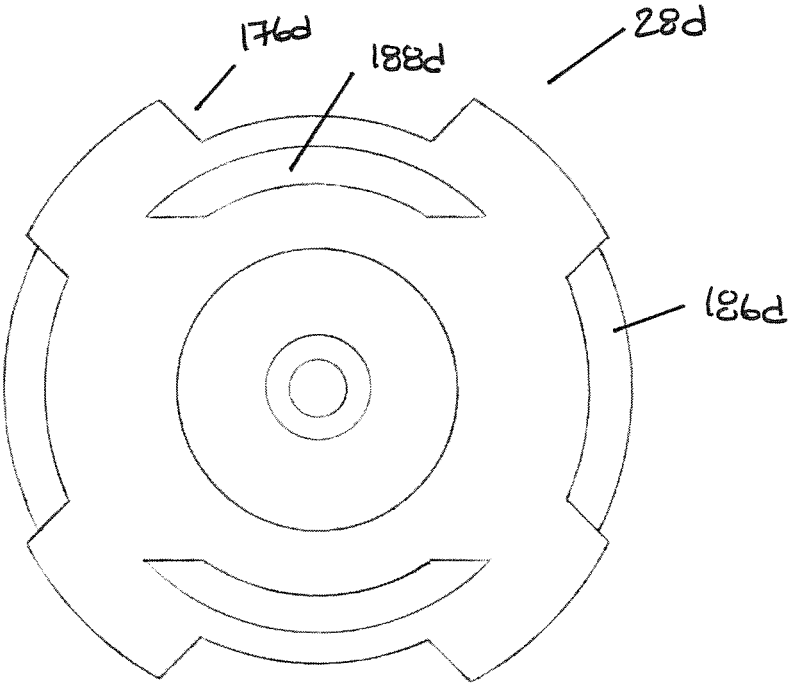
Figure 33C:
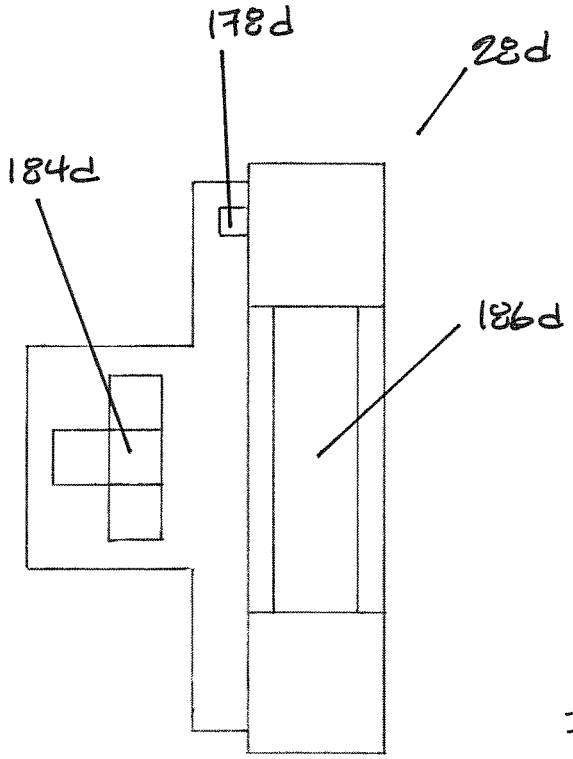
FIG. 33*c* is a side view of the gripper ring of FIG. 33*a;*
Figure 33D:
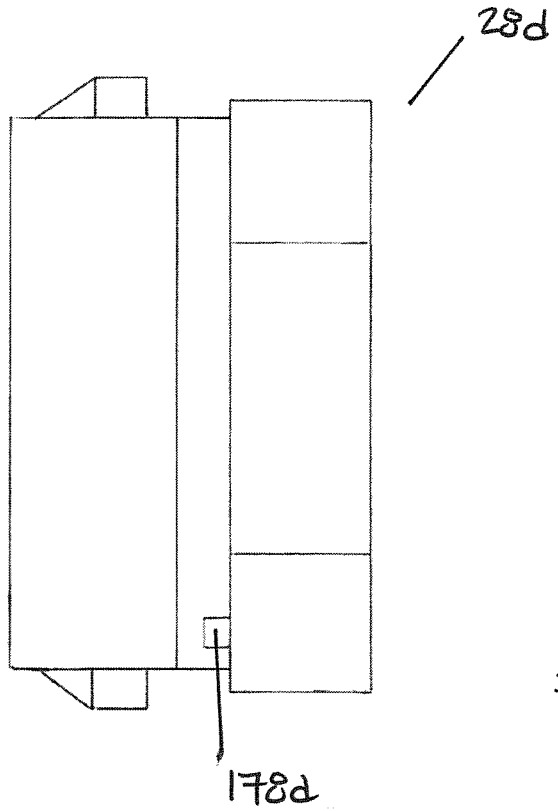
FIG. 33*d* is a second side view of the gripper ring of FIG. 33*a;*
Figure 34A:
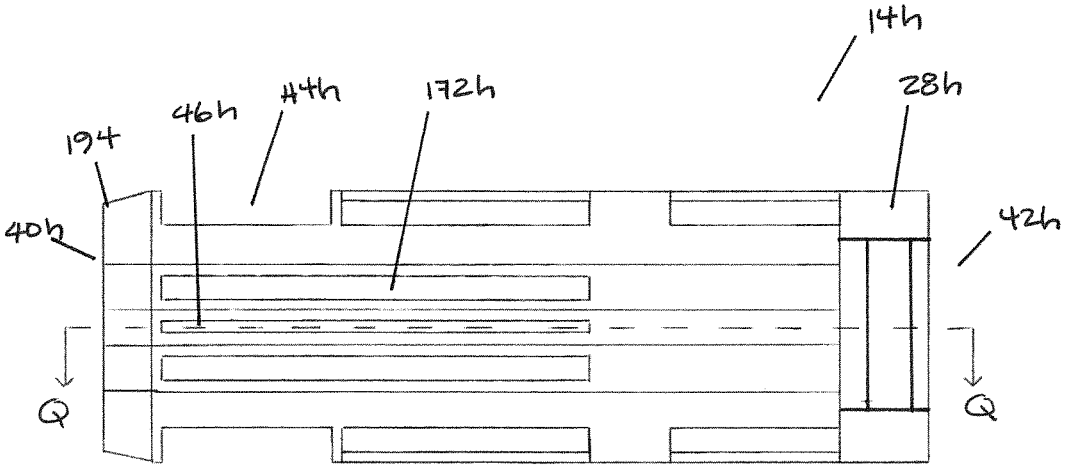
FIGS. 34*a*-34*d* are side, top, front and rear views, respectively, of an eighth embodiment of an outer shell of the invention.
Figure 34B:
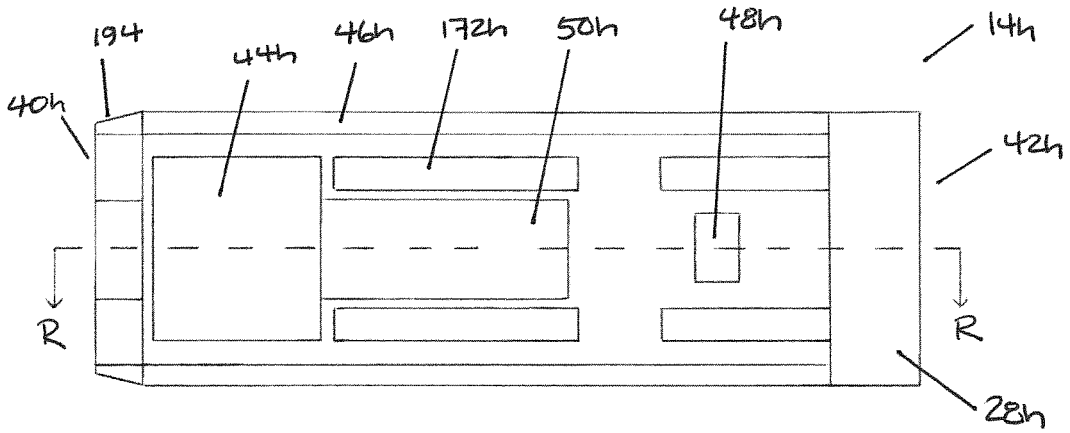
Figure 34C:
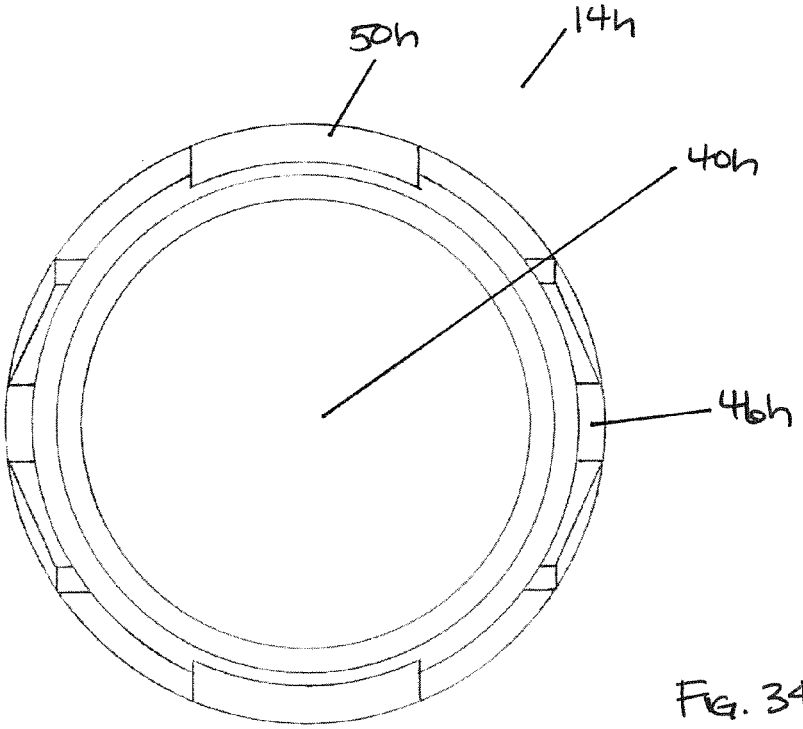
Figure 34D:
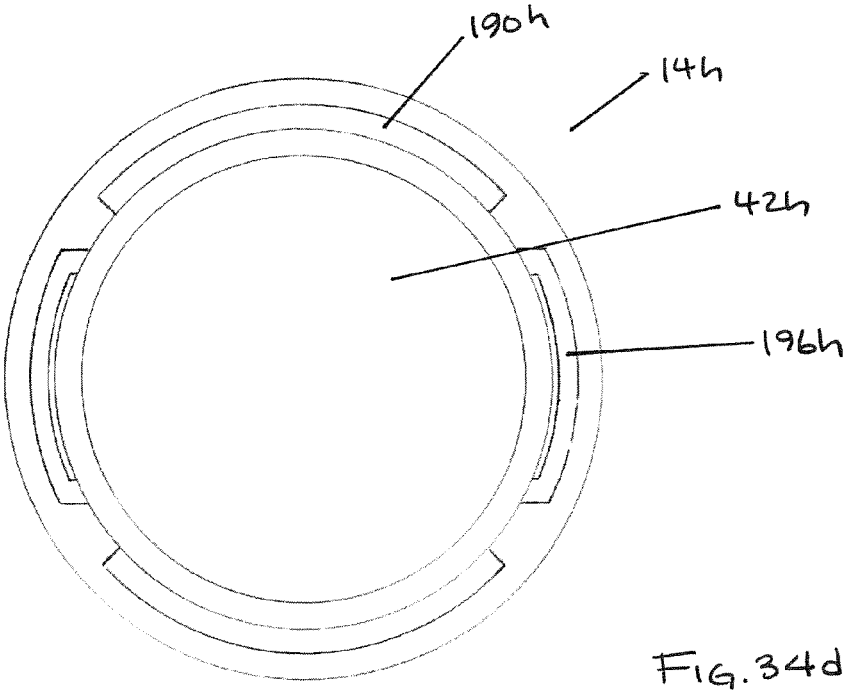
Figure 35A:
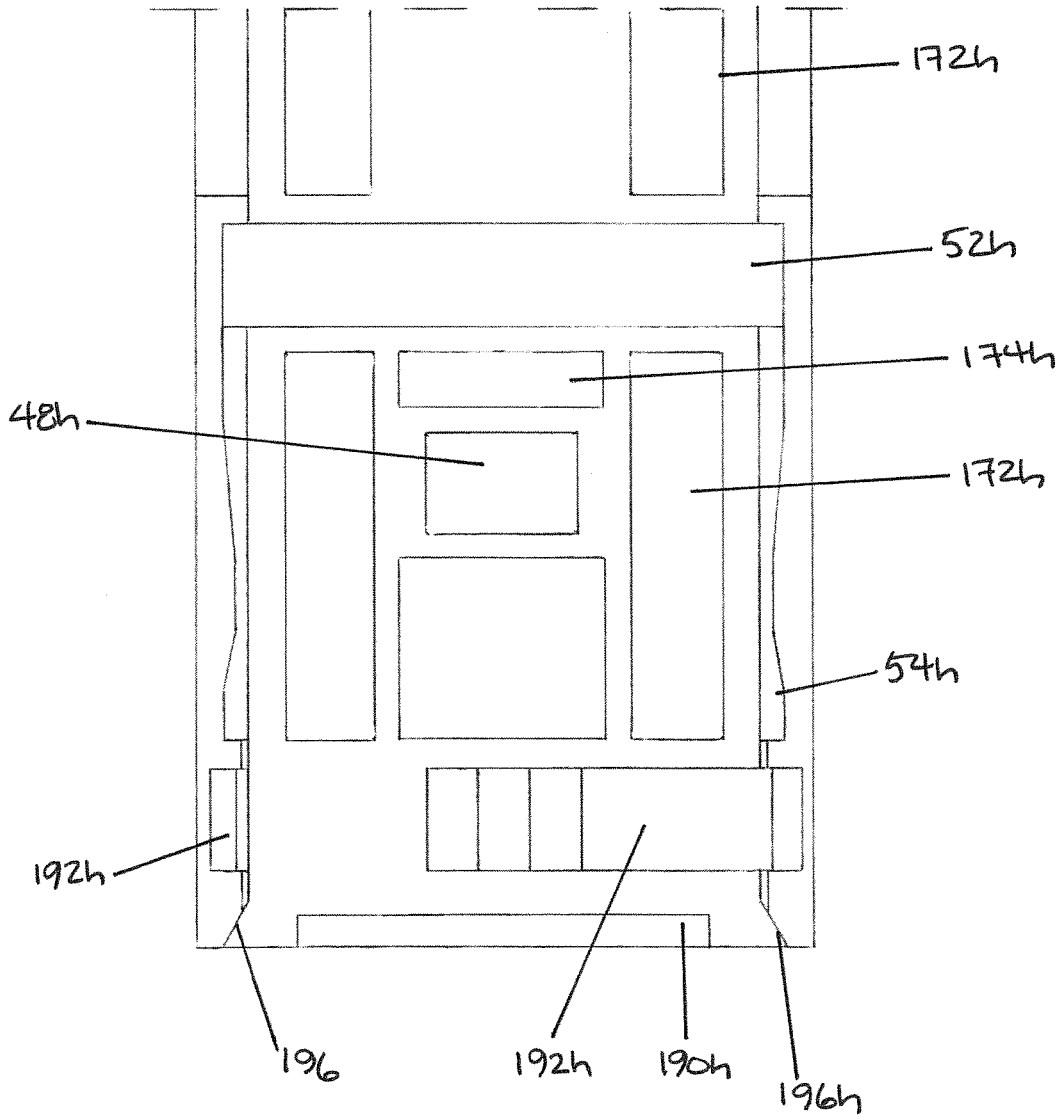
FIGS. 35*a* and 35*b* are enlarged sectional views of the rear and front ends, respectively, of the outer shell of FIG. 34*a*, taken along line Q-Q.
Figure 35B:
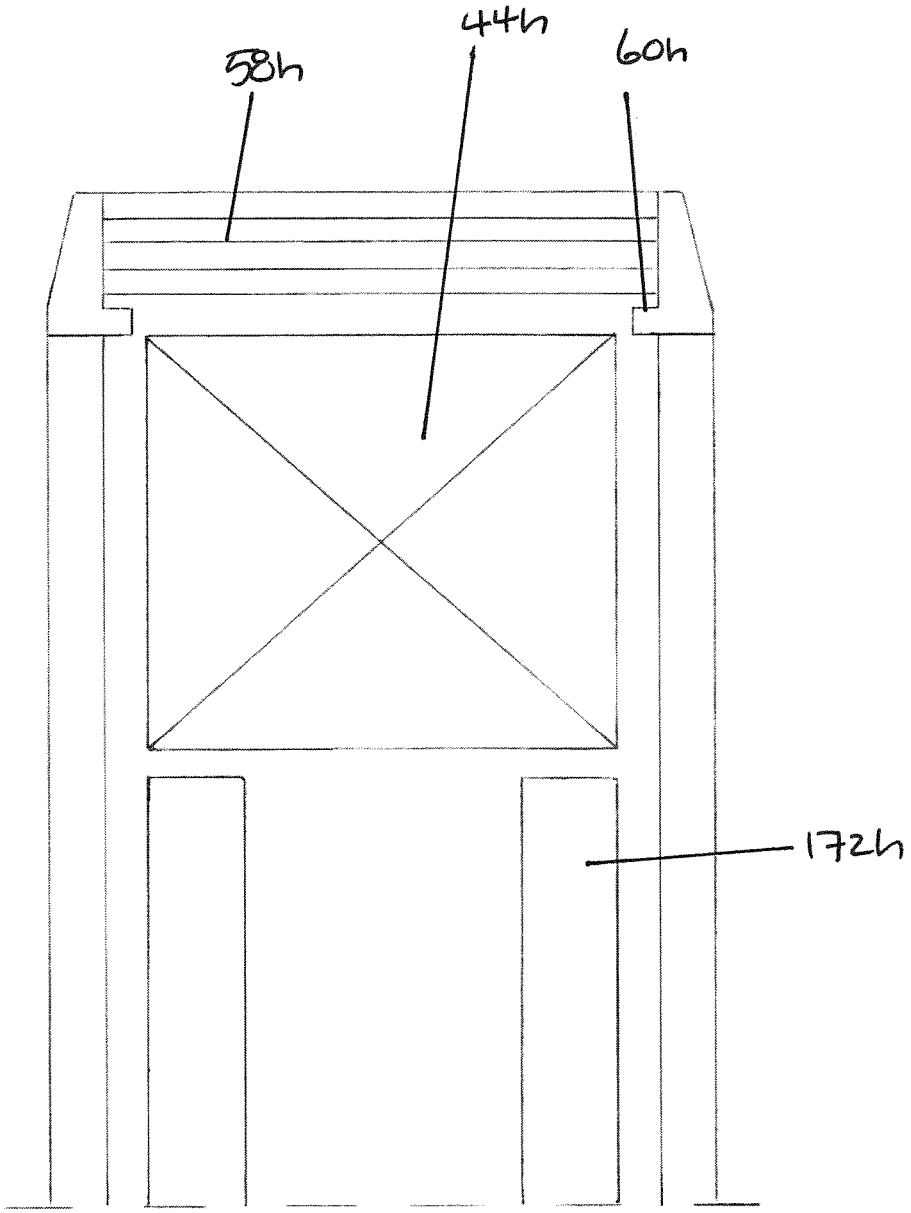
Figure 36A:
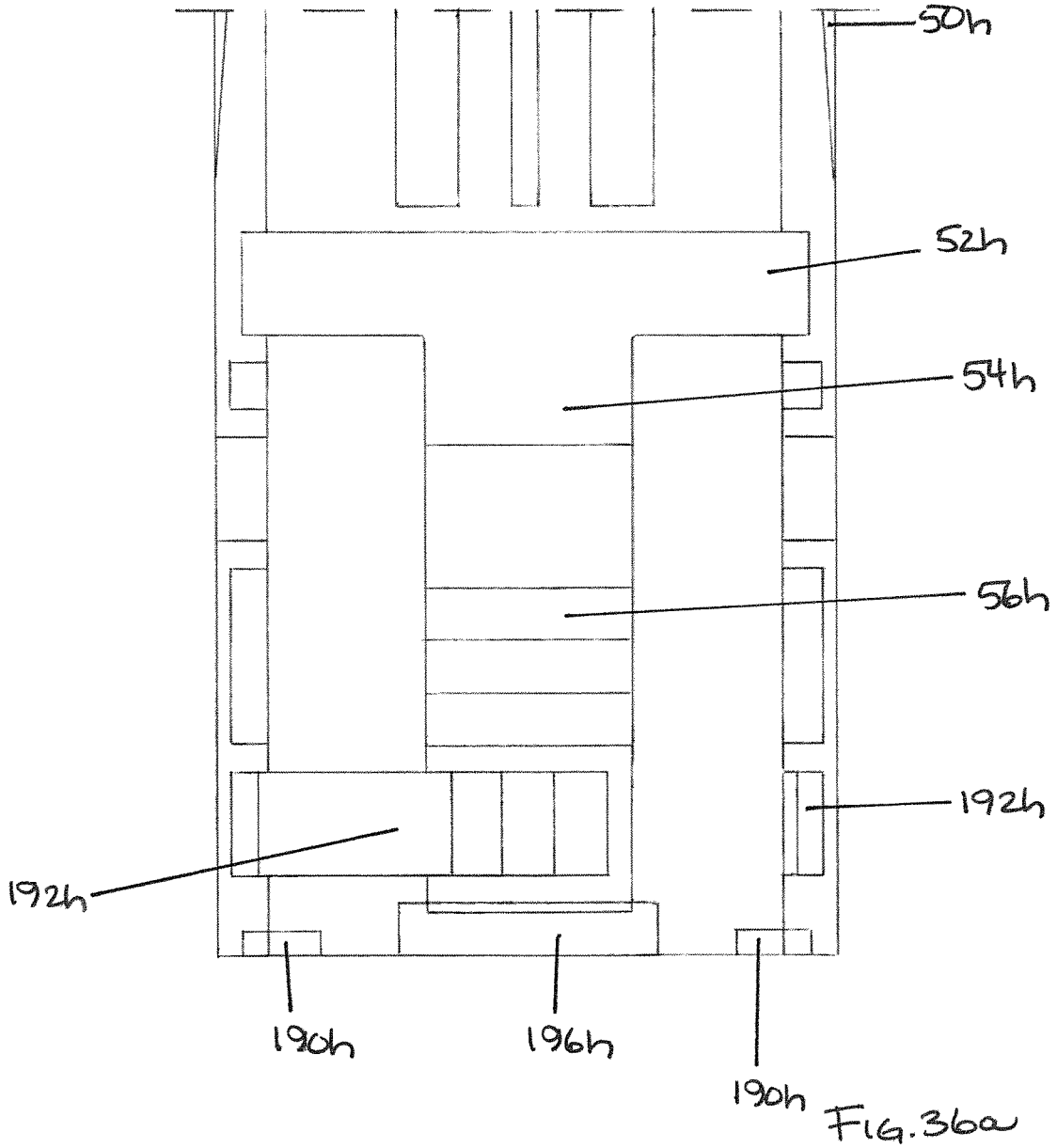
FIGS. 36*a* and 36*b* are enlarged sectional views of the rear and front ends, respectively, of the outer shell of FIG. 34*b*, taken along line R-R.
Figure 36B:
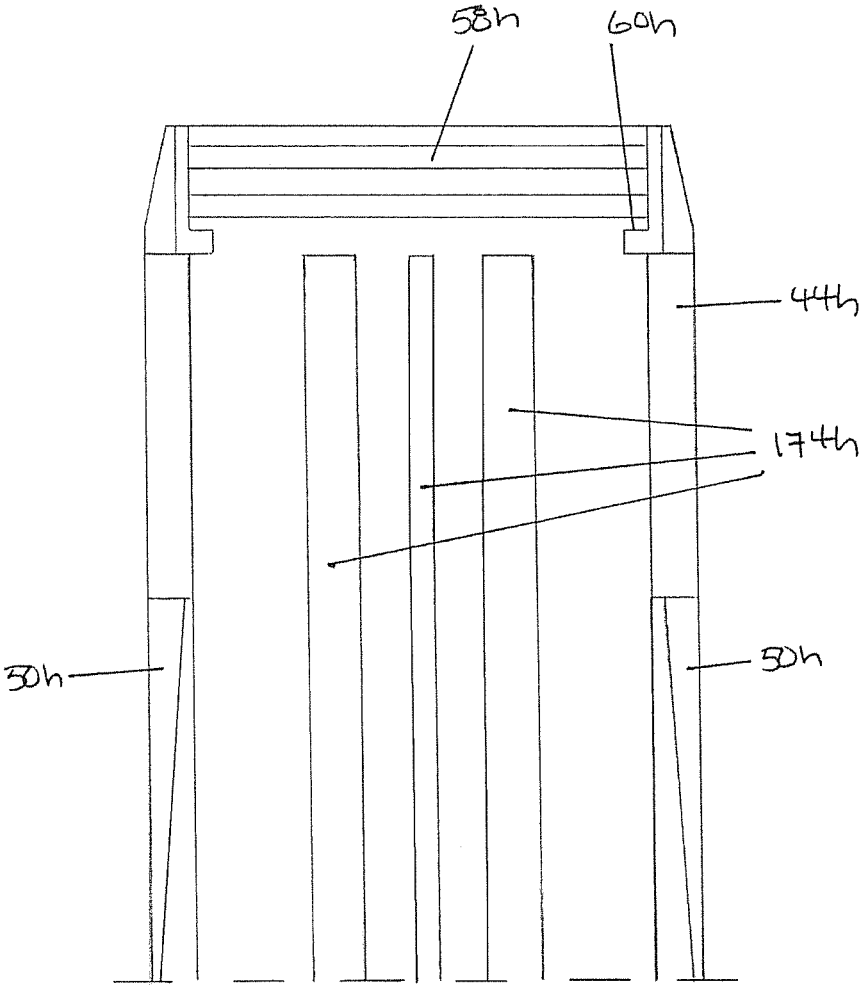

The front end of the outer shell may also be provided with an angled or rounded shape 194, as best shown in FIG. 30, in order to provide a smoother insertion into a player's vest, and/or into the receiver. As best shown in FIG. 35*a*, the rear end 42*h* of the outer shell may also be provided with an angled surface 196*h* to guide the inner tube into the outer shell.

In the embodiment of a magazine 10*g* shown in FIGS. 38-46, inner tube 12*g* may be provided with one (FIGS. 40*a* and 40*b*) or more (FIGS. 39*a*-39*d*) opposed legs 202*g*, 202*g*' which essentially merely connect the front end 20*g* to the rear end 22*g* and accommodate guide tabs 30*g*. Again, this serves to lighten the overall magazine, as well as ensuring that the arming mechanisms have room to operate freely.

This embodiment also illustrates another type of gripper, which uses a slip lock grip arming mechanism 204 that operates in a manner similar to a medicine bottle cap, in that it must be pressed down then turned, in order to open. Slip ring 206 having central opening 66*e*, is provided with one or more opposed compression plates 208, each having an opening 210 to accommodate a pin 212 around which a spring 214 is placed. The core 216 of the slip lock mechanism 204 accommodates the pins 212 and springs 214 on pin plates 224 on one side, such that the pins extend through pin openings 226 on the opposed side of the core 216. The core 216 further comprises one or more additional openings 218 to accommodate fasteners (not shown) and may include one or more openings 188*e* to reduce the overall weight of the assembly. The fasteners connect a back plate 220, via corresponding openings 222. Back plate 220 may also comprise extensions 226 which serve to support the core 216 underneath the pin plates 224. When the core 216 is assembled, core 216 fits within slip ring 206 such that pins 212 fit through pin openings 210 and springs 214 rest against compression plates 208. Back plate 220 is added, and the assembly is fastened to inner tube 12. The assembled inner tube and slip lock grip mechanism 204 is then pressed into the rear of the outer shell until channel 228 in slip ring 206 engages with stopper channel 230*i* which extends below cuff 232*i*. When pressure is released, springs 214 extend, locking the mechanism into place, unless the mechanism is pressed to relieve the spring pressure and then rotated to disengage from stopper channel 230*i*.

Figure 44A:
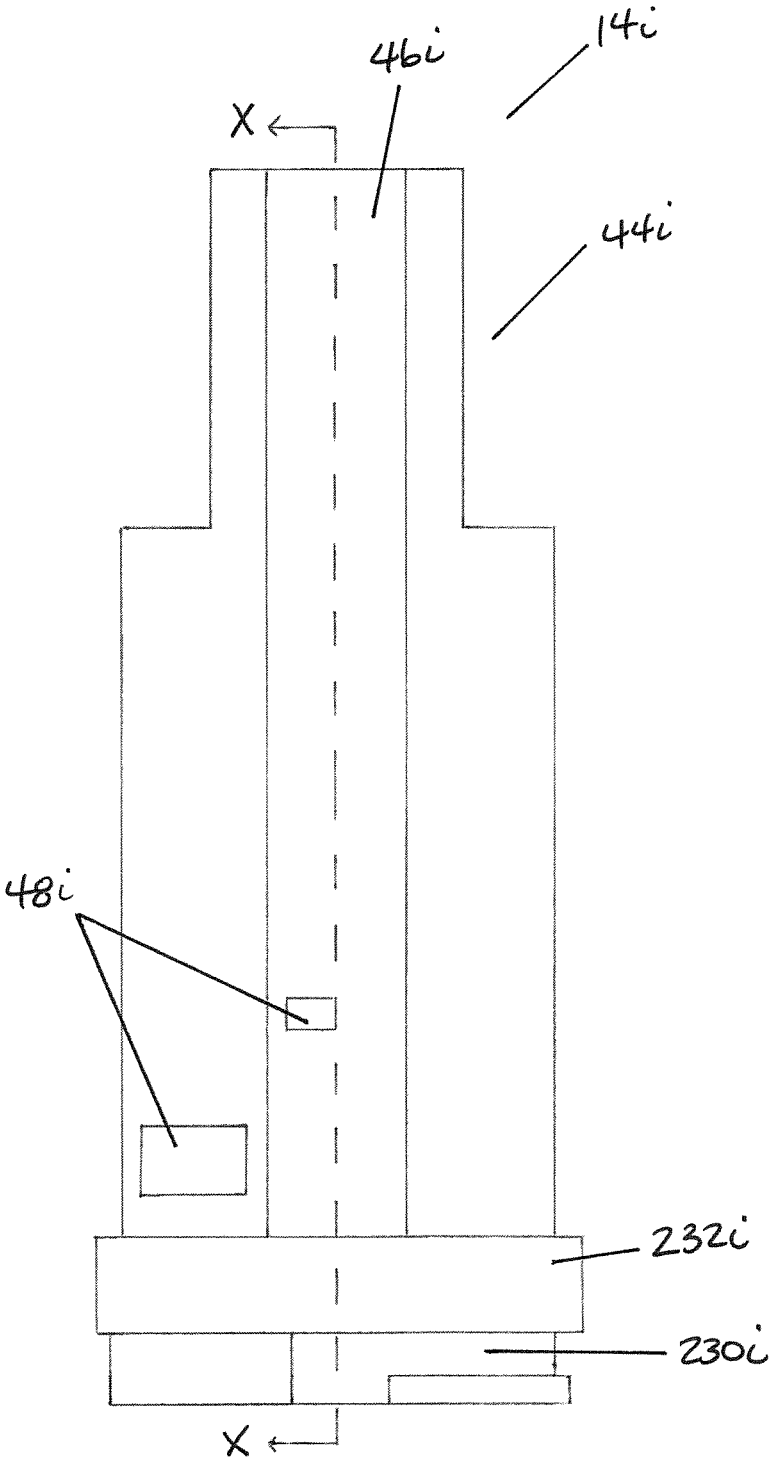
FIGS. 44*a*-44*d* are side, top, front and rear views, respectively, of a ninth embodiment of an outer shell of the invention.
Figure 44B:
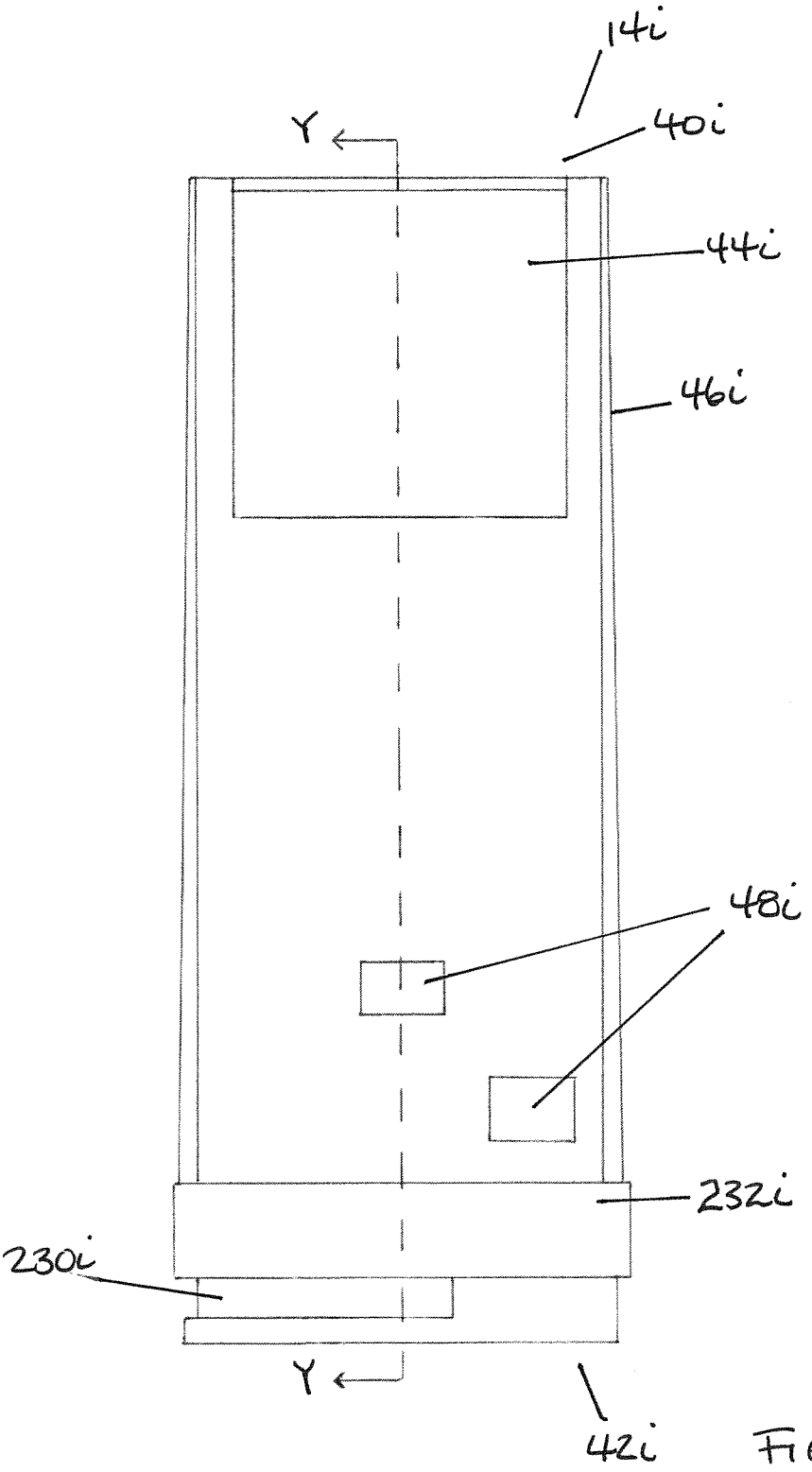
Figure 44C:
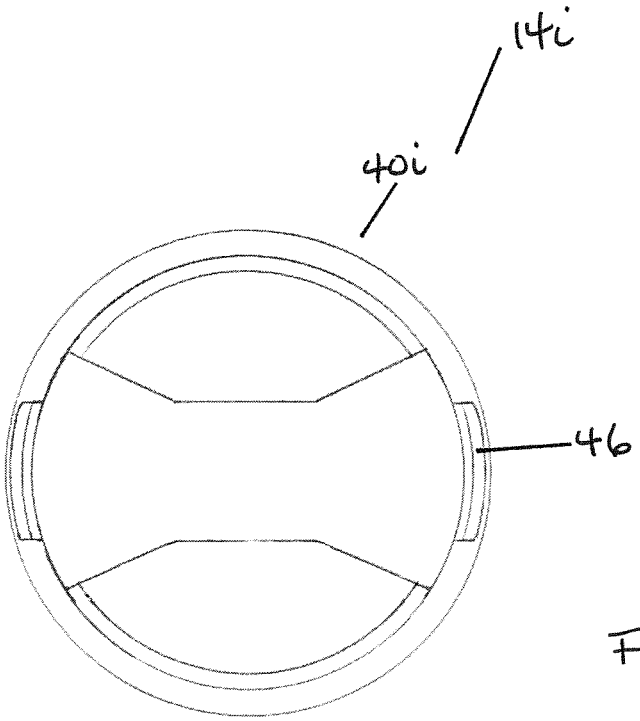
Figure 44D:
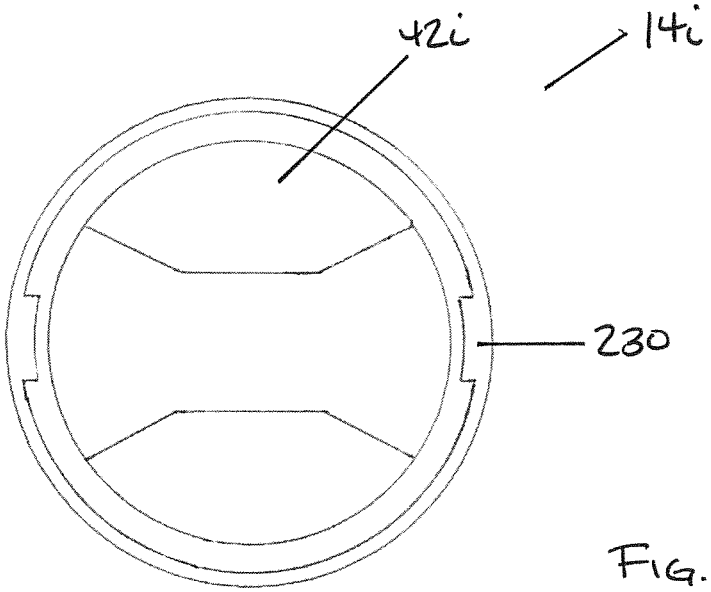
Figure 45:
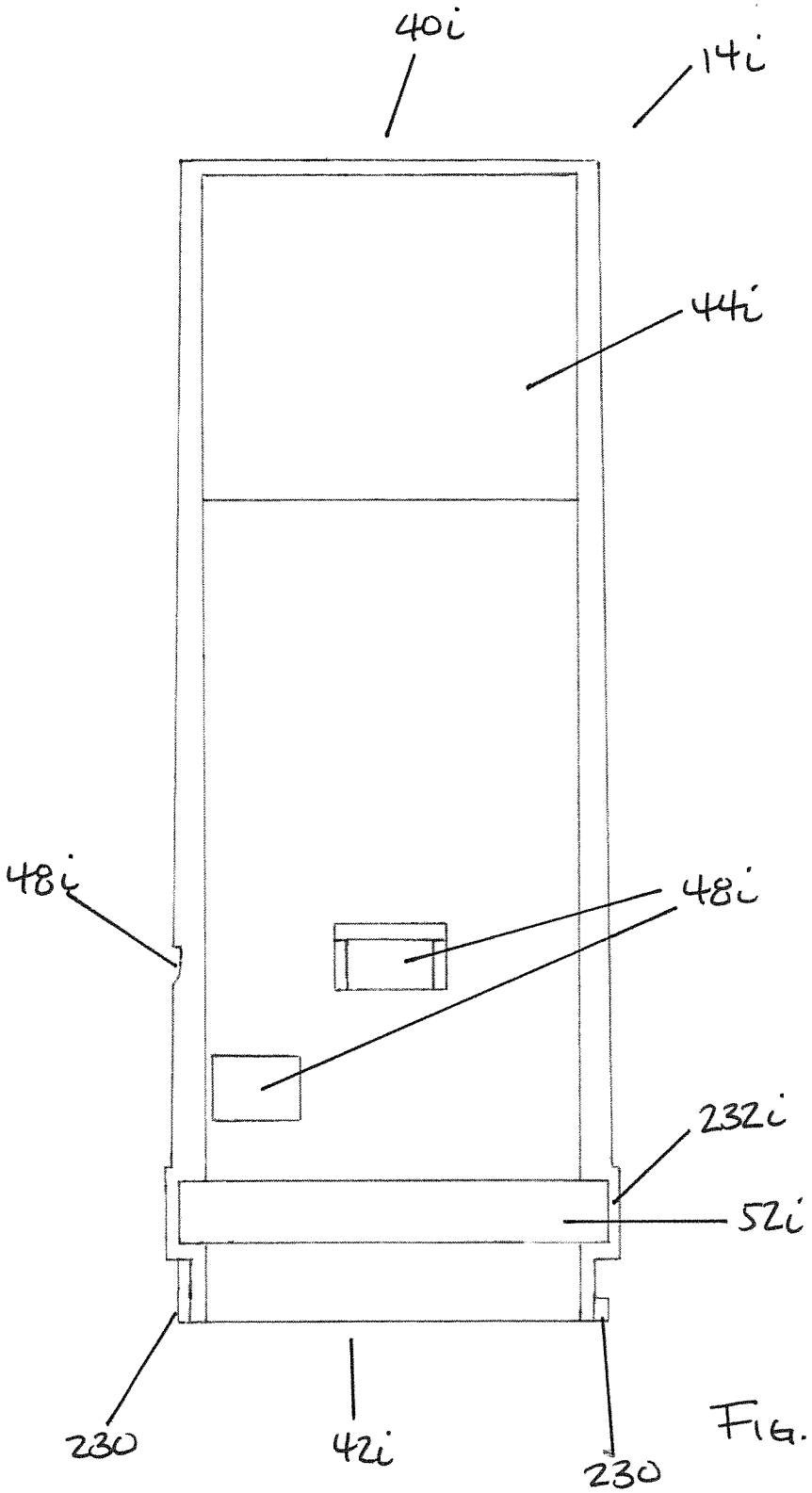
FIG. 45 is a cross-sectional view of the shell of FIG. 44*a*, taken along line X-X.
Figure 46:
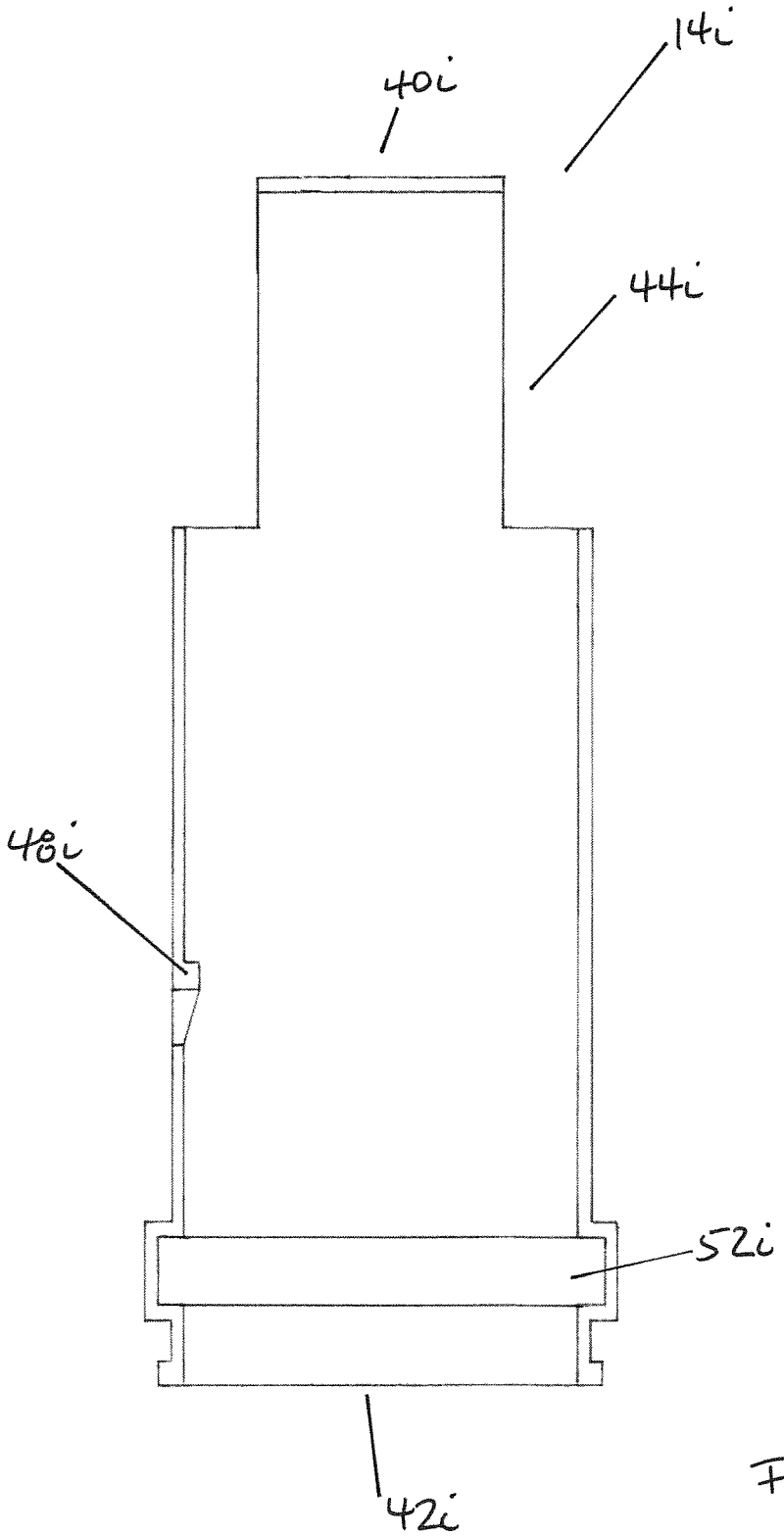
FIG. 46 is a cross-sectional view of the shell of FIG. 44*b*, taken along line Y-Y.
Figure 47A:
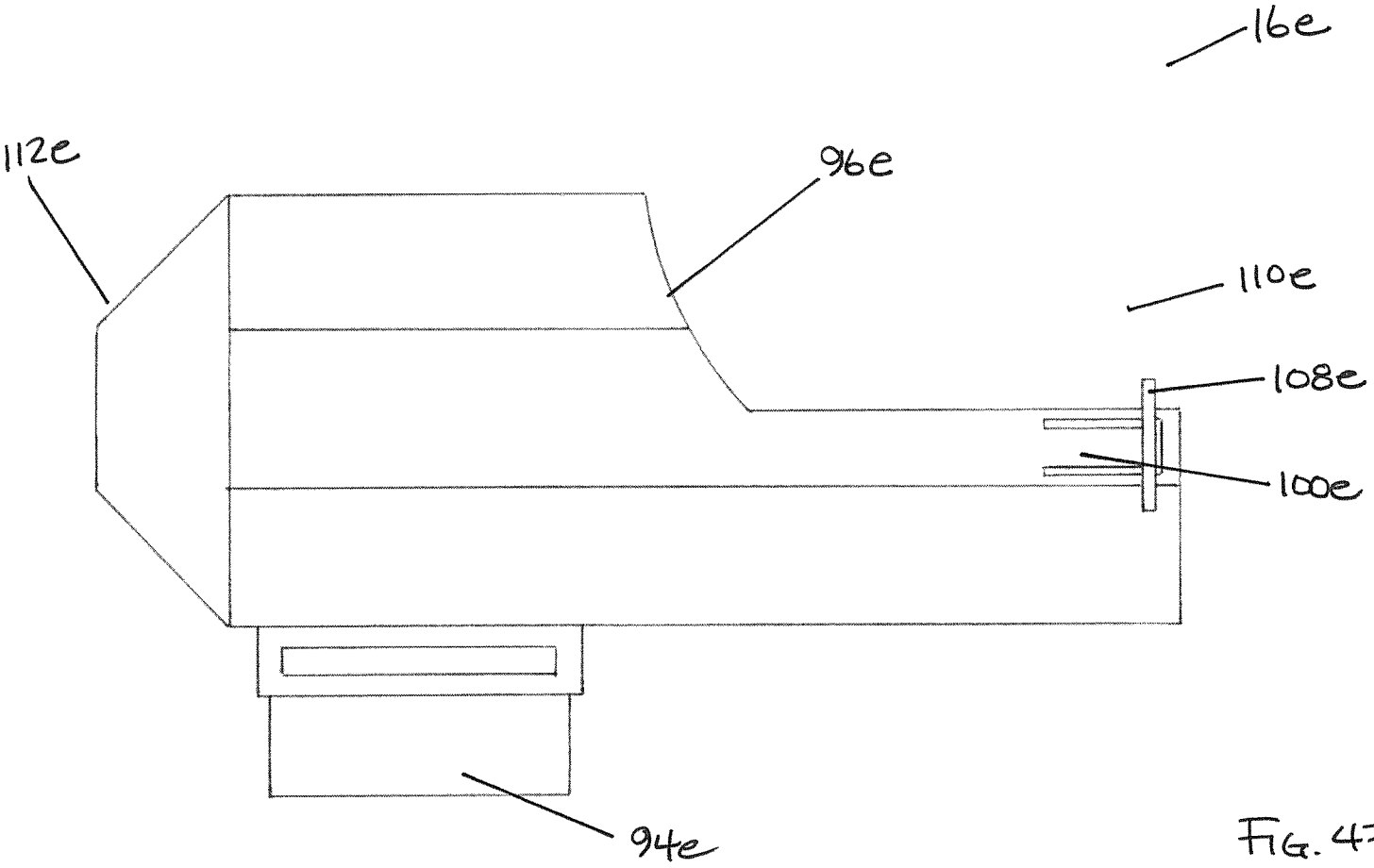
FIGS. 47*a* and 47*b* are side and front views, respectively, of a fifth embodiment of a receiver according to the invention.
Figure 47B:
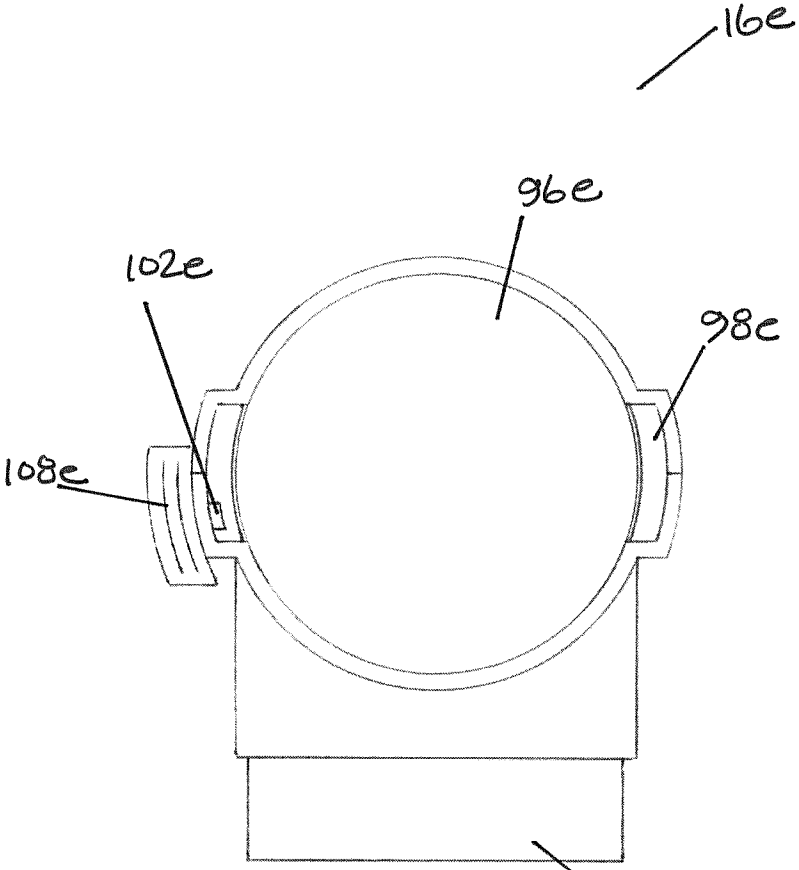

This embodiment also illustrates different configurations for the front end 20*g* of the inner tube 12*g* (FIG. 39*c*) and front end 40*i* of the outer shell 14*i* (FIG. 44*c*). Depending on the size of the paintballs typically being used, it may not be necessary to provide full coverage of the front ends, as long as the combined pieces do not leave any gaps large enough for a paintball to escape.

Figure 48A:
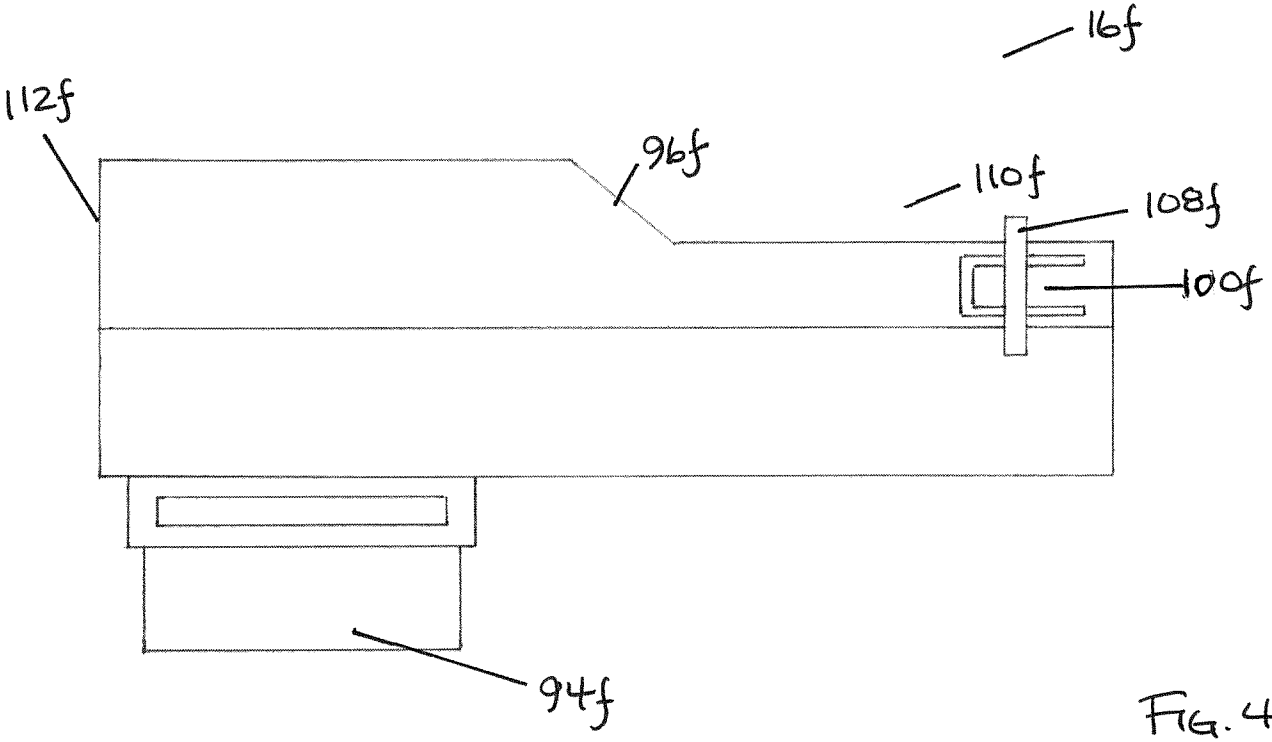
FIGS. 48*a* and 48*b* are side and front views, respectively, of a sixth embodiment of a receiver according to the invention.
Figure 48B:
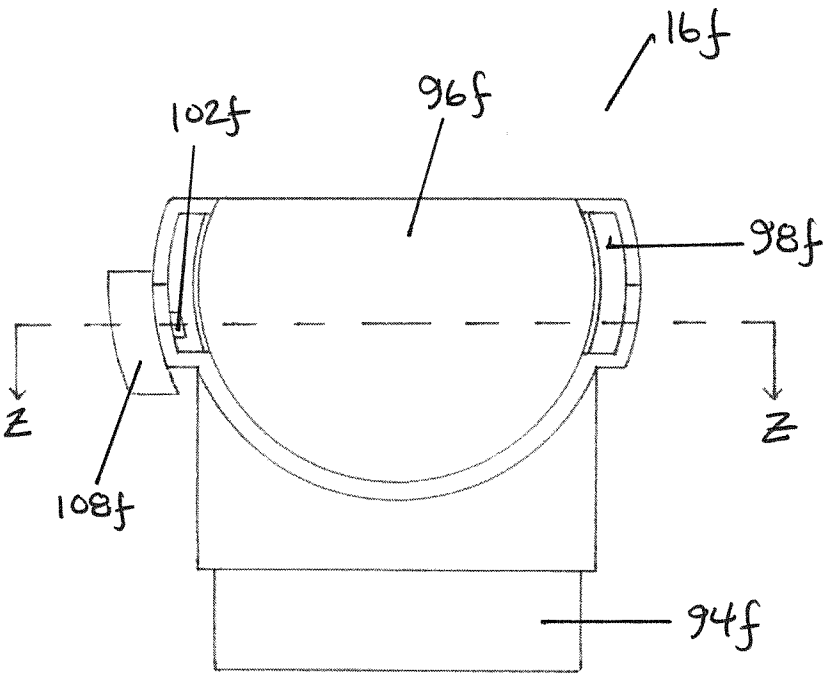
Figure 48C:
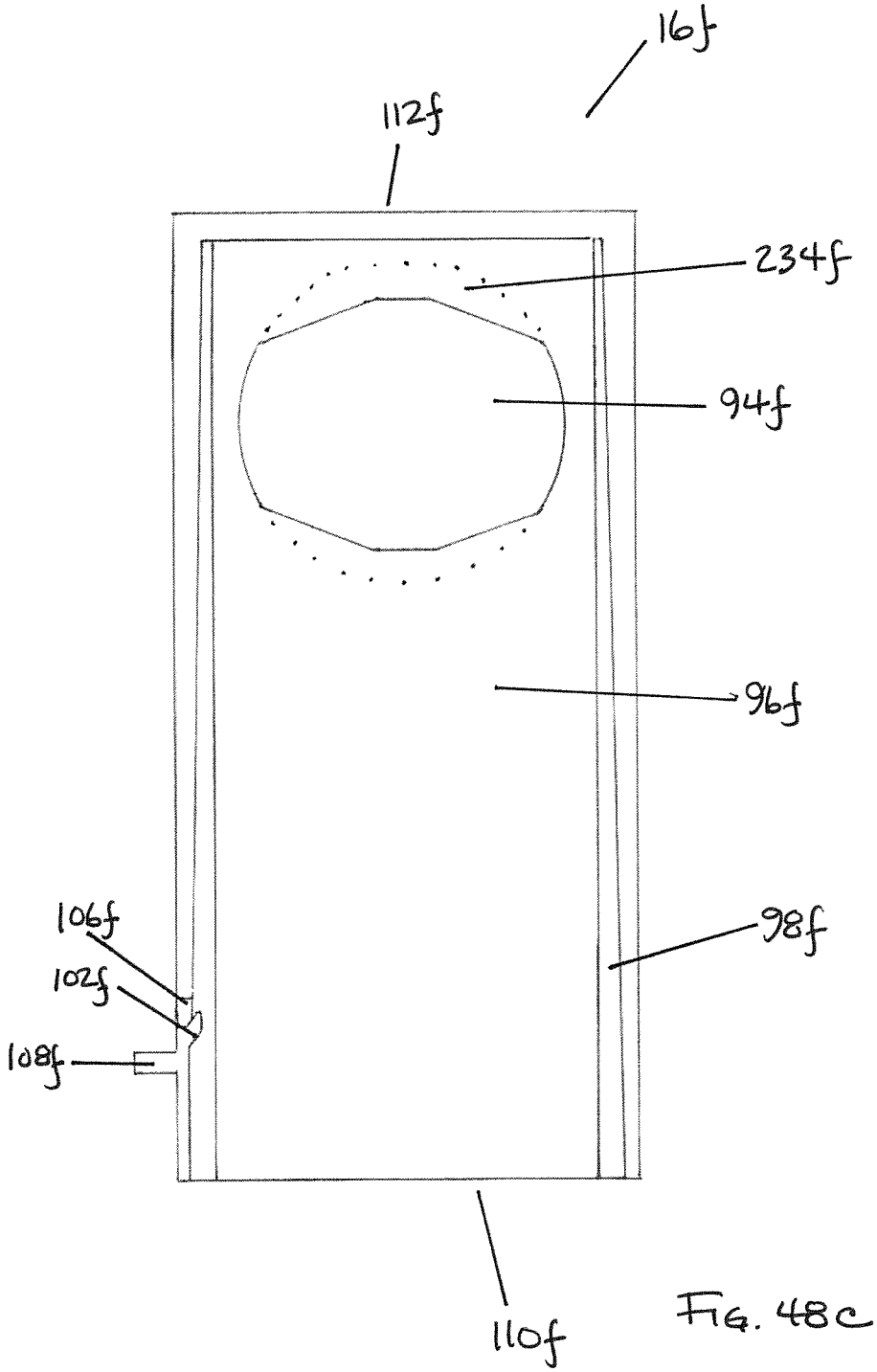
FIG. 48*c* is a sectional view of the receiver of FIG. 48*b*, taken along line Z-Z.

Two embodiments of a receiver 16*e*, 16*f* are shown in FIGS. 47*a-b* and 48*a-b*. These embodiments provide a lock mechanism 100*e*, 100*f* placed on a side of the socket 96*e*, 96*f*, to allow easier access for a user to either push or pull the actuator 108*e*, 108*f* and release the magazine. In a further aspect, FIG. 48*c* shows a rim 234*f*, which extends slightly over the opening into the feed neck 94*f*, and which may prevent paintballs from coming up from the feed neck 94*f* even if the marker is tilted without a magazine in the socket 96*f*, for example, when a user is changing a magazine.

The embodiment of the magazine 10*h* shown in FIGS. 50-54 is similar to the previous embodiment, but includes a connecting means at the front of the magazine. A fastener, such as swivel pin 236*h* or other suitable connecting means, may be provided on the front end 20*h* of inner tube 12*h*, to extend through pin opening 238*j* in the front end 40*j* of outer shell 14*j*. It will be understood that the swivel pin 236*h* may instead be placed on outer shell 14*j* and extend through an opening in the front end 20*h* of inner tube 12*h*. In this embodiment, it may be less important to secure the rear end 22*h* of the inner tube 12*h* directly to the outer tube 14*j*; accordingly the guide channel and guide tabs may be eliminated. As another option, core 216*h* may be manufactured with inner tube 12*h*, (see e.g. FIG. 51*b*), further reducing the number of pieces included with the magazine.

The embodiment of the magazine 10*i* shown in FIGS. 55-59 illustrates that it is possible to obtain a satisfactory and secure engagement between the inner tube 12*i* and outer shell 14*k*, and therefore minimizing the required connecting mechanisms simply by providing carefully sized parts. In this embodiment a friction fit material 240*i* may be provided on the outside of inner tube 12*i*, as shown, or at any other suitable point within the magazine to take up any slack that might be present. It is also possible to provide a gripper 28*i* that is integral with inner tube 12*i*, as there is no need for a complex locking mechanism. This reduces the number of major parts in a complete magazine to two: the inner tube 12*i* and the outer shell 14*k*, along with any closure means necessary to secure the ends of the magazine.

It is also possible to provide inner tubes having configurations designed to minimize the weight of the tube. FIGS. 60*a*-63*b* show views of inner tube embodiments 12*j*, 12*k*, 12*l*, 12*m*, in which various portions of the tube body 18*j*, 18*k*, 18*l*, 18*m* are cut out. Such weight reducing designs are not limited to the exact configurations shown, but may be provided in any configuration or combination of configurations as long as the overall integrity of the tube 12*j*, 12*k*, 12*l*, 12*m* is not compromised. Further, while the figures include twist guides 128, it will be understood that those maybe replaced by, for example pull guides 169 (not shown), or a combination, as may be preferred.

Figure 69:
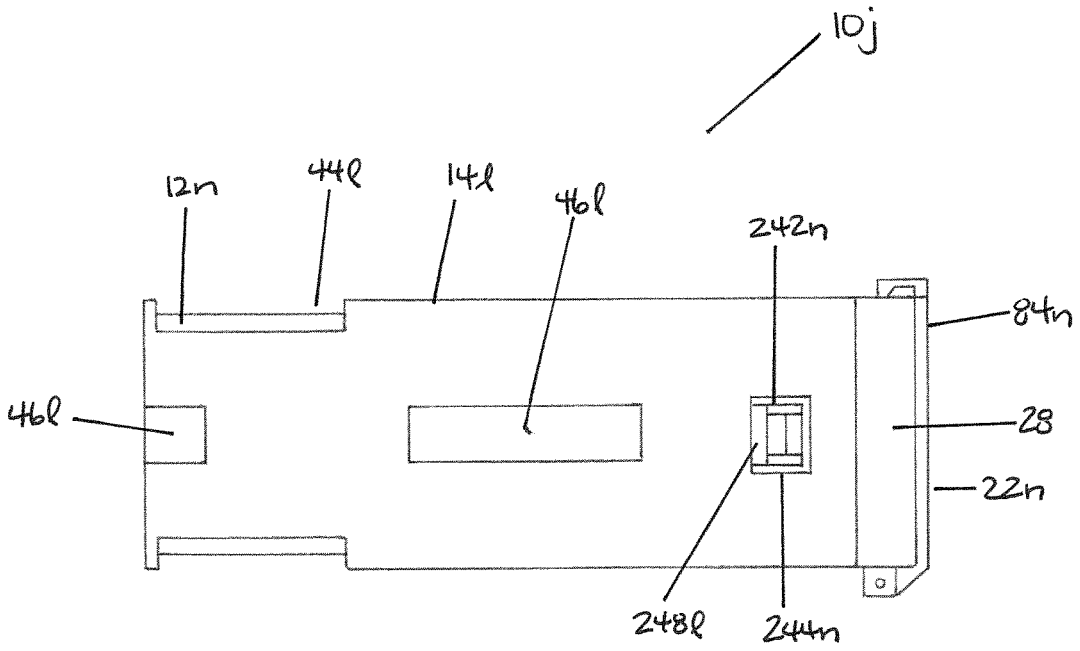
FIG. 69 is a side view of an assembled magazine according to a tenth embodiment of the invention.
Figure 70:
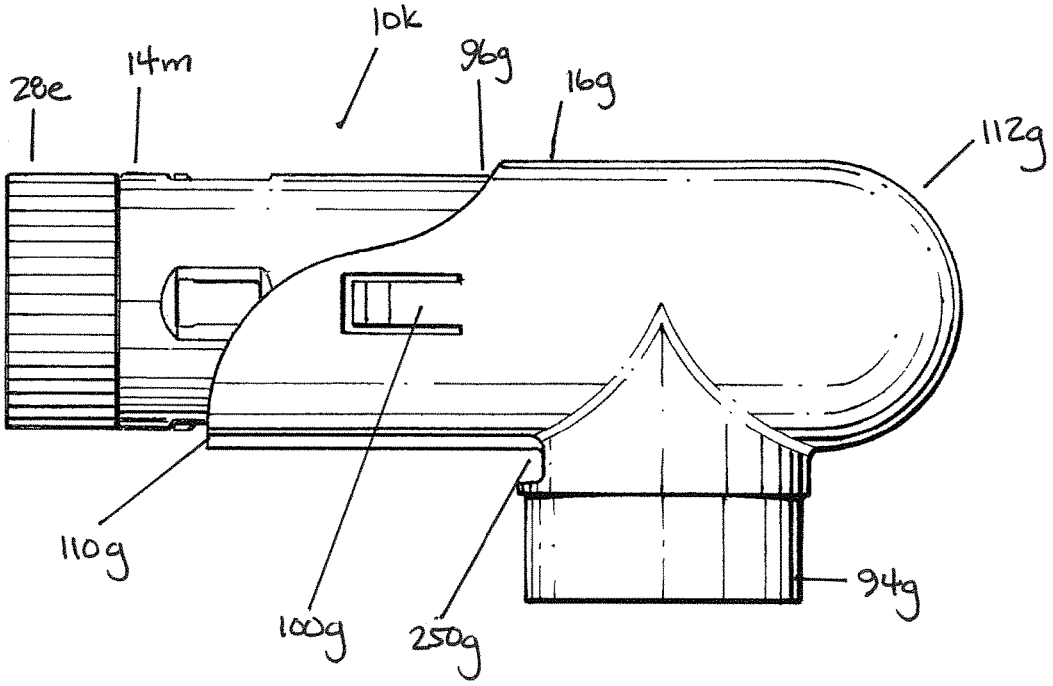
FIG. 70 is a side view of an eleventh embodiment of a magazine assembly according to the invention.
Figure 71:
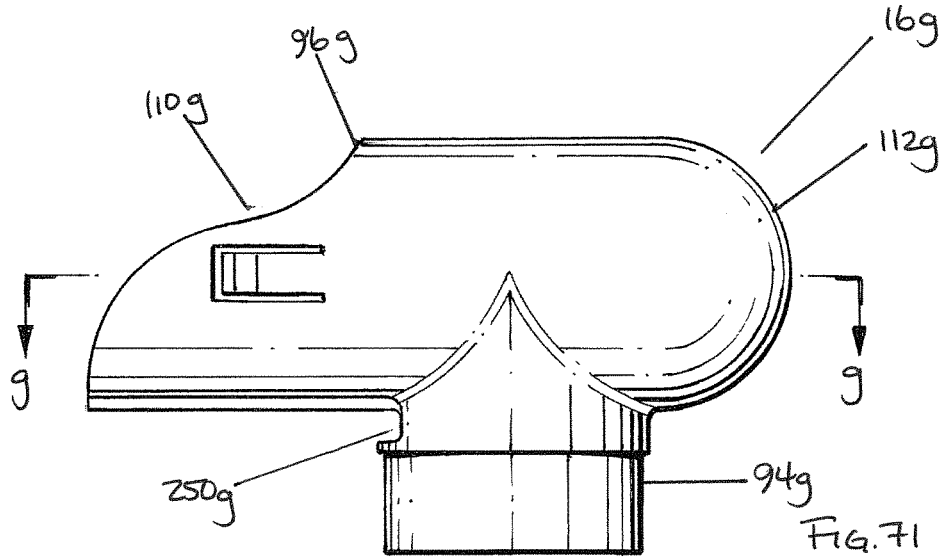
FIG. 71 is a side view of a seventh embodiment of a receiver according to the invention.
Figure 72:
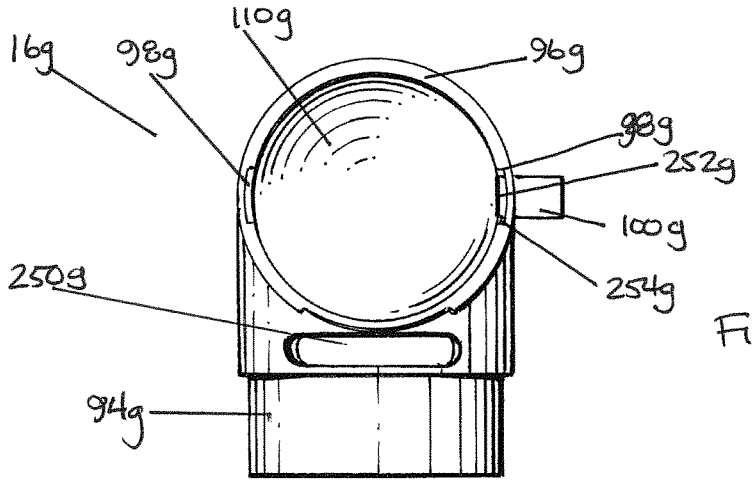
FIG. 72 a front view of the receiver of FIG. 71.

In the embodiment of the magazine 10*j* shown in FIGS. 65*a*-69 the refill cap 84 is provided as a hinged cover, which may be easier to manipulate than a threaded cap or plug. The connection between the inner tube 12*n* and outer shell 14*l* is made via one or more clips 242*n*, which engage with a channel 246*l* within the outer shell 14*l*, and lock into corresponding lock holes 248*l* in the channel 246*l*, in a manner similar to flex locks and lock slots in other embodiments. However, the clip 242*n* may be provided with beveled edges 244*n* such that simple rotation of the arming mechanism provides enough force to move a clip 242*n* out of engagement with a lock hole 248*l* and ninety degrees along the channel 246*l*, to reengage with the next lock hole 248*l*. In the illustrated exemplary embodiment, there are four evenly spaced lock holes 248*l*, and a pair of opposed clips 242*n*. When the magazine is not in use, the clips 242*n* are oriented such that the apertures in inner tube 12*n* do not line up with the apertures 44*l* in outer shell 14*l*, as shown in FIG. 69. When the magazine 10*j* is to be opened to provide paintballs, the rear end 22*n* may be gripped and rotated a quarter turn, moving the lock clips 242*n* out of engagement with the current lock holes 248*l*, and into engagement with the next pair of lock holes 248*l*. The apertures 24*n* of the tube 12*n* and 44*l* of the outer shell 14*l* are then aligned, freeing paintballs to fall out of the magazine. This embodiment also illustrates the ability to provide discontinuous rails 46*l*, or rails of varying size and cross-section, as long as the ability to successfully engage with the receiver is not compromised.

FIGS. 70-73 illustrate another embodiment of magazine assembly 10*k* of the invention. Receiver 16*g* comprises a feed neck 94*g* through which paintballs received from magazine 10*k* are passed to the marker. Feed neck 94*g* may be of any suitable configuration such that its exterior may be securely mounted on the marker. The receiver 16*g* may be flat as shown, or tilted slightly with respect to the marker, by changing the shape and/or angle of the feed neck 94*g*. The means by which the receiver 16*g* is mounted may be any suitable means, such as clamping, friction fit, pressure fit, or any other means suited to or dictated by the particular marker and does not form part of the present invention. Feed neck 94*g* may be provided with a window 250*g*, through which a user may monitor the level of paintballs remaining within the receiver 16*g*.

Receiver 16*g* also includes an opening, such as socket 96*g*, shaped and sized to receive a portion of a magazine and to secure it within the depths of the opening 110*g*. Receiver 16*g* further includes a guide by which a user can ensure that a magazine is being correctly inserted into socket 96*g*. In the embodiment shown, a pair of opposed guide slots 98*g* are provided, which would accommodate opposed guide rails 46*m* located on outer shell 14*m* (best shown in FIGS. 78*a*-78*d*), as will be discussed, but it will be understood that any suitable number of guide slots 98*g* may be provided, and that they may be placed in any suitable orientation within receiver 16*g*. Further, the dimensions of guide slots 98*g* may change, for example by tapering, in order to facilitate the insertion of a magazine into the receiver 16*g*. It will also be understood that guide rails may be used on the receiver instead of guide slots, which would accommodate guide slots in an embodiment of an outer shell containing guide slots instead of guide rails, some of which have been discussed earlier.

Receiver 16*g* further preferably comprises a magazine lock mechanism 100*g* that interacts with a magazine to secure it within the socket 96*g*. Magazine lock mechanism 100*g* comprises a catch 252*g* that protrudes into socket 96*g* through an opening 254*g*. The catch 252*g* is located and sized to interact with lock pocket 47*m* and an end of rail 46*m* on outer shell 14*m* (shown only in FIGS. 78*a*-78*b* and 79*a*-79*b*), such that when the magazine is inserted, catch 252*g* automatically engages the lock pocket and rail, locking the magazine in place. When the magazine is to be removed, pressure on the mechanism 100*g* overcomes the biasing force and disengages catch 252*g*, releasing the magazine.

Within the socket 96*g*, this embodiment features an open end 110*g*, which partially covers the magazine. The open end 110*g* simplifies insertion of the magazine into the receiver 16*g* by providing more available area in which to make the correct connection. The socket 96*g* also features a closed end 112*g*, which is intended to encompass the front end of the magazine and cover any exposed apertures in the magazine.

Figure 73:
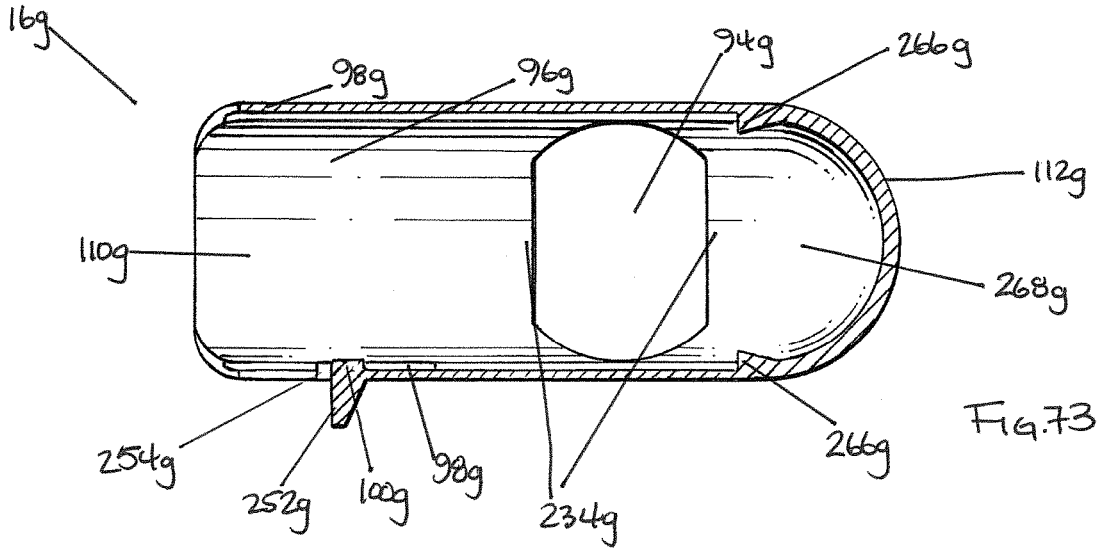
FIG. 73 is a sectional view of the receiver of FIG. 71, taken along line g-g.

In a further aspect, best seen in FIG. 73, a rim 234*g*, which extends slightly over the opening into the feed neck 94*g*, may be provided to prevent paintballs from coming up from the feed neck even if the marker is tilted forwards or backwards without a magazine in the socket 96, for example, when a user is changing a magazine. In this figure, the rim 234*g* is shown as being divided into two identical segments and as being atop two sections of the feed neck 94*g*, but it will be understood that the exact position, shape and number of rim segments may be changed without impairing its functionality.

This view also more clearly shows features that could be present in any of the other receiver embodiments. One or more abutments 266*g* may be provided to stop the insertion of magazine, to ensure that a user does not accidentally push the magazine too far into the closed end 112*g* of receiver 16*g*, possibly jamming and/or damaging the magazine as well as the receiver 16*g*. An overflow area 268*g* may be provided to accommodate paintballs which have accidentally entered the receiver from the feed neck or from the magazine. The overflow area 268*g* allows such paintballs to sit out of the insertion path of a magazine entering into the receiver, minimizing the chance that a loose paintball will get caught and break on such insertion.

Figure 74:
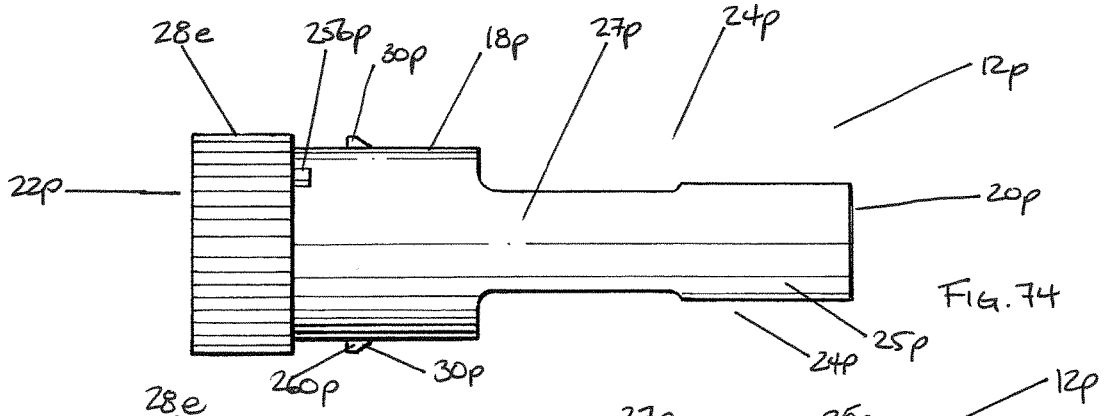
FIG. 74 is a top view of a sixteenth embodiment of an inner tube according to the invention.
Figure 75:
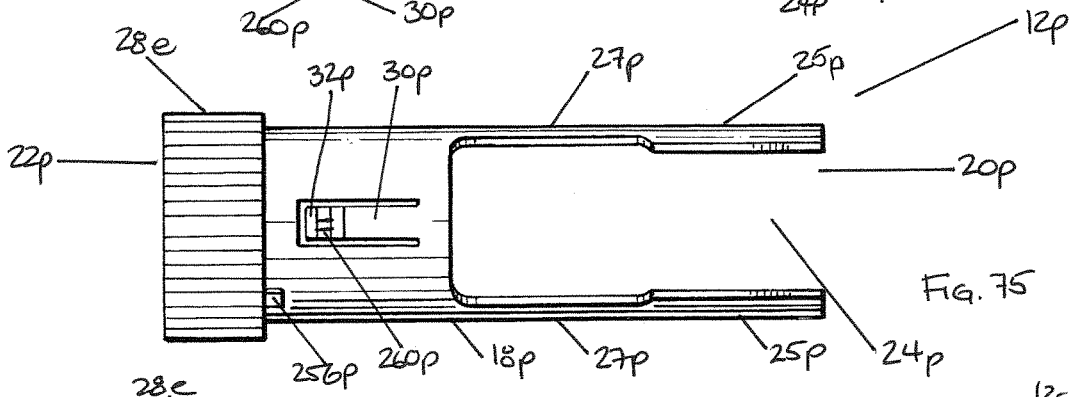
FIG. 75 is a side view of the inner tube of FIG. 74.

In one embodiment, inner tube 12*p*, best seen in FIGS. 74 and 75, comprises a generally tubular body 18*p* having an open front end 20*p* and an opposed rear end 22*p*. One or more tube apertures 24*p* are located on inner tube 12*p*, through which paintballs will flow out of the magazine, once the magazine is properly inserted and armed. One or more aperture covers 25*p* are also provided between and/or beside the tube apertures 24*p*. Aperture covers 25*p* extend between the rear end 22*p* and front end 20*p* on supports such as arms 27*p*, but arms 27*p* may be larger or smaller than shown, or may be shaped differently, and in particular may constitute the entirety of body 18*p*, or may be a solid extension of body 18*p*. Thinner arms 27*p* will reduce the overall weight of the magazine, as will a shorter body 18*p*, or a body consisting entirely of one or more arms 27*p* and aperture covers 25*p*. Tube 12*p* may optionally be provided with one or more internal ramps (not shown), which assist in funneling paintballs within tube 12*p* towards the aperture 24*p* and into the receiver.

Tube 12*p* further comprises one or more flexible guide tabs 30*p*, which allow the tube 12*p* to be inserted and locked into an outer shell, as will be discussed. The guide tabs 30*p* are preferably a pair of opposed guide tabs as shown, but one guide tab may be used without substantially affecting the operation of the tube 12*p*, or two or more guide tabs may be positioned in any suitable places about the circumference of the tube body 18*p*. Flexible guide tabs 30*p* are provided with a release surface or point 32*p*, which acts as a quick release method, allowing the user to separate the inner tube from the outer shell as required merely by pressing the release surface 32*p*.

In this embodiment, the rear 22*p* of the inner tube 12*p* is closed and comprises a gripper 28*e* or similar mechanism by which the inner tube can be easily grasped and securely manipulated to open or close the magazine as well as pushing it into and pulling it out of outer shell. One or more stoppers 256*p* are also positioned on the inner tube and will interact with the outer shell to control the rotation of the inner tube 12*p* within the outer shell, as will be discussed. Such stoppers may be located close to the gripper 28*e* as shown, or at any alternative position within the magazine, including on the outer shell, providing that an appropriate abutment point is given to prevent excessive or undesired rotation of the inner tube within the outer shell.

Figure 76:
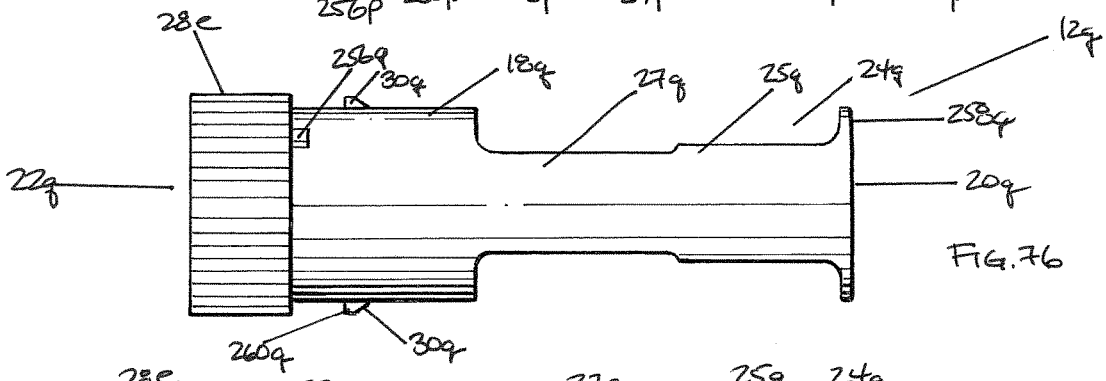
FIG. 76 is a top view of a seventeenth embodiment of an inner tube according to the invention.
Figure 77:
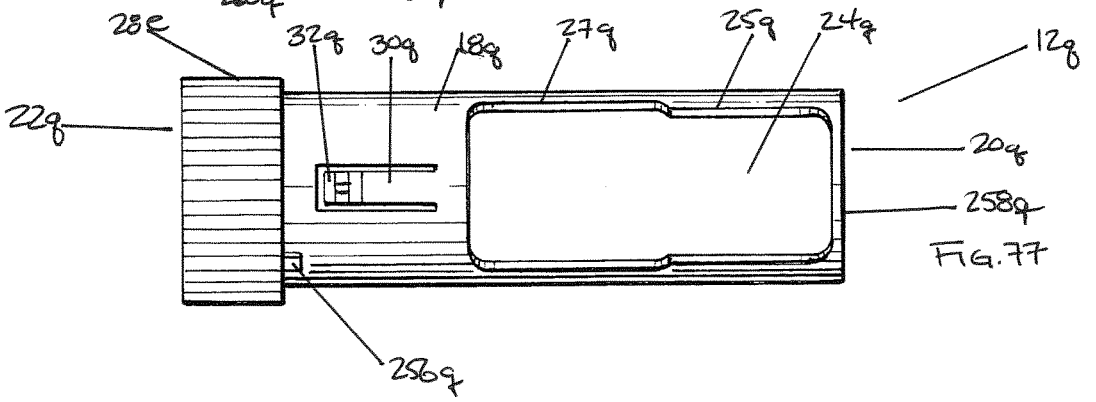
FIG. 77 is a side view of the inner tube of FIG. 76.

In another embodiment, best shown in FIGS. 76 and 77, the front end 20*q* of inner tube 12*q* may comprise a ring 258*q*. This may provide additional stability to the front end 20*q* of the inner tube, and decrease the flexibility of the aperture covers 25*q*, which may protect the paintballs within the magazine. An additional option feature shown in FIGS. 76 and 77 is the provision of one or more angled surfaces 260*q* on guide tabs 30*q*, which allow the user to more easily rotate the inner tube 12*q* within the outer shell, as will be discussed.

In the embodiment of the outer shell 14*m* shown in FIGS. 78*a*-79*b*, outer shell 14*m* comprises a generally cylindrical body 38*m*, sized to fit around an inner tube, having a front end 40*m* and an opposed rear end 42*m*. One or more shell apertures 44*m* is provided in a position to generally correspond with an aperture cover 25*p* on tube 12*p* (inner tube and inner tube features shown only in FIGS. 74-77) to cover shell aperture 44*m* and prevent paintballs from flowing out of the magazine, or to align with a tube aperture 24*p* to allow paintballs to flow out of outer shell 14*m* when the magazine is properly armed. Apertures 44*m* are preferably sized to approximately match the size of aperture covers 25*p*, but may be smaller or may be somewhat larger, as long as any uncovered portion of aperture 44*m* is too small to allow paintballs to pass through or to trap or pinch paintballs in a gap when aperture 44*m* is lined up with aperture cover 25*p*. The rear end 42*m* is open to accommodate the inner tube 12*p*, such that gripper 28*e* abuts the rear of outer tube 14*m*, and stopper 256*p* is accommodated within one or more channels 262*m*. Channel 262*m* preferably does not extend around the circumference of the rear end 42*m*, such that abutment of stopper 256*p* with the end of channel 262*m* prevents excessive rotation of the inner tube 12*p* within the outer shell 14*m*.

The outer shell 14*m* may also be provided with one or more lock slots 48*m*, which interact with flexible guide tabs 30*p* on inner tube 12*p* to affirmatively engage the inner tube 12*p* within outer tube 14*m*. One or more lock slots 48*m* preferably extend through the thickness of the body 38*m* of the outer tube 14*m*, such that release surface 32*p* of guide tabs 30*p* on inner tube 12*p* extends through and can be viewed from the outside of outer tube 14*m* when the tube 12*p* is correctly inserted. One or more lock channels 49*m* extends from each lock slot 48*m*, to control the movement of guide tabs 30*p* for at least part of its rotation, thereby ensuring that the inner tube 12*p* is properly retained within the outer shell 14*m* during the arming and disarming motion. Lock channels 49*m* are shown as comprising a pair of opposed channels, each covering about one quarter of the circumference of the body 38*m*. This may assist in manufacturing and/or in operation of the magazine. However, it will be understood that the channel 49*m* may be provided as a single channel around all or any lesser portion of the circumference of the body 38*m*, or may be one or more channels each covering a portion of the body circumference. A secondary channel 270*m* may be provided to ensure smoother rotation of the inner tube within the outer shell between lock slots 48*m*.

Generally, the guide tabs 30*p* are intended to interact with lock slots 48*m* such that the release surface 32*p* extends through outer tube 14*m* primarily to confirm that the inner tube 12*p* is properly inserted in one of its positions. In this embodiment, guide tabs 30*p* would preferably be provided with one or more angled surfaces 260*p*, such that a simple rotation of the gripper 28*e* will rotate the inner tube 12*p* within the outer tube 14*m* to align the shell aperture 44*m* with the tube aperture 26*p* (arming the magazine) or the aperture cover 25*p* (disarming the magazine). Pulling the inner tube 12*p* by the gripper 28*e* whenever the release surface 32*p* is clear of lock slots 48*m* and lock channels 49*m* will release the inner tube 12*p* from outer shell 14*m*. Alternatively or in addition, pressing on the release surface 32*p* through lock slot 48*m* allows the inner tube 12*p* to be rotated within the outer tube 14*m* to arm or disarm the magazine, and to disengage the guide tabs 30*p* from the lock slots 48*m* and lock channels 49*m*, thereby allowing the inner tube 12*p* to be pulled out of outer tube 14*m*.

A guide mechanism, shown as a pair of opposed guide rails 46*m*, is provided to ensure that the outer shell 14*m* inserts properly into a receiver. Guide rails 46*m* may be continuous or may be sectional as shown. One or more lock pockets 47*m* may be provided around one or more pieces of guide rails 46*m* to assist with retention of the magazine within a receiver, as previously discussed. The guide mechanism provided to ensure accurate insertion of the outer shell 14*m* into a receiver may alternatively be a pair of opposed guide slots, as discussed earlier with respect to other embodiments.

Figure 78A:
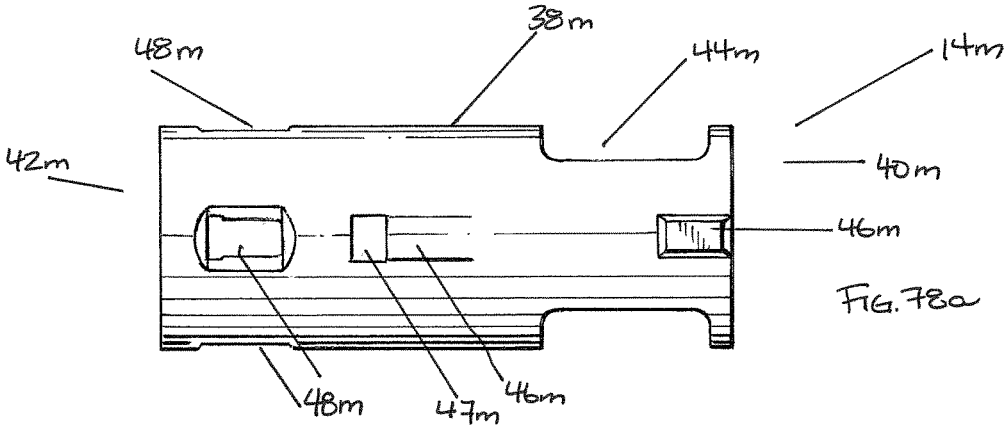
FIGS. 78*a*-78*d* are side, top, rear and front views, respectively, of a thirteenth embodiment of an outer shell according to the invention.
Figure 78B:
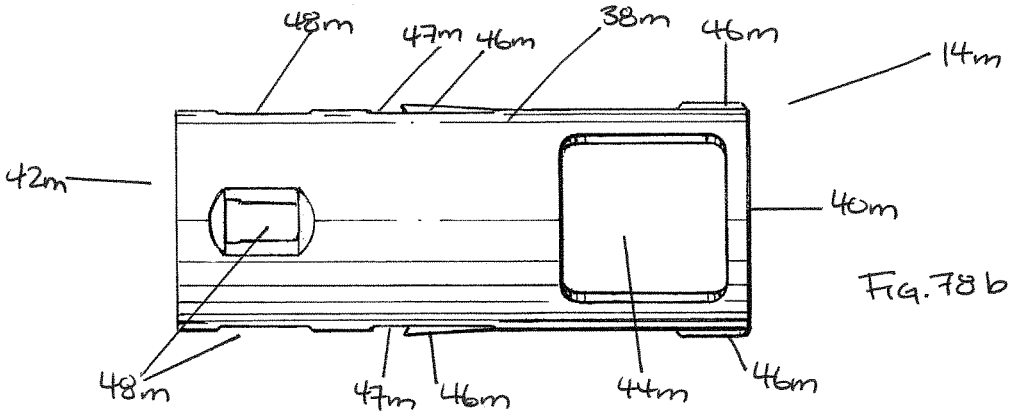
Figure 78C:
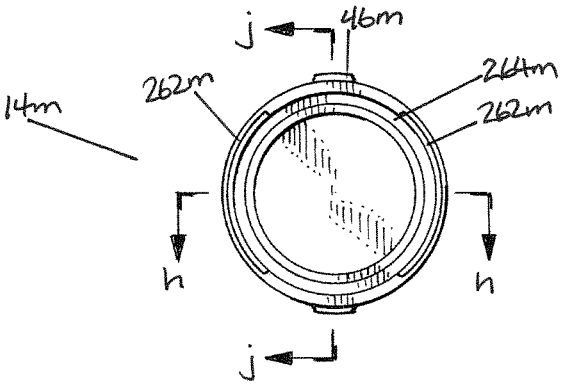
Figure 78D:
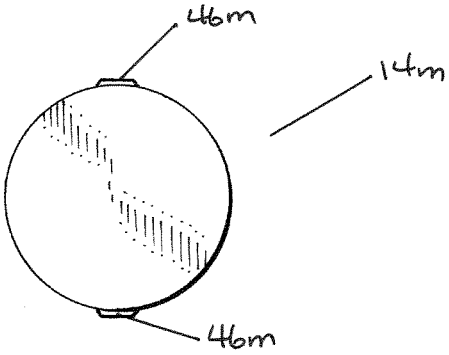
Figure 79A:
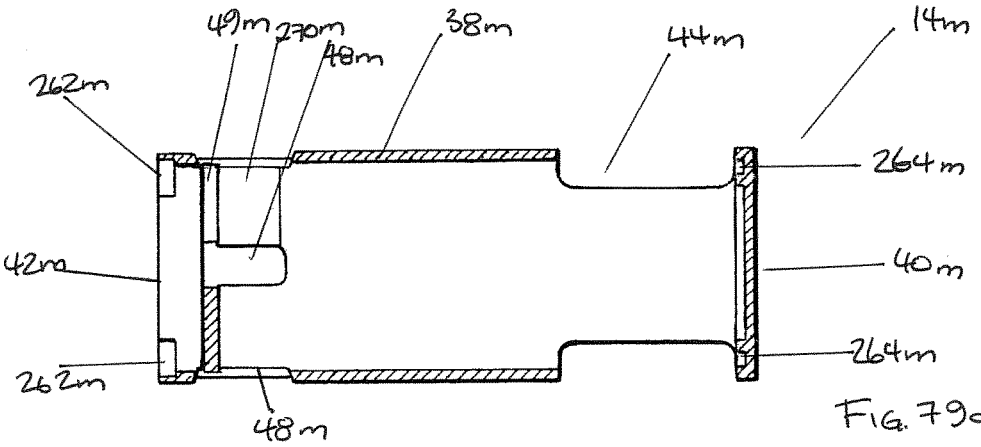
FIGS. 79*a* and 79*b* are sectional views of the outer shell of FIG. 78, taken along line h-h and line j-j.
Figure 79B:
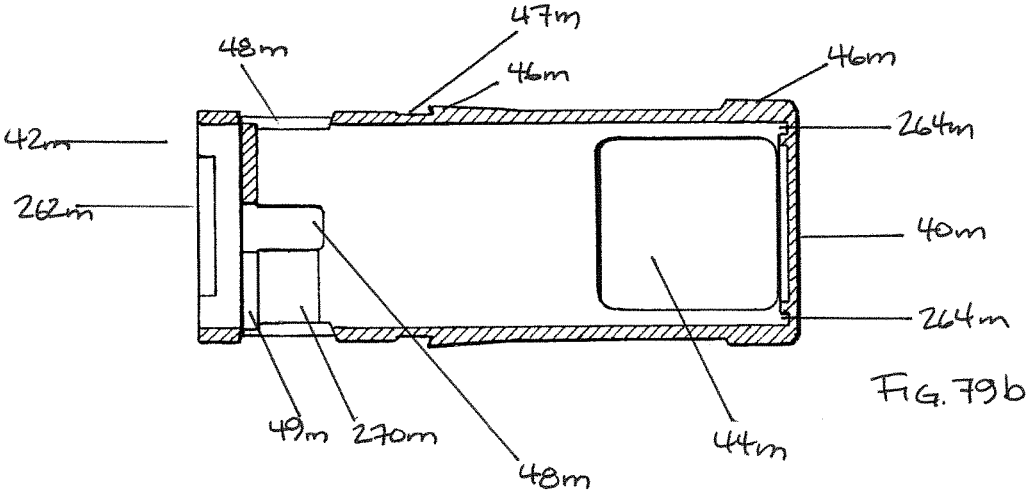

As best seen in FIG. 78*c*, the front end 42*m* of outer shell 14*m* may comprise a groove 264*m*. Groove 264*m* is shaped and sized to snugly accommodate the front end of an inner tube, thus providing support to the tube. This allows front end 20*p* of inner tube 12*p* to be an incomplete circle as shown in FIGS. 74 and 75, or a complete circle 20*q* as shown in FIGS. 76 and 77, to provide additional support for the inner tube 12*q*. Groove 264*m* is shown as circular, but it may be shaped to accommodate any shape or inner tube.

It will be appreciated that the various features have been illustrated alone and in combination with each other, but that specific individual features of each of the inner tube, outer shell, gripper, refill cap or plug, and receiver may be used as appropriate with any of the embodiments or combinations thereof that have been described. For example, some of the features of the later embodiments, such as removal of various portions of the inner tube to reduce the overall weight of the magazine, are shown as modifications to some of the earlier embodiments in FIGS. 60*a*-63*b*. However, these exemplary combinations are not exhaustive.

Further, while the various components of the magazine assembly have been identified with reference numbers in combination with letters to denote like parts as used in different embodiments, it will be understood that components are not limited to combinations with other components having the same letter, or to the specific combinations of embodiments illustrated herein. For example, receiver 16*a* may be used with magazines besides 10*a*, and magazine 10*a* may comprise other than inner tube 12*a* and outer shell 14*a*, and receiver 16*g* may be used with magazines other than that denoted as 10*k*. Unless the components are clearly unsuited to being combined (for example because of features such as shape), specific individual features of each of the components may be used as appropriate with any of the embodiments or combinations thereof that have been described.

It will also be appreciated that several features, such as slots, tabs, apertures, channels, chamfers, openings and blocks have been illustrated, but that the exact shape and dimensions of such parts may be adjusted as required, for example for ease of manufacturing, without affecting the overall working and performance of the magazine or receiver.

In the foregoing specification, the invention has been described with reference to specific embodiments thereof. However, the scope of the claims should not be limited by the preferred embodiments set forth in the examples, but should be given the broadest interpretation consistent with the description as a whole. The specification and drawings are, accordingly, to be regarded in an illustrative rather than a restrictive sense.

What is claimed is:

1. A magazine for storing and feeding paintballs to a paintball marker, said magazine comprising:

an inner tube adapted to hold paintballs, said inner tube comprising at least one aperture;

an outer shell sized to at least partially enclose said inner tube, said outer shell comprising at least one aperture through which paintballs will flow into said marker; and an arming mechanism operatively connected to said inner tube to move said inner tube within said outer shell when said arming mechanism is twisted or pulled, to thereby align said apertures and to allow flow of said paintballs from said magazine to said paintball marker.

2. The magazine of claim 1 wherein said arming mechanism comprises a gripper having at least one aperture cover extending therefrom, and actuation of said gripper causes said aperture cover to cover or uncover said outer shell aperture.

3. The magazine of claim 2 wherein said gripper comprises a slip lock mechanism.

4. The magazine of claim 2 wherein said gripper further comprises a refill means through which paintballs may be inserted into said magazine.

5. The magazine of claim 1 wherein said outer shell further comprises a refill means through which paintballs may be inserted into said magazine.

6. The magazine of claim 1 wherein said outer shell comprises one or more channels to control movement of said arming mechanism.

7. The magazine of claim 1, further comprising an outer shell guide, adapted for insertion into a receiver guide in a receiver on said marker.

8. The magazine of claim 1, further comprising at least one internal ramp to assist in funneling said paintballs toward said aperture.

9. The magazine of claim 1 wherein said outer shell has a non-circular cross-section.

10. The magazine of claim 1 wherein said outer shell comprises two or more pieces.

11. The magazine of claim 1 wherein said inner tube further comprises at least one aperture cover bounding said at least one inner tube aperture;

wherein said arming mechanism aligns said outer tube aperture and said aperture cover to prevent paintballs from flowing from said magazine.

12. The magazine of claim 11 wherein said inner tube further comprises a refill means through which paintballs may be inserted into said magazine.

13. The magazine of claim 11, wherein said arming mechanism and said inner tube are inseparable.

14. The magazine of claim 11 wherein said arming mechanism is a gripper.

15. The magazine of claim 14 wherein said gripper is attached to said inner tube by a threaded connection.

16. The magazine of claim 15 wherein said gripper farther comprises a locking mechanism to prevent said inner tube from moving within said outer shell.

17. The magazine of claim 11 further comprising:
an inner tube lock on said inner tube; and
an outer shell lock in said outer shell;
wherein said outer shell lock is adapted to receive said inner tube lock to removably secure said inner tube within said outer shell.

18. The magazine of claim 17 wherein said inner tube lock comprises a flexible guide tab and said outer shell lock comprises a guide slot.

19. The magazine of claim 17 wherein said inner tube lock comprises a guide slot and said outer shell lock comprises a flexible guide tab.

20. The magazine of claim 17 wherein said outer shell lock comprises a swivel pin and said inner tube lock comprises an opening to accommodate said swivel pin.

21. The magazine of claim 17 wherein said inner tube lock comprises a swivel pin and said outer shell lock comprises an opening to accommodate said swivel pin.

22. The magazine of claim 17 wherein said inner tube lock comprises at least one clip and said outer shell lock comprises at least one lock hole.

23. The magazine of claim 11 wherein said outer shell further comprises a closed front end and a groove within said front end to accommodate a front end of said inner tube.

24. The magazine of claim 11 wherein said inner tube has a non-circular cross-section.

25. The magazine of claim 11 further comprising friction fit material between said inner tube and said outer shell.

26. The magazine of claim 11 wherein said inner tube further comprises a stopper mechanism to control rotation of said inner tube within said outer shell.

27. The magazine of claim 1 further comprising a locking mechanism to prevent said arming mechanism from moving within said outer shell.

28. The magazine of claim 1 further comprising a stopper mechanism to control rotation of said arming mechanism within said outer shell.

29. The magazine of claim 1 wherein said magazine further comprises a locking mechanism to secure said magazine to a receiver in said marker.

30. A loading and feeding assembly for a paintball marker comprising:
a magazine adapted to hold paintballs said magazine comprising:
an inner tube adapted to hold paintballs said inner tube comprising at least one aperture;
an outer shell sized to at least partially enclose said inner tube, said outer shell comprising at least one aperture through which paintballs will flow into said marker; and
an arming mechanism operatively connected to said inner tube to move said inner tube within said outer shell when said arming mechanism is twisted or pulled, to thereby align said apertures and to allow flow of said paintballs from said magazine to said paintball marker; and
a receiver mountable on said marker, said receiver comprising:
an opening in communication with a feed neck, said opening being adapted to receive and enclose a portion of said magazine; and
at least one guide within said opening to guide insertion of said magazine into said opening.

31. The assembly of claim 30, wherein said receiver further comprises a window for viewing paintballs within said marker.

32. The assembly of claim 30, wherein said receiver farther comprises a flexible catch to hold said magazine within said opening.

33. The assembly of claim 30 further comprising a locking mechanism to prevent said arming mechanism from moving within said outer shell.

34. The assembly of claim 30 further comprising a stopper mechanism to control rotation of said arming mechanism within said outer shell.

35. The assembly of claim 30 wherein said inner tube further comprises at least one aperture cover bounding said at least one inner tube aperture;
wherein said arming mechanism aligns said outer tube aperture and said aperture cover to prevent paintballs from flowing from said magazine.

36. The assembly of claim 35 wherein said inner tube further comprises a stopper mechanism to control rotation of said inner tube within said outer shell.

37. The assembly of claim 35 further comprising:
an inner tube lock on said inner tube; and
an outer shell lock in said outer shell;
wherein said outer shell lock is adapted to receive said inner tube lock to removably secure said inner tube within said outer shell.

38. The assembly of claim 37 wherein said inner tube lock comprises a flexible guide tab and said outer shell lock comprises a guide slot.

39. The assembly of claim 37 wherein said inner tube lock comprises a guide slot and said outer shell lock comprises a flexible guide tab.

40. The assembly of claim 37 wherein said outer shell lock comprises a swivel pin and said inner tube lock comprises an opening to accommodate said swivel pin.

41. The assembly of claim 37 wherein said inner tube lock comprises a swivel pin and said outer shell lock comprises an opening to accommodate said swivel pin.

42. The assembly of claim 37 wherein said inner tube lock comprises at least one clip and said outer shell lock comprises at least one lock hole.

43. The assembly of claim 30 wherein said magazine further comprises a locking mechanism to secure said outer shell to said receiver.

44. The assembly of claim 30 wherein said receiver further comprises an overflow area spaced from a path traveled by said magazine upon insertion into said receiver.

45. The assembly of claim 30, wherein said receiver further comprises a rim at a top edge of said feed neck to prevent paintballs from travelling towards said magazine.

* * * * *